US007029813B2

(12) United States Patent
Mikuriya et al.

(10) Patent No.: US 7,029,813 B2
(45) Date of Patent: Apr. 18, 2006

(54) TONER

(75) Inventors: Yushi Mikuriya, Shizuoka (JP); Yasushi Katsuta, Shizuoka (JP); Keiji Komoto, Shizuoka (JP); Takeshi Kaburagi, Shizuoka (JP); Emi Tosaka, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 146 days.

(21) Appl. No.: 10/717,452

(22) Filed: Nov. 21, 2003

(65) Prior Publication Data

US 2005/0026061 A1 Feb. 3, 2005

(30) Foreign Application Priority Data

Jul. 30, 2003 (JP) ..... 2003-203861

(51) Int. Cl.
*G03G 9/097* (2006.01)

(52) U.S. Cl. ..... 430/108.1; 430/108.6; 430/109.1; 430/111.4

(58) Field of Classification Search ..... 430/108.1, 430/108.6, 109.1, 111.4
See application file for complete search history.

(56) References Cited

U.S. PATENT DOCUMENTS

| | | | | |
|---|---|---|---|---|
| 2,297,691 | A | 10/1942 | Carlson | |
| 4,301,355 | A | 11/1981 | Kimbrough et al. | |
| 4,990,424 | A | 2/1991 | Van Dusen et al. | 430/106.6 |
| 5,547,800 | A | 8/1996 | Nishimori et al. | 430/110 |
| 5,604,072 | A | 2/1997 | Unno et al. | 430/110 |
| 5,629,118 | A | 5/1997 | Tomono et al. | 430/99 |
| 5,629,123 | A | 5/1997 | Tomono et al. | 430/110 |
| 5,744,571 | A * | 4/1998 | Hilbert et al. | 528/272 |
| 6,346,070 | B1 | 2/2002 | Ohmatsuzawa et al. | 529/279 |
| 6,451,959 | B1 | 9/2002 | Ohmatsuzawa et al. | 528/279 |
| 2002/0137879 | A1 | 9/2002 | Ohmatsuzawa et al. | 528/279 |

FOREIGN PATENT DOCUMENTS

| | | |
|---|---|---|
| JP | 52-3304 | 1/1977 |
| JP | 57-52574 | 3/1982 |
| JP | 1-185660 | 7/1989 |
| JP | 1-185661 | 7/1989 |
| JP | 1-185662 | 7/1989 |
| JP | 1-185663 | 7/1989 |
| JP | 1-238672 | 9/1989 |
| JP | 2-79860 | 3/1990 |
| JP | 3-50559 | 3/1991 |
| JP | 4-301853 | 10/1992 |
| JP | 5-61238 | 3/1993 |
| JP | 6-59502 | 3/1994 |
| JP | 01-64378 | 3/2001 |
| JP | 02-148867 | 5/2002 |
| JP | 2002-148867 | 5/2002 |

* cited by examiner

*Primary Examiner*—John L Goodrow
(74) *Attorney, Agent, or Firm*—Fitzpatrick, Cella, Harper & Scinto

(57) ABSTRACT

In a toner having toner particles containing at least a colorant, a release agent and a polar resin, and an inorganic fine powder, the polar resin contains a polyester resin obtained by carrying out polymerization in the presence of a titanium chelate compound as a catalyst, and has an acid value in a specific range. The toner particles are granulated in an aqueous medium and have a weight-average particle diameter in a specific range.

9 Claims, 5 Drawing Sheets

TONER

BACKGROUND OF THE INVENTION

1. Field of the Invention

This invention relates to a toner used in electrophotography, electrostatic recording, electrostatic printing and toner jet recording (magnetic recording).

2. Related Background Art

A number of methods are known as methods for electrophotography (see, e.g., U.S. Pat. No. 2,297,691). In general, copies are obtained by forming an electrostatic latent image on a photosensitive member by various means utilizing a photoconductive material, subsequently developing the latent image by the use of a toner to form a visible image, and transferring the toner (toner image) to a recording material (transfer material) such as paper as occasion calls, followed by fixing by the action of heat and/or pressure. The toner that has not transferred to and has remained on the photosensitive member is cleaned by various means, and then the above process is repeated.

In recent years, it has been put forward to improve such copying apparatus toward higher image quality, smaller size, lighter weight, higher speed and higher reliability with a high demand from users, where the performance of products have severely been investigated. Also, the such image-forming apparatus not only have been used as copying machines for office working to take copies of originals, but also have long been used as digital printers for outputting data from computers or used for copying highly minute images such as graphic designs. In more recent years, with tremendous spread of digital cameras, there is an increasing demand for high-color printers for outputting photographs taken therewith. In the meantime, it has become more and more necessary to consider how to deal with environmental problems, how to deal with energy saving, and so forth.

The step of development may be given as the step of forming electrophotographic images that is difficult for the achievement of higher image quality, higher minuteness and higher stability as those demanded by users.

In electrophotography, the step of developing an electrostatic latent image is the step of utilizing electrostatic mutual action between toner particles having been charged and the electrostatic latent image to form a visible image on the electrostatic latent image. Developers with which electrostatic latent image are developed by the use of toners include a magnetic one-component developer making use of a toner formed of a resin and a magnetic material dispersed therein, a non-magnetic one-component developer which performs development by charging a non-magnetic toner electrostatically by means of a charge-providing member such as an elastic blade, and a two-component developer formed of a blend of a non-magnetic toner with a magnetic carrier.

At present where the technique to expose the photosensitive member to light using small-diameter laser beams or the like has advanced and electrostatic latent images have come minute, it has been put forward to make both toner particles and carrier particles have smaller diameters in any of the above developing systems so that faithful development can be performed on the electrostatic latent images and images can be reproduced in a higher image quality. In particular, it is often attempted to make toners have a smaller average particle diameter to improve image quality.

Making toners have a smaller average particle diameter is an effective means for improving image characteristics, in particular, graininess and character reproducibility. However, it has problems to be solved, in respect of specific image quality items, in particular, fog at the time of extensive printing, melt adhesion to photosensitive member, toner scatter and so forth.

Such problems are firstly caused by a lowering of charge quantity of toners that results from the two things that i) the use of toners over a long period of time causes deterioration of external additives having been added to toner particles and ii) charge-providing members such as a developing sleeve and a carrier and a toner layer thickness control member for keeping the coating of toner on the sleeve to a stated quantity are contaminated by the toner and the external additives, i.e., toner-spent comes about. These phenomena tend to occur as a result of making toners have smaller particle diameters. To amplify the situation, triboelectric charging is performed by means of physical external force such as contact and collision between the toner and the sleeve in the case of one-component developers and between the toner and the carrier in the case of two-component developers, and hence all the toner, the charge-providing members (sleeve and carrier) and the toner layer thickness control member may necessarily be damaged. For example, in the toner, the external additives added to its toner particle surfaces may come buried in toner particles or toner components may come off. In the charge-providing members and the toner layer thickness control member, they may be contaminated with toner components including the external additives, or coat components with which the charge-providing members are coated in order to stabilize charge properly may wear or be broken. Because of such damage, the initial characteristics of the developers become not maintainable with an increase in the number of copying times to cause fog, in-machine contamination and variations of image density. This phenomenon becomes conspicuous especially as the image-element units of electrostatic latent images are made minuter.

Secondly, the above problems may arise because, where an original having a high image area percentage is used and where the toner is fed onto the charge-providing members in a large quantity, it takes a time until the toner having been fed is uniformly charged and the toner uncharged participates in development. This phenomenon occurs remarkably especially when the toner has small diameter and has low fluidity. Any image defects thereby caused tend to come into question when multi-superimposed images are formed in full-color image formation, and are especially required to be remedied. As a countermeasure for this problem, it has been main to make studies on triboelectric series and resistance of the charge-providing members. As the toner, it is also studied to improve various charge control agents so that the toner can quickly be charged.

As the magnetic carrier used in the two-component developer, an iron powder carrier, a ferrite carrier or a carrier coated with a resin obtained by dispersing fine magnetic-material particles in a binder resin is known in the art. In particular, a developer making use of a resin-coated carrier obtained by coating carrier core material surfaces with a resin is preferably used because it can have proper electrical resistance, has superior charge controllability and can relatively easily be improved in environmental stability and stability with time.

In order to overcome an insufficiecny in charging to the small-particle-diameter toner as stated above, it is also a preferable means especially in the two-component developer to make the carrier have a small particle diameter. This, however, tends to make toner-spent resistance poor as the carrier has a larger specific surface area.

To solve these problems, it is attempted to use the carrier in a large quantity. This, however, goes against the downsizing of copying machine or printer main bodies, and is not practical.

Meanwhile, steps which are most important for satisfying the demand of users and are technically difficult include the fixing step.

With regard to the fixing step, various methods and assemblies have been provided. The most commonly available method at present is a pressure-and-heating system making use of a heated roller, film or belt.

The pressure-and-heating system is a system in which the toner image surface of a sheet to which toner images are to be fixed (hereinafter "fixing-medium sheet") is made to pass the surface of a fixing member having a heating source, which member has a surface formed of a material with releasability to the toner (such as silicone rubber or fluorine resin), in contact with a pressure member under application of its pressure against the fixing member to perform fixing. This system is very effective in high-speed electrophotographic copying machines because the toner image on the fixing-medium sheet comes into contact with the surface of the fixing member as a heating member under application of pressure and hence the thermal efficiency in fusing the toner image onto the fixing-medium sheet is so good that the toner image can rapidly be fixed. In this system, however, since the toner image comes into pressure contact with the heating member in a molten state, part of the toner image may adhere, and be transferred, to the heating member surface to contaminate the next fixing-medium sheet (what is called "offset phenomenon"). Accordingly, it is regarded as one of essential conditions to make the toner not adhere to the heating member.

For this reason, for the purpose of preventing the offset, a method in which an oil such as silicone oil is fed to the fixing member to apply the oil uniformly on the fixing member is also used in color copying machines.

This method is very effective in preventing the offset of the toner. However, it requires a unit for feeding such an offset-preventive fluid, and has a problem that it makes the fixing assembly complicate, providing an inhibitory factor in the designing of compact and inexpensive systems. Further, in the case of an overhead projector transparency film or sheet (OHT film or sheet) needed increasingly as its use for presentation, it has a low oil absorption capacity as being different from paper, and hence the stickiness of the OHT film surface has come into question. In the case of paper as well, it has a problem that its surface is not inscribable with a pen using water-based ink or the like because of the oil absorbed therein. Under such background, it is strongly sought to provide full-color toners that are fixable in an oilless system or a system in which the oil is applied in a small quantity.

Under such circumstances, oilless fixing or small-quantity oil application fixing has been materialized in color toners as well, by incorporating a release agent into toner particles.

It is known to incorporating the release agent into toner particles (see, e.g., Japanese Patent Publication No. S52-3304 and Japanese Patent Application Laid-Open No. S57-52574).

Incorporation of the release agent into toner particles is also disclosed in a large number (see, e.g., Japanese Patent Applications Laid-Open No. H03-50559 and No. H02-79860).

The release agent is used in order to improve anti-offset properties at the time of high-temperature fixing or low-temperature fixing of toners, or to improve fixing performance at the time of low-temperature fixing. On the other hand, it may lower anti-blocking properties of toners, may lower developing performance of toners because of in-machine temperature rise, or may lower developing performance of toners because of exudation of the release agent to toner particle surfaces when the toners are left over a long period of time.

It is also disclosed that specifying the modulus of elasticity of toner particles containing a release agent makes it possible to perform oilless fixing. In publications, it is certainly disclosed that specifying viscoelasticity in the vicinity of fixing preset temperatures 150° C. and 170° C. enables achievement of both OHT film transparency and high-temperature anti-offset properties (see Japanese Patent Applications Laid-Open No. H06-59502 and H08-54750). However, in the case of high-speed fixing, in which the temperature of the heating member drops violently at the time of continuous paper feed, the method disclosed has some problems in respect of things relating to fixing, such as faulty fixing at the time of low-temperature fixing, what is called a low-temperature offset phenomenon and faulty paper delivery and placement, and in respect of how to ensure stable developing performance over a long period of time.

Some description is added in regard to the above faulty paper delivery and placement. As a problem in the case of the oilless fixing or small-quantity oil application fixing, the transfer sheet is put out in such a form that it is pulled toward the fixing member after its leading end on the paper delivery side has passed the fixing nip. This is a phenomenon which occurs because of a shortage of releasability between the toner melt surface and the fixing member. In this case, the problem of faulty placement may arise on the paper delivered in a large number of sheets. Also, where the above phenomenon occurs at a serious level, the transfer sheet may wind around the fixing member to cause the faulty paper delivery. In order to prevent this faulty paper delivery, it is attempted to keep a member such as a separation claw in contact with the fixing member or to provide the former in non-contact and bring it into touch with the latter. In the case of keeping the former in contact, the offset toner having stagnated at the separation claw or the like may enlarge the contact pressure on the fixing member to scratch the fixing member surface, so that the fixing performance at that part may lower to cause a difference in gloss from the other part, making the quality level of fixed images different only at that part. In addition, the toner having stagnated at the separation claw may come off at certain timing and transfer to the pressure member to cause what is called back staining where the back of the image-fixed transfer sheet stains. In order to lessen such a phenomenon, it is attempted to bring into touch therewith a web or the like impregnated with silicone oil or the like. This, however, goes against the downsizing of copying machine or printer main bodies as stated above. The phenomenon of wind-around may more occur as the affinity of the toner for the fixing member is higher, and tends to occur more seriously as the fixing speed is higher and the fixing temperature is lower as the makeup of fixing.

As a further demand in the fixing step, toners may be given which are fixable at a low temperature correspondingly to the achievement of energy saving and high speed in copying machine or printer main bodies. In particular, in the formation of full-color images, colors are reproduced using three color toners of coloring matter's three primary colors, yellow, magenta and cyan colors, or four color toners consisting of these color toners and a black toner added thereto. Accordingly, in fixing multi-color toner images onto paper and in fixing them onto the overhead projector transparency sheet (OHT), color reproducibility and transmission properties must be satisfied. Thus, their formation involves a high degree of technical difficulty.

In order to solve these problems, it is preferable to use a resin having sharp-melt properties. In particular, it is attempted to incorporate a polyester resin into toner particles.

The polyester resin affords superior low-temperature fixing performance, but, on the other hand, because of the acid value and hydroxyl value it has, makes it difficult to control charge quantity when made into a toner. Stated specifically, it may make the toner greatly dependent on environment, such that the toner may be charged in excess (what is called charge-up) in an environment of low humidity and charged insufficiently in an environment of high humidity, and it may make the toner have a low rise speed of charging.

As a polymerization catalyst used for producing such a polyester resin for toners, it has commonly been attempted to use a tin type catalyst such as dibutyltin oxide or an antimony type catalyst such as antimony trioxide. These techniques have some problem in respect of fixing performances such as low-temperature fixing performance and high-temperature anti-offset properties which are demanded in full-color copying machines in recent years, how to satisfy color reproducibility such as color mixing properties and transparency, rise characteristics of charging, and how to stably control charge quantity of toners.

Accordingly, it is proposed to use a titanate of a diol as the polymerization catalyst (see Japanese Patent Application Laid-Open No. 2002-148867). It is also proposed to use a solid titanium compound as the polymerization catalyst (see Japanese Patent Application Laid-Open No. 2001-64378). Although the use of a titanium compound as the polymerization catalyst restrains the phenomenon of charge-up of toners, these proposals have not made the rise characteristics of charging well satisfactory.

The use of the resin having sharp-melt properties also usually tends to cause a problem on high-temperature anti-offset properties when the toner melts in the step of heat-and-pressure fixing, because the binder resin has a low self-cohesive force. Accordingly, a relatively highly crystalline wax as typified by polyethylene wax and polypropylene wax is used as the release agent in order to improve the high-temperature anti-offset properties at the time of fixing.

However, in the toners for full-color images, when images are projected using an overhead projector (OHP), their transparency may be obstructed and the projected images may have a low chroma or brightness, because of a high crystallizability of the release agent itself or a difference in refractive index between the release agent and the OHT sheet.

Accordingly, to solve these problems, a method is proposed in which a wax having a low crystallinity is used (see Japanese Patent Applications Laid-Open No. H04-301853 and No. H05-61238). As waxes having a relatively good transparency and a low melting point, montan type waxes are available. Use of such montan type waxes is proposed in a large number (see Japanese Patent Applications Laid-Open No. H01-185660, No. H01-185661, No. H01-185662, No. H01-185663 and No. H01-238672). These waxes, however, have some problems for well satisfying all the transparency in OHP and the low-temperature fixing performance and high-temperature anti-offset properties at the time of heat-and-pressure fixing.

In addition, in any of the above toners incorporated with the release agent, those which afford good developing performance, in particular, the rise characteristics of charging stably over a long period of time do not exist because of the presence of the release agent on toner particle surfaces.

As discussed above, under the existing conditions, any toner has not yet been made available which has achieved both the fixing performance that can realize low-cost, compact and high-speed machines and the developing performance that can satisfy image quality level over a long period of time.

SUMMARY OF THE INVENTION

An object of the present invention is to provide a toner which has solved the above problems and has superior low-temperature fixing performance and high-temperature anti-offset properties.

Another object of the present invention is to provide a toner which has superior color reproducibility such as color mixing properties and transparency in color toners.

Still another object of the present invention is to provide a toner which can realize images with high image quality as having so quick rise of charging that stable charge quantity can be held in any environment.

As a result of repeated extensive studies, the present inventors have discovered that the above requirements can be satisfied by using a binder resin synthesized in the presence of a certain specific polymerization catalyst.

That is, to achieve the above objects, the present invention provides a toner comprising toner particles containing at least a colorant, a release agent and a polar resin, and an inorganic fine powder, wherein;

the polar resin contains a polyester resin obtained by carrying out polymerization in the presence of at least a titanium chelate compound as a catalyst, and has an acid value of from 3 mg·KOH/g to 35 mg·KOH/g;

the toner particles are obtained by carrying out granulation in an aqueous medium; and the toner has a weight-average particle diameter of from 4 μm to 10 μm.

DESCRIPTION OF THE PREFERRED EMBODIMENTS

Figure 1:
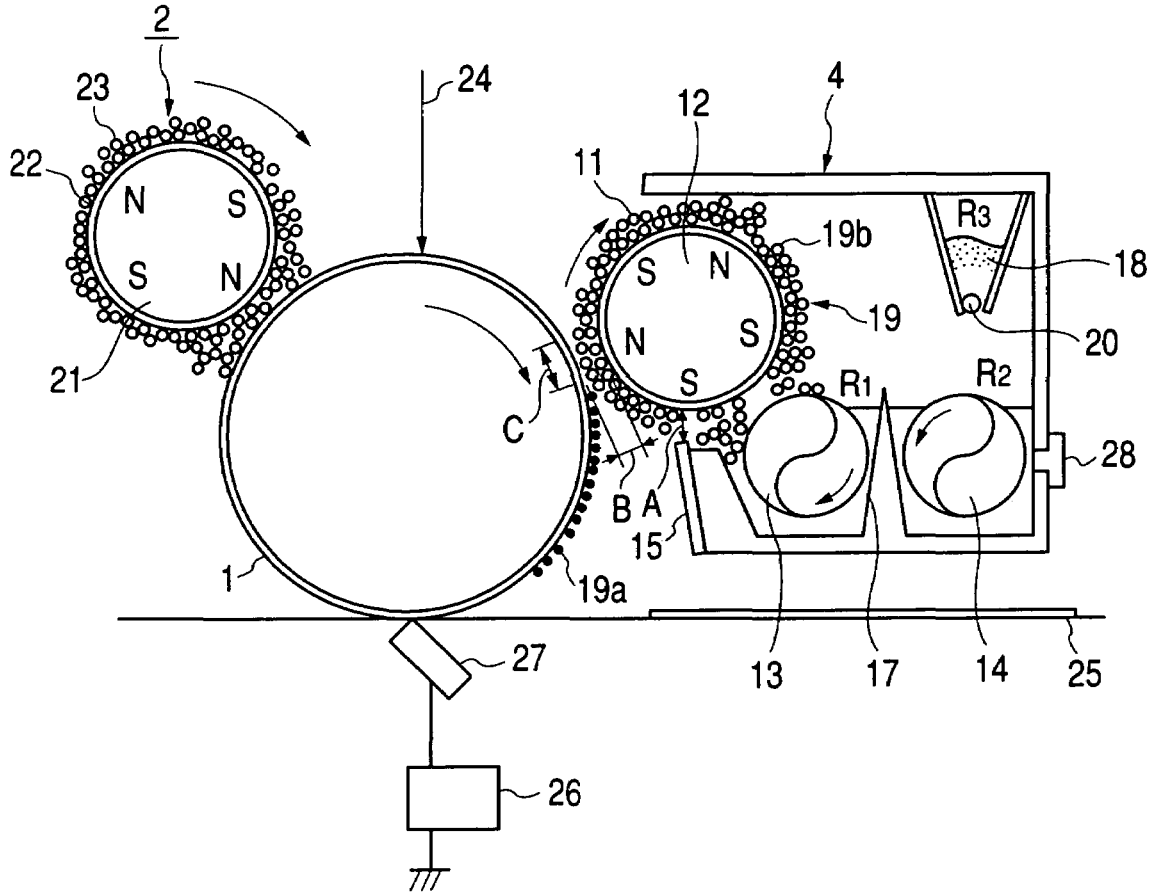
FIG. 1 is a partial diagrammatic view showing an example of an image-forming apparatus in which the toner of the present invention is preferably used.

The toner of the present invention has toner particles containing at least a colorant, a release agent and a polar resin, and an inorganic fine powder, and is characterized in that;

the polar resin contains a polyester resin obtained by carrying out polymerization in the presence of at least a titanium chelate compound as a catalyst, and has an acid value of from 3 mg·KOH/g to 35 mg·KOH/g;

the toner particles are obtained by carrying out granulation in an aqueous medium; and the toner has a weight-average particle diameter of from 4 μm to 10 μm.

As a result of extensive studies, the present inventors have discovered the following. The toner of the present invention is greatly characterized in that a polar resin having a polyester unit, contained in the toner, has been synthesized in the presence of a titanium chelate compound used as a catalyst.

The performance and constituents of the toner of the present invention have relations sketched out as follows:

The use of the polar resin having a polyester unit brings an improvement in low-temperature fixing performance, and, in color toners, promises superior color reproducibility such as color mixing performance and transparency. Further, the titanium chelate compound is used as a polymerization catalyst for polyester and the polar resin is made to have an appropriate acid value. These features interact to enable the toner have higher charging speed and saturation charge quantity and also to make it possible to restrain charge-up. The polar resin having a polyester unit also has an appropriate affinity for the release agent, and hence this makes it possible to satisfy low-temperature fixing performance and even high-temperature anti-offset properties, and to ensure a broad fixing temperature region. That is, the release agent having been compatibilized with the polar resin acts plastically to improve the low-temperature fixing performance. Conversely, its part having not been compatibilized exhibits, at the time of fixing, the effect of release from a fixing member as the effect the release agent has originally. This action is remarkable in the case of toners produced by suspension polymerization which may make the polar resin more present on toner particle surfaces. The use of this titanium chelate compound makes it possible for the inorganic fine powder to be able to be held on the toner particle surfaces stably over a long period of time; the inorganic fine powder being a power that controls the fluidity and charge stability of the toner. Its use in the toner of the present invention, having small particle diameters of 4 to 10 μm, can contribute to the formation of images with high image quality.

The present invention is described below in detail. In charge characteristics of toners, carboxyl groups the polyester resin has are considered to have the function to improve charging speed, and OH groups the polyester resin has, to lower saturation charge quantity.

The carboxyl groups are functional groups having a very strong polarity, and hence the carboxyl groups associate with one another to make a state in which polymer chains spread from their associated moieties to surroundings. For example, where two carboxyl groups associate, they are considered to stand as shown below and are considered to have formed a stable associated state. Therefore, the controlling of the acid value as shown in the present invention can make the charging speed and saturation charge quantity higher and moreover can restrain the charge-up. This enables stable maintenance of high image density from the beginning in whatever environment the images are formed.

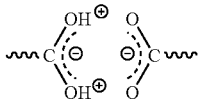

Next, considering the matter from the C—O bond angle, it is presumed that four or more carboxyl groups form an aggregate of association. The aggregate of association of carboxyl groups thus formed stands like holes, and hence it readily accepts free electrons. Therefore, it is presumed that the aggregate has the function to improve the charging speed of the toner. Where it keeps this state of association, it is resistant to any attack from the outside. In particular, if water molecules try to coordinate, they can not easily coordinate. Hence, the toner can also have good environmental stability.

The OH groups, contrary to the carboxyl groups, where, e.g., two OH groups associate, stand as shown below, and come to have a stronger polarity than in the case of one. Thus, electrons can not be present in a stable state like the case when the carboxyl groups associate, and hence they may easily be attacked from the outside. Therefore, it is presumed that they tend to be affected by water molecules.

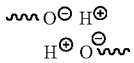

The polyester resin having such charge characteristics is polymerized in the presence of the titanium chelate catalyst. This enables electric charges to be stably present, in virtue of the mutual action between the titanium compound remaining in the polyester resin and the OH groups of the polyester. Hence, the polyester resin comes not to be easily affected by water content, and the saturation charge quantity can be kept from lowering.

Thus, in virtue of the mutual action between the polyester resin having appropriate acid value and hydroxyl value and the residue of the titanium chelate used as a catalyst, the resin is so made up as to be able to enhance charging speed and saturation charge quantity and also keep charge-up from occurring in an environment of low humidity and charge quantity from lowering in an environment of high humidity.

The toner of the present invention further contains a release agent. A toner incorporated with a release agent having a low crystallizability may preferably be used when used in color toners. In particular, incorporation of an ester wax in the toner particles gives a good form because of its appropriate compatibility with the polyester resin. This not only enables improvement in color mixing properties and transparency in color toners, but also enables resolution of the above faulty paper delivery and placement because the release agent can be made present in the vicinity of toner particle surfaces at a level that does not inhibit developing performance.

In addition, the toner of the present invention contains an inorganic fine powder. In particular, a fine powder of, e.g., silica, alumina or titania may preferably be used in view of the impartment of fluidity to the toner and and the stability of charging. The present inventors have discovered an unexpected effect in the toner obtained using the titanium chelate catalyst. The reason therefor is uncertain, but a result has been obtained such that high image quality can be provided stably over a long period of time presumably because, in the toner obtained by adding the above inorganic fine powder to the toner particles containing the polyester resin produced using the titanium chelate catalyst, the inorganic fine powder stands adsorbed so highly that, or in so high a state of adsorption that, it may come liberated from the toner particles in a small proportion even in continuous printing. The highness of the state of adsorption is presumed to be due to the highness of the charging speed and saturation charge quantity the polyester resin can provide, or the mutual action between the surface hydroxyl groups the inorganic fine powder has and the titanium chelate catalyst residue in the resin.

The titanium chelate compound used in the present invention may preferably have a ligand which is any of a diol, a dicarboxylic acid and an oxycarboxylic acid. Of these, the ligand may particularly preferably be any of an aliphatic diol, a dicarboxylic acid and an oxycarboxylic acid. The aliphatic ligand has a stronger catalytic activity than aromatic ligands, and is preferred in view of making reaction time short and temperature control. As resin properties, it makes molecular weight distribution sharp with ease, and is preferred.

Examples of the ligand are, as the diol, 1,2-ethanediol, 1,2-propanediol and 1,3-propanediol. As the dicarboxylic acid, examples are oxalic acid, malonic acid, succinic acid, glutaric acid, adipic acid and maleic acid; and, as the oxycarboxylic acid, gluconic acid, lactic acid, hydroxyacrylic acid, α-oxybutyric acid, glyceric acid, tartronic acid, malic acid, tartaric acid and citric acid.

The titanium chelate compound may also preferably be a compound represented by any of the following Formulas (I) to (VIII), or a hydrate thereof:

Formula (I)

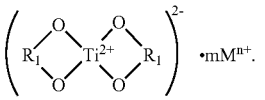

In Formula (I), $R_1$'s each represent an alkylene group or alkenylene group having 2 to 10 carbon atoms, which may have a substituent; and M represents a counter cation, m represents the number of the cation and n represents a valence number of the cation, where n is 2 when m is 1 and n is 1 when m is 2, and, when n is 1, M represents a hydrogen ion, an alkali metal ion, an ammonium ion or an organoammonium ion, and, when n is 2, an alkaline earth metal ion.

Formula (II)

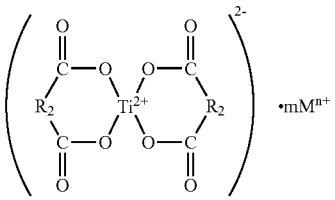

In Formula (II), $R_2$'s each represent an alkylene group or alkenylene group having 1 to 10 carbon atoms, which may have a substituent; and M represents a counter cation, m represents the number of the cation and n represents a valence number of the cation, where n is 2 when m is 1 and n is 1 when m is 2, and, when n is 1, M represents a hydrogen ion, an alkali metal ion, an ammonium ion or an organoammonium ion, and, when n is 2, an alkaline earth metal ion.

Formula (III)

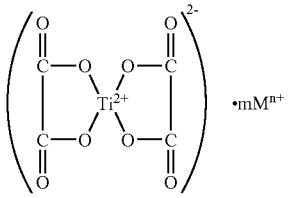

In Formula (III), M represents a counter cation, m represents the number of the cation and n represents a valence number of the cation, where n is 2 when m is 1 and n is 1 when m is 2, and, when n is 1, M represents a hydrogen ion, an alkali metal ion, an ammonium ion or an organoammonium ion, and, when n is 2, an alkaline earth metal ion.

Formula (IV)

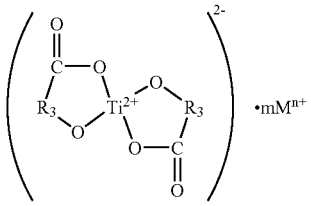

In Formula (IV), $R_3$'s each represent an alkylene group or alkenylene group having 1 to 10 carbon atoms, which may have a substituent; and M represents a counter cation, m represents the number of the cation and n represents a valence number of the cation, where n is 2 when m is 1 and n is 1 when m is 2, and, when n is 1, M represents a hydrogen ion, an alkali metal ion, an ammonium ion or an organoammonium ion, and, when n is 2, an alkaline earth metal ion.

Formula (V)

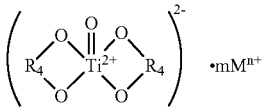

In Formula (V), $R_4$'s each represent an alkylene group or alkenylene group having 2 to 10 carbon atoms, which may have a substituent; and M represents a counter cation, m represents the number of the cation and n represents a valence number of the cation, where n is 2 when m is 1 and n is 1 when m is 2, and, when n is 1, M represents a hydrogen ion, an alkali metal ion, an ammonium ion or an organoammonium ion, and, when n is 2, an alkaline earth metal ion.

Formula (VI)

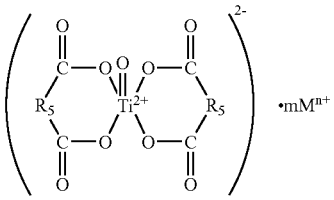

In Formula (VI), $R_5$'s each represent an alkylene group or alkenylene group having 1 to 10 carbon atoms, which may have a substituent; and M represents a counter cation, m represents the number of the cation and n represents a valence number of the cation, where n is 2 when m is 1 and n is 1 when m is 2, and, when n is 1, M represents a hydrogen ion, an alkali metal ion, an ammonium ion or an organoammonium ion, and, when n is 2, an alkaline earth metal ion.

Formula (VII)

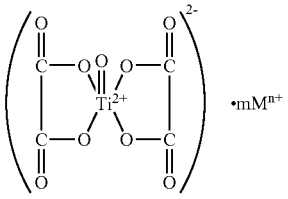

In Formula (VII), M represents a counter cation, m represents the number of the cation and n represents a valence number of the cation, where n is 2 when m is 1 and n is 1 when m is 2, and, when n is 1, M represents a hydrogen ion, an alkali metal ion, an ammonium ion or an organoammonium ion, and, when n is 2, an alkaline earth metal ion.

Formula (VIII)

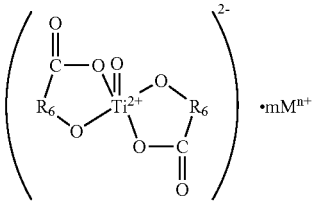

In Formula (VIII), $R_6$'s each represent an alkylene group or alkenylene group having 1 to 10 carbon atoms, which may have a substituent; and M represents a counter cation, m represents the number of the cation and n represents a valence number of the cation, where n is 2 when m is 1 and n is 1 when m is 2, and, when n is 1, M represents a hydrogen ion, an alkali metal ion, an ammonium ion or an organoammonium ion, and, when n is 2, an alkaline earth metal ion.

In particular, the titanium chelate compounds represented by the above Formulas (II), (III), (VI) and (VII) or a hydrate of each of them are preferred because the toner can be excellent in running stability of charging performance and images having maintained high image quality can be formed.

In the counter cation M in Formulas (I) to (VIII), an alkali metal is preferred. The alkali metal may include lithium, sodium, potassium, rubidium and cesium. Of these, preferred are lithium, sodium and potassium, and particularly preferred are sodium and potassium.

Any of these titanium chelate compounds may be used in combination of two or more and be used as the catalyst. This also affords a favorable form of the present invention.

Specific examples of the titanium chelate compound used in the present invention are shown below.

Exemplary Compound 1

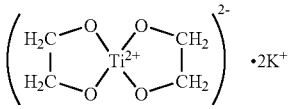

Exemplary Compound 2

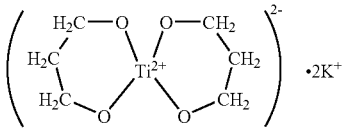

Exemplary Compound 3

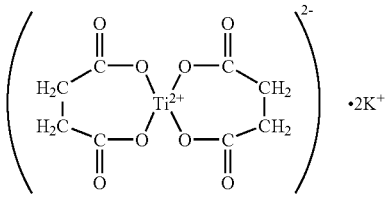

Exemplary Compound 4

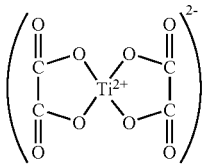

Exemplary Compound 5

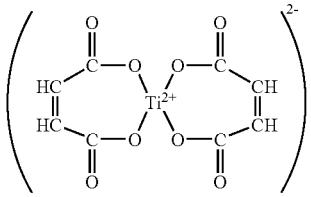

Examplary Compound 6

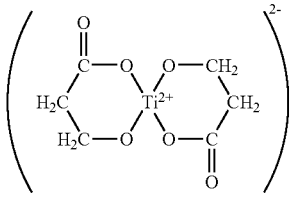

Exemplary Compound 7

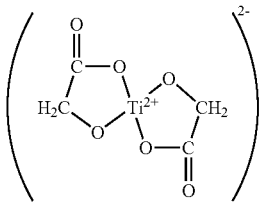

-continued

Exemplary Compound 8

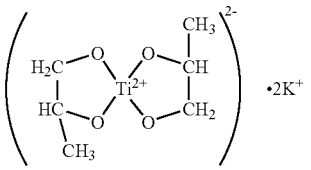

Exemplary Compound 9

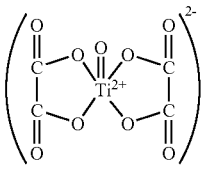

Exemplary Compound 10

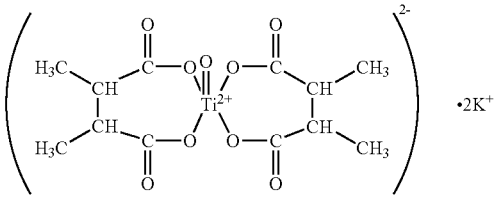

Exemplary Compound 11

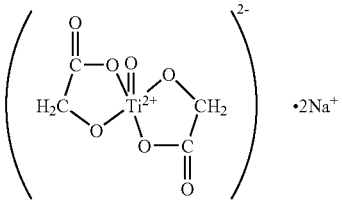

In the polymerization to produce the polyester resin used in the present invention, the titanium chelate Compound may be added in an amount of from 0.01% by weight to 2% by weight, preferably from 0.05% by weight to 1% by weight, and more preferably from 0.1% by weight to 0.7% by weight, based on the weight of the whole polyester unit components. If it is in an amount of less than 0.01% by weight, it may take a long reaction time in the polymerization for the polyester resin, and also the resulting resin may have a broad molecular weight distribution, making it difficult to provide good fixing performance when made into the toner. If on the other hand it is contained in an amount more than 2% by weight, it may affect charging performance of the toner, tending to cause great variations of charge quantity depending on environment.

The polar resin incorporated in the toner of the present invention may be a polar resin having at least a polyester unit. The polyester unit component contained in the whole resin may preferably be in an amount of 3% by weight or more. This is preferable in order to bring out the effect of the present invention. If it is less than 3% by weight, it is difficult to obtain especially good charging performance in the effect of the present invention.

The polar resin used in the present invention has an acid value (mg·KOH/g) of from 3 or more to 35 or less, where the effect of the present invention can be brought out. It may preferably have an acid value of from 5 or more to 30 or less, and more preferably from 7 or more to 20 or less.

If it has an acid value of less than 3, the charging of the toner may rise slowly, and may cause image defects such as fog and spots around line images before the charging rises.

If on the other hand it has an acid value of more than 35, the charge-up may seriously occur especially in an environment of low humidity to cause difficulties such as a decrease in image density and spots around characters.

The polar resin used in the present invention may also have a hydroxyl value (mg·KOH/g) of from 5 or more to 40 or less, where the effect of the present invention can be brought out. It may preferably have a hydroxyl value of from 10 or more to 35 or less, and more preferably from 15 or more to 30 or less.

If it has a hydroxyl value of less than 5, the charging of the toner may rise slowly, and may cause image defects such as fog and spots around line images before the charging rises.

If on the other hand it has a hydroxyl value of more than 40, the charge quantity may seriously lower especially in an environment of high humidity to cause image defects such as fog and spots around line images.

The toner particles of the present invention may be those granulated in an aqueous system by a process such as suspension polymerization, emulsion polymerization or suspension granulation. By the use of such toner particles, the effect of the present invention can be brought out. In the case of toner particles produced by commonly available pulverization, the use of a release agent in a large quantity involves a very high degree of technical difficulty in view of developing performance. Producing toner particles by granulation in an aqueous system enables employment of a method by which the release agent can be made not present on toner particle surfaces even when it is used in a large quantity. In particular, the suspension polymerization is one of the most preferred form in view of enclosure or encapsulation of the release agent in the toner particles and in view of production cost, e.g., use of no solvent.

The toner of the present invention has a weight-average particle diameter of from 4 μm to 10 μm, where the effect of the present invention can be brought out. It may preferably have a weight-average particle diameter of from 5 μm to 9 μm, and more preferably from 6 μm to 7.5 μm.

If the toner has a weight-average particle diameter of less than 4 μm, such a toner tends to cause charge-up, which tends to cause difficulties such as fog, spots around line images and a decrease in image density. It also tends to contaminate charge-providing members during long-term image reproduction to make it difficult to provide stable images with high image quality. It may further not only make it difficult to perform cleaning for removing the transfer residual toner which remains on the photosensitive member, but also tends to cause its melt adhesion and so forth.

If on the other hand it has a weight-average particle diameter of more than 10 μm, such a toner may make fine-line reproducibility of fine characters or the like poor, or may cause spots around line images seriously, and can not provide images with high image quality which are desired nowadays.

The toner particles of the present invention may have, in their water/methanol wettability test, a methanol per cent by weight, TA, of from 10 or more to 70 or less, preferably from 15 or more to 60 or less, and more preferably from 20 or more to 50 or less, at the time the transmittance has come to be 50% of the initial value.

Similarly, the toner may have, in its water/methanol wettability test, a methanol per cent by weight, TB, of from 30or more to 90 or less, preferably from 35 or more to 80 or less, and more preferably from 40 or more to 70 or less, at the time the transmittance has come to be 50% of the initial value.

A case in which the TA is less than 10 or the TB is less than 30 shows that the toner particles and toner have a high affinity for water to cause a lowering of charging performance in an environment of high humidity. This phenomenon tends to occur especially at the latter part of extensive image printing where external additives have deteriorated.

On the other hand, in a case in which the TA is larger than 70 because of exposure of the release agent on the toner particle surfaces or modification of the release agent or a case in which the TA is larger than 90 because of high hydrophobicity of the inorganic fine powder and its addition in a large quantity, the toner particles and toner have so excessively high water repellency as to bring about, particularly in a low humidity environment, problems such that the toner coat layer on the developing sleeve becomes non-uniform because of the phenomenon of charge-up, that the image density decreases and that the toner adheres to the charge-providing members and photosensitive member. The addition of the inorganic fine powder in a large quantity is also not preferable because it may make fixing performance poor and may contaminate the photosensitive member, the charging member of the photosensitive member, the charge-providing members in the developing step, and so forth.

The values TA and TB in the water/methanol wettability test of the toner particles and the toner may have a difference of TA−TB (TA minus TB) of 0 or more and 60 or less, preferably 5 or more and 45 or less, and more preferably 10, or more and 30 or less.

Where the toner particles are easily wettable by water, i.e., have a small TA, it is also necessary to control the wettability-by-water of the toner by selecting the type and amount of external additives such as the inorganic fine powder. If, however, the wettability of the toner is controlled to be too excess, i.e., if the value of TB−TA is larger than 60, the toner may come to lack in running stability even though images without any problem are obtained at the initial stage. Stated specifically, such a toner causes problems such as fog and spots around line images in the latter half of extensive operation (running). The developing performance also varies greatly, so that it becomes difficult to control the toner laid-on quantity on paper. Especially in color image formation, there is a tendency to give rise to a problem such that when like images are reproduced, tints of the images differ too much between images at the initial stage and images after continuous paper feed (image reproduction).

On the other hand, where an inorganic fine powder having a high hydrophilicity is added, there may be a case in which the value of TB−TA is smaller than 0. This causes a lowering of charging performance in an environment of high humidity to bring about image defects such as fog and spots around line images.

The toner of the present invention has the toner particles containing at least a colorant, a release agent and a polar resin and an inorganic fine powder, and in the endothermic curve obtained in the measurement of the toner by differential thermal analysis with a DSC (differential scanning calorimeter), the peak temperature of the maximum endothermic peak in the range from 30° C. to 200° C. is preferably in the range from 50° C. to 120° C., more preferably from 55° C. to 100° C., and still more preferably from 60° C. to 75° C.

This maximum endothermic peak depends on the type of the release agent in the toner particles. Inasmuch as the peak temperature at this maximum endothermic peak is within the above range, both the fixing performance and the developing performance can be satisfied. Two or more kinds of release agents also may preferably be used to achieve the advantages of the present invention, provided that the peak temperature of the maximum endothermic peak (i.e., endothermic peak temperature) is required to be within the above range.

If the toner has the endothermic peak temperature at less than 50° C., it may have poor storage stability and may have poor developing performance to cause fog and spots around line images.

On the other hand, if the toner has the endothermic peak temperature at more than 120° C., the plastic effect the release agent imparts to the toner is so small that the toner may have a somewhat inferior low-temperature fixing performance. Also, if the temperature control of a fixing assembly is lowered during continuous paper feed (image reproduction), the release agent can not be desirably interposed between the fixing member and the toner, tending to cause the phenomenon that the transfer sheet winds around the fixing member (what is called fixing winding).

The endothermic peak (maximum endothermic peak) may also preferably have a half width of 15° C. or less, and more preferably 7° C. or less. In a case in which it has a half width of more than 15° C., the release agent does not have a high crystallizability. Hence, the release agent has a low hardness, and may accelerate contamination of the photosensitive member and the fixing members.

The release agent contained in the toner particles may preferably be in an amount of from 2.5 to 25 parts by weight, more preferably from 4 to 20 parts by weight, and still more preferably from 6 to 18 parts by weight, based on 100 parts by weight of the toner.

If the release agent is contained in an amount of less than 2.5 parts by weight, its release effect can not sufficiently be brought out at the time of fixing, so that it may be difficult to satisfy paper delivery and placement performance of transfer sheets when the fixing member comes to have a low temperature, and also the winding of transfer sheets tends to occur. On the other hand, if it is in an amount of more than 25 parts by weight, the release agent may seriously contaminate the charge-providing members and photosensitive member to cause problems such as fog and melt adhesion.

The toner of the present invention may preferably have a number-average molecular weight (Mn) of from 2,000 to 50,000, more preferably from 5,000 to 40,000, and still more preferably from 10,000 to 25,000. If it has a number-average molecular weight (Mn) of less than 2,000, the toner particles themselves may have so low elasticity as to tend to cause high-temperature offset. On the other hand, if it has a number-average molecular weight (Mn) of more than 50,000, the toner particles themselves tend to have high elasticity to make it unable for the release agent to exude favorably to the fixing surface at the time of fixing, tending to cause the winding of transfer sheets at the time of low-temperature fixing.

The toner of the present invention may also preferably have a weight-average molecular weight (Mw) of from 10,000 to 1,500,000, more preferably from 50,000 to 1,000,000, and still more preferably from 100,000 to 750,000. If it has a weight-average molecular weight (Mw) of less than 10,000, the toner particles themselves may have so low elasticity as to tend to cause high-temperature offset. On the other hand, if it has a weight-average molecular weight (Mw) of more than 1,5000,000, the toner particles themselves tend to have high elasticity to make it unable for the release agent to exude favorably to the fixing surface at the time of fixing, tending to cause the winding of transfer sheets at the time of low-temperature fixing. An extremely low fixing gloss may also result.

In order for the toner to have the above physical properties, the reaction temperature in producing the resin or polymerization toner and a type and amount of polymerization initiator, a cross-linking agent, a chain transfer agent and the release agent may be controlled.

In order to make the toner of the present invention achieve an appropriate medium gloss, the toner may preferably have a melt index (MI) value of from 1 to 50, and more preferably from 3 to 40. If it has an MI value of less than 1, fixed images have too low gloss. If it has an MI value of more than 50, glaring fixed images with a high gloss are formed.

The toner of the present invention may preferably have a glass transition temperature (Tg) of from 50° C. to 75° C., more preferably from 52° C. to 70° C., and still more preferably from 54° C. to 65° C. If it has a Tg of less than 50° C., the toner may have a poor storage stability. On the other hand, if it has a Tg of more than 75° C., the toner may have a poor low-temperature fixing performance.

The release agent used in the toner of the present invention may include polymethylene waxes such as paraffin wax, polyolefin wax, microcrystalline wax and Fischer-Tropsch wax, amide waxes, higher fatty acids, long-chain alcohols, ketone waxes, ester waxes, and derivatives thereof such as graft compounds or block compounds of these, which may optionally be subjected to distillation.

Of the above waxes, the toner particles may particularly preferably contain any of ester waxes represented by the following general structural formulas.

Ester Wax A

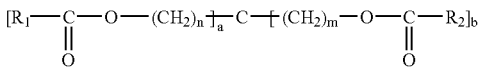

wherein a and b each represent an integer of 0 to 4, provided that a+b is 4; $R_1$ and $R_2$ each represent an organic group having 1 to 40 carbon atoms, provided that a difference in the number of carbon atoms between $R_1$ and $R_2$ is 3 or more; and n and m each represent an integer of 0 to 40, provided that n and m are not 0 at the same time.

Ester Wax B

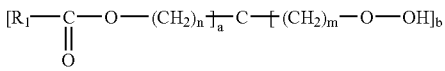

wherein a and b each represent an integer of 0 to 4, provided that a+b is 4; $R_1$ represents an organic group having 1 to 40 carbon atoms; and n and m each represent an integer of 0 to 40, provided that n and m are not 0 at the same time.

Ester Wax C

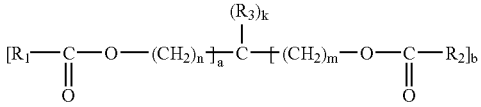

wherein a and b each represent an integer of 0 to 3, provided that a+b is 3 or less; $R_1$ and $R_2$ each represent an organic group having 1 to 40 carbon atoms, provided that a difference in the number of carbon atoms between $R_1$ and $R_2$ is 3 or more; $R_3$ represents an organic group having 1 or more carbon atoms; and n and m each represent an integer of 0 to 40, provided that n and m are not 0 at the same time.

As molecular weight of the release agent, the release agent may preferably have a weight-average molecular weight (Mw) of from 300 to 1,500, and more preferably from 400 to 1,250. If the release agent has a weight-average molecular weight of less than 300, it tends to come bare on the toner particle surfaces and contaminate the photosensitive member, charging roller and charge-providing members to give rise to problems such as fog and melt adhesion. On the other hand, if it has a weight-average molecular weight of more than 1,500, it may cause problems such as serious fixing winding, poor low-temperature fixing performance, poor OHT transparency and so forth.

The release agent may also have a ratio of the weight-average molecular weight to the number-average molecular weight, Mw/Mn, of 1.5 or less. This is preferable because the release agent can have a sharper maximum peak of the DSC endothermic curve, so that the mechanical strength of the toner particles at room temperature is improved, showing sharp melt characteristics at the time of fixing.

The release agent may preferably have a needle penetration of 15 degrees or less. If it has a needle penetration of more than 15 degrees, like the case in which the half width of the endothermic peak of the release agent is more than 15° C., it tends to contaminate the photosensitive member, charging roller and charge-providing members and cause problems such as fog and melt adhesion.

The "polyester unit" used in the present invention refers to a moiety derived from polyester, and polyester unit constituent components specifically refer to acid monomers such as a dihydric or higher alcohol monomer component, a dibasic or higher carboxylic acid, a dibasic or higher carboxylic anhydride and a dibasic or higher carboxylic ester.

The toner of the present invention is characterized by using a resin having a moiety formed by condensation-polymerizing the polyester unit constituent components as a part of materials.

As a polyester unit component dihydric alcohol component, it may specifically include bisphenol-A alkylene oxide addition products such as polyoxypropylene(2.2)-2,2-bis(4-hydroxyphenyl)propane, polyoxypropylene(3.3)-2,2-bis(4-hydroxyphenyl)propane, polyoxyethylene(2.0)-2,2-bis(4-hydroxyphenyl)propane, polyoxypropylene(2.0)-polyoxyethylene(2,0.)-2,2-bis(4-hydroxyphenyl)propane and polyoxypropylene(6)-2,2-bis(4-hydroxyphenyl)propane; and ethylene glycol, diethylene glycol, triethylene glycol, 1,2-propylene glycol, 1,3-propylene glycol, 1,4-butanediol, neopentyl glycol, 1,4-butenediol, 1,5-pentanediol, 1,6-hexanediol, 1,4-cyclohexanedimethanol, dipropylene glycol, polyethylene glycol, polypropylene glycol, polytetramethylene glycol, bisphenol A and hydrogenated bisphenol A.

As a trihydric or higher alcohol monomer component, it may include, e.g., sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylolethane, trimethylolpropane and 1,3,5-trihydroxymethylbenzene.

As a dibasic or higher carboxylic acid monomer component, it may include aromatic dicarboxylic acids such as phthalic acid, isophthalic acid and terephthalic acid, or anhydrides thereof; alkyldicarboxylic acids such as succinic acid, adipic acid, sebacic acid and azelaic acid, or anhydrides thereof; succinic acids substituted with an alkyl group or alkenyl group having 6 to 18 carbon atoms, or anhydrides thereof; unsaturated dicarboxylic acids such as fumaric acid, maleic acid and citraconic acid, or anhydrides thereof. In particular, isophthalic acid may preferably be used in view of its highness of reactivity.

As other monomers, they may also include polyhydric alcohols such as glycerol, sorbitol, sorbitan and also oxyalkylene ethers of, e.g., novolak type phenol resin; and polybasic carboxylic acids such as trimellitic acid, pyromellitic acid and benzophenonetetracarboxylic acid, or anhydrides thereof.

In particular, a polyester resin having as a dihydric alcohol component a bisphenol derivative represented by the following Formula (1) and as an acid monomer component a carboxylic acid component composed of a dibasic or higher carboxylic acid or an acid anhydride thereof or a lower alkyl ester thereof (e.g., fumaric acid, maleic acid, maleic anhydride, phthalic acid, terephthalic acid, trimellitic acid or pyromellitic acid), and obtained by condensation polymerization of these polyester unit components is preferred as affording a good charging performance.

(1)

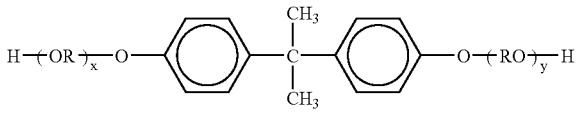

wherein R represents an ethylene group or a propylene group, x and y are each an integer of 1 or more, and an average value of x+y is 2 to 10;

As a binder resin of the toner, it may include polystyrene; homopolymers of styrene derivatives such as poly-p-chlorostyrene and polyvinyl toluene; styrene copolymers such as a styrene-p-chlorostyrene copolymer, a styrene-vinyltoluene copolymer, a styrene-vinylnaphthalene copolymer, a styrene-acrylate copolymer, a styrene-methacrylate copolymer, a styrene-methyl α-chloromethacrylate copolymer, a styrene-acrylonitrile copolymer, a styrene-methyl vinyl ether copolymer, a styrene-ethyl vinyl ether copolymer, a styrene-methyl vinyl ketone copolymer, a styrene-butadiene copolymer, a styrene-isoprene copolymer and a styrene-acrylonitrile-indene copolymer; acrylic resins, methacrylic resins, polyvinyl acetate, silicone resins, polyester resins, polyamide resins, furan resins, epoxy resins, and xylene resins. Any of these resins may be used alone or in the form of a mixture.

As the main component of the binder resin, a styrene copolymer which is a copolymer of polyester resin and/or styrene and other vinyl monomer is preferred in view of developing performance and fixing performance.

Comonomers copolymerizable with styrene monomers in the styrene copolymers may include monocarboxylic acids having a double bond and derivatives thereof, such as acrylic acid, methyl acrylate, ethyl acrylate, butyl acrylate, dodecyl acrylate, octyl acrylate, 2-ethylhexyl acrylate, phenyl acrylate, methacrylic acid, methyl methacrylate, ethyl methacrylate, butyl methacrylate, octyl methacrylate, acrylonitrile, methacrylonitrile and acrylamide; dicarboxylic acids having a double bond and derivatives thereof, such as maleic acid, butyl maleate, methyl maleate and dimethyl maleate; vinyl esters such as vinyl chloride, vinyl acetate and vinyl benzoate; olefins such as ethylene, propylene and butylene; vinyl ketones such as methyl vinyl ketone and hexyl vinyl ketone; and vinyl ethers such as methyl vinyl ether, ethyl vinyl ether and isobutyl vinyl ether. Any of these vinyl monomers may be used alone or in combination of two or more.

The above styrene copolymer may be one having been cross-linked with a cross-linking agent such as divinylbenzene. This is preferable in order to broaden the fixing temperature region and improve anti-offset properties.

A process for producing the toner particles by polymerization is described taking the case of suspension polymerization most preferably used among production processes for the toner particles produced in an aqueous system in the present invention. A monomer composition prepared by subjecting the polymerizable monomer, the colorant and the release agent and further optionally other additives and so forth to uniform dissolution or dispersion by means of a dispersion machine such as a homogenizer, a ball mill, a colloid mill or an ultrasonic dispersion machine is suspended in an aqueous medium containing a dispersion stabilizer. A polymerization initiator may be added at the same time other additives are added to the polymerizable monomer, or may be mixed immediately before the materials are suspended in the aqueous medium. A polymerization initiator having been dissolved in the polymerizable monomer or in a solvent may also be added after the granulation or before the polymerization reaction is started.

As the polymerizable monomer used in producing the toner particles of the present invention, a radical-polymerizable, vinyl type polymerizable monomer is used. As the vinyl type polymerizable monomer, a monofunctional polymerizable monomer or a polyfunctional polymerizable monomer may be used. The monofunctional polymerizable monomer may include styrene; styrene derivatives such as α-methylstyrene, β-methylstyrene, o-methylstyrene, m-methylstyrene, p-methylstyrene, 2,4-dimethylstyrene, p-n-butylstyrene, p-tert-butylstyrene, p-n-hexylstyrene, p-n-octylstyrene, p-n-nonylstyrene, p-n-decylstyrene, p-n-dodecylstyrene, p-methoxystyrene and p-phenylstyrene; acrylate type polymerizable monomers such as methyl acrylate, ethyl acrylate, n-propyl acrylate, iso-propyl acrylate, n-butyl acrylate, iso-butyl acrylate, tert-butyl acrylate, n-amyl acrylate, n-hexyl acrylate, 2-ethylhexyl acrylate, n-octyl acrylate, n-nonyl acrylate, cyclohexyl acrylate, benzyl acrylate, dimethyl phosphate ethyl acrylate, diethyl phosphate ethyl acrylate, dibutyl phosphate ethyl acrylate and 2-benzoyloxyethyl acrylate; methacrylate type polymerizable monomers such as methyl methacrylate, ethyl methacrylate, n-propyl methacrylate, iso-propyl methacrylate, n-butyl methacrylate, iso-butyl methacrylate, tert-butyl methacrylate, n-amyl methacrylate, n-hexyl methacrylate, 2-ethylhexyl methacrylate, n-octyl methacrylate, n-nonyl methacrylate, diethyl phosphate ethyl methacrylate and dibutyl phosphate ethyl methacrylate; methylene aliphatic monocarboxylates; vinyl esters such as vinyl acetate, vinyl propionate, vinyl butyrate, vinyl benzoate and vinyl formate; vinyl ethers such as methyl vinyl ether, ethyl vinyl ether and isobutyl vinyl ether; and vinyl ketones such as methyl vinyl ketone, hexyl vinyl ketone and isopropyl vinyl ketone.

The polyfunctional polymerizable monomer may include diethylene glycol diacrylate, triethylene glycol diacrylate, tetraethylene glycol diacrylate, polyethylene glycol diacrylate, 1,6-hexanediol diacrylate, neopentyl glycol diacrylate, tripropylene glycol diacrylate, polypropylene glycol diacrylate, 2,2'-bis [4-(acryloxy-diethoxy)phenyl]propane, trimethyrolpropane triacrylate, tetramethyrolmethane tetraacrylate, ethylene glycol dimethacrylate, diethylene glycol dimethacrylate, triethylene glycol dimethacrylate, tetraethylene glycol dimethacrylate, polyethylene glycol dimethacrylate, 1,3-butylene glycol dimethacrylate, 1,6-hexanediol dimethacrylate, neopentyl glycol dimethacrylate, polypropylene glycol dimethacrylate, 2,2'-bis[4-(methacryloxy diethoxy)phenyl]propane, 2,2'-bis[4-(methacryloxy polyethoxy)phenyl]propane, trimethyrolpropane trimethacrylate, tetramethyrolmethane tetramethacrylate, divinyl benzene, divinyl naphthalene, and divinyl ether.

In the present invention, the above monofunctional polymerizable monomer may be used alone or in combination of two or more, or the above monofunctional polymerizable monomer and polyfunctional polymerizable monomer may be used in combination. The polyfunctional polymerizable monomer may also be used as a cross-linking agent.

As the polymerization initiator used in polymerizing the above polymerizable monomer, an oil-soluble initiator and/or a water-soluble initiator may be used. For example, the oil-soluble initiator may include azo compounds such as 2,2'-azobisisobutyronitrile), 2,2'-azobis-(2,4-dimethylvaleronitrile), 1,1'-azobis-(cyclohexane-1-carbonitrile), and 2,2'-azobis-4-methoxy-2,4-dimethylvaleronitrile; and peroxide type initiators such as acetylcyclohexylsulfonyl peroxide, diisopropyl peroxycarbonate, decanonyl peroxide, lauroyl peroxide, stearoyl peroxide, propionyl peroxide, acetyl peroxide, t-butylperoxy-2-ethylhexanoate, benzoyl peroxide, t-butylperoxyisobutyrate, cyclohexanone peroxide, methyl ethyl ketone peroxide, dicumyl peroxide, t-butyl hydroperoxide, di-t-butyl peroxide, and cumene hydroperoxide.

The water-soluble initiator may include ammonium persulfate, potassium persulfate, 2,2'-azobis(N,N'-diemthyleneisobutyloamidine)hydrochloride, 2,2'-azobis(2-amino-dipropane)hydrochloride, azobis(isobutyloamidine) hydrochloride, sodium 2,2'-azobisisobutylonitrile sulfonate, and ferrous sulfate or hydrogen peroxide.

In the present invention, a chain transfer agent, a polymerization inhibitor and the like may further be added in order to control the degree of polymerizing the polymerizable monomer.

As the cross-linking agent used in the present invention, a compound having at least two polymerizable double bonds may be used. For example, it may include aromatic divinyl compounds such as divinyl benzene and divinyl naphthalene; carboxylic acid esters having two double bonds, such as ethylene glycol diacrylate, ethylene glycol dimethacrylate and 1,3-butanediol dimethacrylate; divinyl compounds such as divinyl aniline, divinyl ether, divinyl sulfide and divinyl sulfone; and compounds having at least three vinyl groups. Any of these may be used alone or in the form of a mixture.

As the colorant used in the toner of the present invention, any of yellow, magenta and cyan colorants shown below may be used. As a black colorant for a black toner, carbon black or a magnetic material may be used as a main colorant. It is one of favorable forms that the following coloring matters are mixed to control tints and toner resistance.

As yellow colorants, compounds typified by condensation azo compounds, isoindolinone compounds, anthraquinone compounds, azo metal complex methine compounds and allylamide compounds are used. Stated specifically, C.I. Pigment Yellow 3, 7, 10, 12, 13, 14, 15, 17, 23, 24, 60, 62, 74, 75, 83, 93, 94, 95, 99, 100, 101, 104, 108, 109, 110, 111, 117, 123, 128, 129, 138, 139, 147, 148, 150, 155, 166, 168, 169, 177, 179, 180, 181, 183, 185, 191:1, 191, 192, 193 and 199 are preferably used. As dyes, the yellow colorant may include, e.g., C.I. Solvent Yellow 33, 56, 79, 82, 93, 112, 162 and 163; and C.I. Disperse Yellow 42, 64, 201 and 211. A yellow toner is obtainable by incorporating any of these yellow colorants into the toner particles.

As magenta colorants, condensation azo compounds, diketopyrrolopyrrole compounds, anthraquinone compounds, quinacridone compounds, basic dye lake compounds, naphthol compounds, benzimidazolone compounds, thioindigo compounds and perylene compounds are used. Stated specifically, C.I. Pigment Red 2, 3, 5, 6, 7, 23, 48:2, 48:3, 48:4, 57:1, 81:1, 122, 146, 166, 169, 177, 184, 185, 202, 206, 220, 221, 238, 254 and 269, and C.I. Pigment Violet 19 are particularly preferred. A magenta toner is obtainable by incorporating any of these magenta colorants into the toner particles.

As cyan colorants, phthalocyanine compounds and derivatives thereof, anthraquinone compounds and basic dye lake compounds may be used. Stated specifically, C.I. Pigment Blue 1, 7, 15, 15:1, 15:2, 15:3, 15:4, 60, 62 and 66 may particularly preferably be used. A cyan toner is obtainable by incorporating any of these cyan colorants into the toner particles.

Full-color toners for forming full-color images are obtainable by using the above black toner, yellow toner, magenta toner and cyan toner in combination.

Any of these colorants may be used alone, in the form of a mixture, or in the state of a solid solution. The colorants used in the present invention are selected taking account of hue angle, chroma, brightness, weatherability, transparency on OHT sheets and dispersibility in toner particles. The colorant may preferably be added in an amount of from 1 to 20 parts by weight based on 100 parts by weight of the binder resin.

In the toner of the present invention, a charge control agent may used. This is a form preferable for keeping the charging performance of the toner stably.

As charge control agents capable of controlling the toner to be negatively chargeable, they include the following substances.

For example, organic metal complexes or chelate compounds are effective, which include monoazo metal compounds, acetylacetone metal compounds, aromatic oxycarboxylic acid metal compounds, aromatic dicarboxylic acid metal compounds, oxycarboxylic acid metal compounds, and dicarboxylic acid metal compounds. Besides, they include aromatic oxycarboxylic acids, aromatic mono- and polycarboxylic acids, and metal salts, anhydrides or esters thereof, and phenol derivatives such as bisphenol. They may further include urea derivatives, metal-containing salicylic acid compounds, metal-containing naphthoic acid compounds, boron compounds, quaternary ammonium salts, carixarene, and resin type charge control agents.

Charge control agents capable of controlling the toner to be positively chargeable include the following substances.

They may include Nigrosine and Nigrosine-modified products, modified with a fatty acid metal salt; guanidine compounds; imidazole compounds; quaternary ammonium salts such as tributylbenzylammonium 1-hydroxy-4-naphthosulfonate and tetrabutylammonium teterafluoroborate, and analogues of these, including onium salts such as phosphonium salts, and lake pigments of these; triphenylmethane dyes and lake pigments of these (lake-forming agents may include tungstophosphoric acid, molybdophosphoric acid, tungstomolybdophosphoric acid, tannic acid, lauric acid, gallic acid, ferricyanides and ferrocyanides); metal salts of higher fatty acids; diorganotin oxides such as dibutyltin oxide, dioctyltin oxide and dicyclohexyltin oxide;

diorganotin borates such as dibutyltin borate, dioctyltin borate and dicyclohexyltin borate; and resin type charge control agents. Any of these may be used alone or in combination of two or more kinds.

In particular, in order to sufficiently bring out the effect of the present invention, metal-containing salicylic acid compounds are preferred. As their metal, aluminum or zirconium is preferred. As the most preferred control agent, a salicylic acid aluminum compound is preferred.

The charge control agent may be used in an amount of from 0.01 to 20 parts by weight, and preferably from 0.5 to 10 parts by weight, based on 100 parts by weight of the binder resin.

In the present invention, it is also a preferable form that a lubricant is used in order to lessen contamination of members. As the lubricant, it may include fluorine resin powders such as polyvinylidene fluoride and polytetrafluoroethylene, and fatty acid metal salts such as zinc stearate and calcium stearate. Of these, polyvinylidene fluoride is preferably used.

The toner of the present invention has the inorganic fine powder in order to improve charge stability, developing performance, fluidity, adhesion-to-member proofness and durability.

The inorganic fine powder may include, as a charge controlling powder, metal oxides such as tin oxide, titanium oxide, zinc oxide, silicon oxide and aluminum oxide, and carbon black.

As an abrasive, it may include metal oxides such as cerium oxide, aluminum oxide, magnesium oxide and chromium oxide; nitrides such as silicon nitride; carbides such as silicon carbide; and metal salts such as strontium titanate, calcium sulfate, barium sulfate and calcium carbonate. Of these, strontium titanate is preferably used as the abrasive.

As a fluidity-providing agent, it may include metal oxides such as silicon oxide (silica), aluminum oxide (alumina) and titanium oxide (titania); and carbon fluoride. These may more preferably be those having been subjected to hydrophobic treatment. As mentioned previously, the silica, alumina and titania are preferred because these can favorably maintain the fluidity and charging performance of the toner and also because these have a high adsorptivity to the toner particles. It is also a favorable form that two or more of these are used in combination. In particular, it is most preferable that the toner particles contain at least titania in view of the affinity for the titanium chelate compound used in the present invention.

The inorganic fine powder added to the toner of the present invention may preferably be added in an amount of from 0.5 to 4.5 parts by weight, and more preferably from 0.8 to 3.5 parts by weight, in total, based on 100 parts by weight of the toner particles. If the inorganic fine powder is added in an amount of less than 0.5 part by weight in total, the toner may have insufficient fluidity to cause fog seriously with a lowering of charging performance and cause toner scatter, making it impossible to bring out the effect of the present invention sufficiently. On the other hand, if it is added in an amount of more than 4.5 part by weight in total, it may cause problems such as toner scatter, a lowering of charging performance, melt adhesion to photosensitive member, and a decrease in toner charge quantity due to contamination of charge-providing members.

The silica, alumina and/or titania preferably added as the inorganic fine powder may have a specific surface area of from 20 to 400 $m^2/g$, preferably from 35 to 300 $m^2/g$, and more preferably from 50 to 230 $m^2/g$, as measured by the BET nitrogen adsorption method. If the inorganic fine powder has a specific surface area of less than 20 $m^2/g$, it is difficult to secure sufficient fluidity of the toner particles. On the other hand, if it has a specific surface area of more than 400 $m^2/g$, the state of presence of the inorganic fine powder on the toner particles may change in a great proportion during continuous paper feed (image reproduction) to cause an increase in the degree of agglomeration of the toner particles. Also, the value of TB−TA specified in the present invention tends to come larger than 60, tending to cause problems such as fog, spots around line images, and tint variations in color images.

For the purpose of improving hydrophobicity, charging performance and also transfer performance, the inorganic fine powder as the fluidity-providing agent may preferably be one having been treated with a treating agent such as a silicone varnish, a modified silicone varnish of various types, a silicone oil, a modified silicone oil of various types, a silane coupling agent or other organosilicon compound, any of which may be used alone or in combination.

As other inorganic fine powder, it may include a caking agent, a conductivity-providing agent such as zinc oxide, antimony oxide or tin oxide, and a developability improver. Any of these additives may preferably be added in an amount of from 0.01 to 2 parts by weight, and more preferably from 0.1 to 1 part by weight, based on 100 parts by weight of the toner.

The toner particles may also preferably have a shape that is close to a spherical shape. Stated specifically, the toner particles may preferably have a shape factor SF-1 in the range of from 100 to 150, more preferably from 100 to 140, and still more preferably from 100 to 130. They may also preferably have a shape factor SF-2 in the range of from 100 to 140, more preferably from 100 to 130, and still more preferably from 100 to 120.

Toner particles having a shape factor SF-1 of more than 150 or SF-2 of more than 140 are undesirable because they tend to cause a lowering of transfer efficiency of the toner, an increase in re-transfer of the toner and an increase in wear depth of the photosensitive-member surface.

It is also a preferable form of the present invention that the toner of the present invention is blended with a carrier so as to be used as a two-component developer. The carrier used in the present invention may preferably be a carrier formed of core material particles which are composed of a magnetic material or a mixture of a magnetic material and a non-magnetic material and have been coated with a resin and/or a silane compound. Here, a carrier making use of magnetic-material dispersion type resin particles as the core material particles is preferred in view of image characteristics and long-term durability. In particular, where the carrier is used in blend with a negatively chargeable toner, it is preferable for the core material particles to be covered with coat layers containing an aminosilane compound. Incidentally, the fine-particle toner of 10 μm or less in particle diameter according to the present invention tends to contaminate carrier particle surfaces, and hence the carrier formed of core material particles surface-coated with a resin is preferred also in order to prevent this.

The carrier surface-coated with a resin has an advantage also in respect of durability when used in high-speed machines, and is superior also in respect of the controlling of charge of the toner.

As the resin for forming the coat layers with which the core material particle surfaces are covered, preferably usable are, e.g., a fluorine resin, a silicone resin and a silicone compound.

As the fluorine resin that forms the coat layers of the carrier, preferably usable are, e.g., halofluoropolymers such as polyvinyl fluoride, polyvinylidene fluoride, polytrifluoroethylene and polytrifluorochloroethylene; polytetrafluoroethylene, polyperfluoropropylene, a copolymer of vinylidene fluoride and an acrylic monomer, a copolymer of vinylidene fluoride and trifluorochloroethylene, a copolymer of tetrafluoroethylene and hexafluoropropylene, a copolymer of vinyl fluoride and vinylidene fluoride, a copolymer of vinylidene fluoride and tetrafluoroethylene, a copolymer of vinylidene fluoride and hexafluoropropylene, and fluoroterpolymers such as a terpolymer of tetrafluoroethylene, vinylidene fluoride and a non-fluorinated monomer.

The above fluorine resin may preferably have a weight-average molecular weight of from 50,000 to 400,000, and more preferably from 100,000 to 250,000.

As the resin that forms the coat layers of the carrier, the above fluorine resins may each be used alone, or may be used in the form of a blend of any of these. A blend of any of the above fluorine resins with a non-fluorine polymer may still also be used.

As the non-fluorine polymer, any of homopolymers or copolymers of monomers as shown below may be used.

They may include vinyl monomers having one vinyl group in the molecule, as exemplified by styrene, styrene derivatives such as α-methylstyrene, p-methylstyrene, p-t-butyl-styrene and p-chlorostyrene, methyl methacrylate, ethyl methacrylate, propyl methacrylate, butyl methacrylate, pentyl methacrylate, hexyl methacrylate, heptyl methacrylate, octyl methacrylate, nonyl methacrylate, decyl methacrylate, undecyl methacrylate, dodecyl methacrylate, glycidyl methacrylate, methoxyethyl methacrylate, propoxyethyl methacrylate, butoxyethyl methacrylate, methoxydiethylene glycol methacrylate, ethoxydiethylene glycol methacrylate, methoxyethylene glycol methacrylate, butoxytriethylene glycol methacrylate, methoxydipropylene glycol methacrylate, phenoxyethyl methacrylate, phenoxydiethylene glycol methacrylate, phenoxytetraethylene glycol methacrylate, benzyl methacrylate, cyclohexyl methacrylate, tetrahydrofurfuryl methacrylate, dicyclopentenyl methacrylate, dicyclopentenyloxyethyl methacrylate, N-vinyl-2-pyrrolidone methacrylate, methacrylonitrile, methacrylamide, N-methylolmethacrylamide, ethylmorpholine methacrylate, diacetoneacrylamide, methyl acrylate, ethyl acrylate, propyl acrylate, butyl acrylate, pentyl acrylate, hexyl acrylate, heptyl acrylate, octyl acrylate, nonyl acrylate, decyl acrylate, undecyl acrylate, dodecyl acrylate, glycidyl acrylate, methoxyethyl acrylate, propoxyethyl acrylate, butoxyethyl acrylate, methoxydiethylene glycol acrylate, ethoxydiethylene glycol acrylate, methoxyethylene glycol acrylate, butoxytriethylene glycol acrylate, methoxydipropylene glycol acrylate, phenoxyethyl acrylate, phenoxydiethylene glycol acrylate, phenoxytetraethylene glycol acrylate, benzyl acrylate, cyclohexyl acrylate, tetrahydrofurfuryl acrylate, dicyclopentenyl acrylate, dicyclopentenyloxyethyl acrylate, N-vinyl-2-pyrrolidone acrylate, glydidyl acrylate, acrylonitrile, acrylamide, N-methylolacrylamide, diacetoneacrylamide, ethylmorpholine acrylate and vinylpyridine; vinyl monomers having two or more vinyl groups in the molecule as exemplified by divinylbenzene, reaction products of glycol with methacrylic acid or acrylic acid, as exemplified by ethylene glycol dimethacrylate, 1,3-butylene glycol dimethacrylate, 1,4-butanediol dimethacrylate, 1,5-pentanediol dimethacrylate, 1,6-hexanediol dimethacrylate, neopentyl glycol dimethacrylate, diethylene glycol dimethacrylate, triethylene glycol dimethacrylate, polyethylene glycol dimethacrylate, tripropylene glycol dimethacrylate, hydroxypivalic acid neopentyl glycol ester dimethacrylate, trimethylolethane, trimethacrylate, trimethylolpropane trimethacrylate pentaerythritol tetramethacrylate, trismethacryloxyethyl phosphate, tris(methacryloyloxyethyl) isocyanurate, ethylene glycol diacrylate, 1,3-butylene glycol diacrylate, 1,4-butanediol diacrylate, 1,5-pentanediol diacrylate, 1,6-hexanediol diacrylate, neopentyl glycol diacrylate, diethylene glycol diacrylate, triethylene glycol diacrylate, polyethylene glycol diacrylate, tripropylene diacrylate, hydroxypivalic acid neopentyl glycol diacrylate, trimethylolethane triacrylate, trimethylolpropane triacrylate, pentaerythritol tetraacrylate, trisacryloxyethyl phosphate, tris(acryloyloxyethyl) isocyanurate, a half-esterification product of glycidyl methacrylate with methacrylic acid or acrylic acid, a half-esterification product of bisphenol type epoxy resin with methacrylic acid or acrylic acid, and a half-esterification product of glycidyl acrylate with methacrylic acid or acrylic acid; and vinyl monomers having a hydroxyl group as exemplified by 2-hydroxyethyl acrylate, 2-hydroxypropyl acrylate, hydroxybutyl acrylate, 2-hydroxy-3-phenyloxypropyl acrylate, 2-hydroxyethyl methacrylate, 2-hydroxypropyl methacrylate, hydroxybutyl methacrylate, and 2-hydroxy-3-phenyloxypropyl methacrylate.

These monomers are copolymerized by known processes such as suspension polymerization, emulsion polymerization and solution polymerization. The resulting copolymers may preferably be those having a weight-average molecular weight of from 10,000 to 70,000. The copolymers may also be subjected to melamine aldehyde cross-linking or isocyanate cross-linking.

The fluorine resin and other polymer may preferably be blended in a ratio of 20 to 80:80 to 20, and particularly 40 to 60:60 to 40, in weight ratio.

As the silicone resin or silicone compound used to form the coat layers of the carrier, polysiloxanes such as dimethyl polysiloxane and phenylmethyl polysiloxane are used. It is also possible to use modified silicone resins such as alkyd-modified silicone, epoxy-modified silicone, polyester-modified silicone, urethane-modified silicone and acryl-modified silicone. As the form of modification, it may include block copolymers, graft copolymers, comb-type graft copolymers.

When any of these are applied to the surfaces of core material particles, employed is a method in which the fluorine resin, silicone resin or silicone compound is previously converted into a varnish such as a solid methyl silicone varnish, a solid phenyl silicone varnish, a solid methylphenyl silicone varnish, a solid ethyl silicone varnish and various types of modified silicone varnishes and the core material particles (magnetic particles) are dispersed therein, or a method in which the varnish is sprayed on the magnetic particles.

The treatment (coating) with the above resin for coat layers may preferably be in an amount of from 0.1 to 30% by weight, and preferably from 0.5 to 20% by weight, based on the weight of the carrier core material (core material particles), in view of film-forming properties or durability of the coating material.

The carrier used in the present invention may have a volume-average particle diameter of from 25 to 55 μm, and preferably from 30 to 50 μm. This is preferable in the matching with the small-particle-diameter toner. If the carrier has a volume-average particle diameter of less than 25 μm, the carrier tends to be developed on (i.e., transferred together with toner to) the photosensitive member (latent-image-bearing member), tending to scratch the latent image bearing member or a cleaning blade. If on the other hand the carrier has a volume-average particle diameter of more than 55 μm, the toner-holding ability of the carrier may lower, tending to cause uneven solid images, toner scatter, fog and so forth.

In the present invention, the carrier and the toner may preferably be so blended as to be in a toner concentration of from 3 to 12% by weight, and more preferably from 5 to 10% by weight, in order to well satisfy image density and image characteristics.

In the present invention, the carrier may preferably have a resistivity (volume resistivity) of from $1\times10^{8}$ to $1\times10^{16}$ Ω·cm, and more preferably from $1\times10^{9}$ to $1\times10^{15}$ Ω·cm. If the carrier has a resistivity of less than $1\times10^{8}$ Ω·cm, the carrier tends to adhere to the latent-image-bearing member surface, or may scratch the latent-image-bearing member or be directly transferred onto paper, to tend to cause image defects. Also, the development bias may leak through the carrier to disorder the electrostatic latent images formed on the latent-image-bearing member.

If on the other hand the carrier has a resistivity of more than $1\times10^{16}$ Ω·cm, strongly edge-emphasized images tend to be formed. Also, the electric charges on the carrier particle surfaces may leak with difficulty, and hence such a carrier may cause a lowering of image density due to the phenomenon of charge-up, or may become unable to provide charge to toners supplied anew, to cause fog and spots around line images. Still also, such a carrier may charge substances such as inner walls of the developing assembly, so that the charge quantity of toners that is to be originally given may become non-uniform. Besides, any external additives may electrostatically adhere to the carrier to tend to cause image defects.

As magnetic properties, the carriers may have a low magnetic force such that the intensity of magnetization at 1,000/4π (kA/m) is from 30 to 60 $Am^2/kg$, and more preferably from 35 to 55 $Am^2/kg$.

If the carrier has an intensity of magnetization of more than 60 $Am^2/kg$, the developer may strongly be compressed at the part of the developer layer thickness control blade on the developer-carrying member to cause carrier-spent due to the release agent even when the toner of the present invention is used. This may cause faulty developer coating because of the carrier transport performance on sleeve that has become poor, and may cause fog, toner scatter and so forth at the latter part of extensive operation (running) because of a lowering of charge-providing performance to toner.

Also, as being concerned in the carrier particle diameter, the magnetic brush formed on the developing sleeve at the development pole may decrease in density to come to have a large ear length and become rigid, tending to cause uneven sweep marks on copied images.

If the carrier has an intensity of magnetization of less than 30 $Am^2/kg$, the carrier may have a low magnetic force even if fine carrier powder is removed, to tend to cause carrier adhesion, tending to cause a lowering of toner transport performance.

The carrier may preferably have an apparent density of 2.3 $g/cm^3$ or less, and more preferably 2.1 $g/cm^3$ or less. If it has an apparent density of more than 2.3 $g/cm^3$ or less, it may cause carrier-spent due to the release agent, inside the developing assembly, may cause faulty developer coating because of the carrier transport performance on sleeve that has become poor, and may cause fog, tone scatter and so forth at the latter part of extensive operation (running) because of a lowering of charge-providing performance to toner.

The carrier (carrier particles) may preferably have a shape factor SF-1 of from 100 to 130, and more preferably from 100 to 1210. If it has a shape factor SF-1 of more than 130, the carrier may seriously be contaminated by the toner particles or inorganic fine powder, so that its charge-providing performance to toner may lower during extensive service over a long period of time to cause difficulties such as toner scatter and fog.

The carrier may preferably be a magnetic-material dispersion type resin carrier.

Methods for measuring various physical properties concerning the present invention are described below.

(1) Measurement of Molecular-weight Distribution of Resin Component of Toner:

Molecular weight distribution of the resin component of the toner is measured by GPC (gel permeation chromatography). As a specific method for the measurement by GPC, the toner is beforehand extracted with a toluene solvent for 20 hours by means of a Soxhlet extractor, and thereafter the toluene is evaporated off by means of a rotary evaporator, optionally followed by addition of an organic solvent capable of dissolving the wax contained in the toner and not dissolving resin components, e.g., chloroform, to thoroughly carry out washing. Thereafter, the toner components having been subjected to this washing is dissolved in THF (tetrahydrofuran), and then the solution obtained is filtered with a solvent-resistant membrane filter of 0.3 μm in pore diameter to obtain a measuring sample. Using a detector 150C, manufactured by Waters Co., and with the column constitution in which A-801, A-802, A-803, A-804, A-805, A-806 and A-807, available from Showa Denko K.K., are connected, the molecular-weight distribution of the sample is measured using a calibration curve of a standard polystyrene resin. Weight-average molecular weight (Mw) and number-average molecular weight (Mn) are calculated from the molecular-weight distribution thus measured.

(2) Measurement of Endothermic Peak Temperature, Endothermic-peak Half Width and Glass Transition Temperature in DSC Endothermic Curve of Toner:

These are measured according to ASTM D3418-82. In the present invention, a differential scanning calorimeter DSC-7 (manufactured by Perkin Elmer Co.) is used. The temperature at the detecting portion of the device is corrected on the basis of melting points of indium and zinc, and the calorie is corrected on the basis of heat of fusion of iridium. A measuring sample is precisely weighed within the range of 10 mg. The measuring sample is put in a pan made of aluminum and only a pan (empty pan) made of aluminum is set as a control. From a DSC curve obtained when the sample is heated at a heating rate of 10° C./min in the measurement region of from 30° C. to 200° C., the chief endothermic peak value is determined as the endothermic peak value of the release agent used in the present invention. The half width of the endothermic peak refers to the temperature width of an endothermic chart at the part corresponding to ½ of the peak height from the base line at the endothermic peak. In addition, when measurement is made on only the wax component, the temperature is previously raised-and-dropped once under the same conditions as those at the time of measurement, and measurement is started after the previous history of the wax component is erased. When the measurement is made on the wax component kept contained in toner particles, the measurement is made without the operation of erasing the previous history.

(3) Measurement of Molecular Weight of Release Agent:

Measurement is made by GPC (gel permeation chromatography) under conditions shown below.

GPC Measurement Conditions

Apparatus: GPC-150C (Waters Co.)

Columns: GMH-HT 30 cm, combination of two columns (available from Toso Corporation)

Temperature: 135° C.

Solvent: o-Dichlorobenzene (0.1% ionol-added)

Flow rate: 1.0 ml/min

Sample: 0.4 ml of 0.15% sample is injected.

Molecular weight is measured under conditions shown above. The molecular weight of the sample is calculated using a molecular weight calibration curve prepared from a monodisperse polystyrene reference sample. It is further calculated by converting the value in terms of polyethylene according to a conversion expression derived from the Mark-Houwink viscosity equation.

(4) Water/Methanol Wettability Test Method:

A methanol dropping transmittance curve is utilized which is prepared by measurement conducted under the following conditions and procedure by means of a powder wettability tester WET-100P, manufactured by K.K. Resuka.

First, 50 ml of a methanol/water mixed solvent (methanol concentration: 0%) is put into a flask, and its transmittance is measured. The transmittance measured here is expressed by 100%, and a state in which no light is transmitted is expressed by 0%, on the basis of which the transmittance of a sample is measured while methanol is dropwise added in the solvent. That is, the methanol per cent by weight at the time the intensity of transmitted light has come to be a half of the intensity of transmitted light when the light is transmitted through the methanol/water mixed solvent (methanol concentration: 0%), is represented by TA or TB in the present invention.

The transmittance is measured in the following way.

A magnetic stirrer is put into a beaker holding 50 ml of the methanol/water mixed solvent (methanol concentration: 0%). Then, 0.1 g of the toner or toner particles having been sieved with a mesh size of 150 μm is precisely weighed, and this is put into a flask. Next, stirring with the magnetic stirrer is started at a stirring speed of 300 rpm (5 revolutions/second). To this measuring sample fluid, methanol is continuously added through a glass tube at an addition rate of 1.3 ml/min, during which the transmittance of light of 780 nm in wavelength is measured to prepare the methanol dropping transmittance curve. Here, the methanol is used as a titration solvent for the reason that the elution of the dye or pigment, charge control agent and so forth contained in the toner or toner particles has less influence and the surface state of toner particles can more accurately be observed.

In addition, in this measurement, used as the beaker is a beaker made of glass and having a diameter of 5 cm, and as the magnetic stirrer a stirrer having the shape of a spindle of 25 mm in length and 8 mm in maximum diameter and having been coated with TEFLON (registered trademark of Du Pont).

(5) Measurement of Needle Penetration of Release Agent:

The needle penetration of the release agent is measured according to JIS K2235. Measurement temperature is set to 25° C.

(6) Measurement of Melt Index (MI):

Measurement is made by a manual cut-out method, using the apparatus prescribed in JIS K7210. Measurement conditions are measurement temperature: 135° C.; load: 1.75 kg; and sample filling quantity: 5 to 10 g. Here, measured values are converted into 10-minute values.

(7) Measurement of Weight-average Particle Diameter (D4) of Toner and Particle Size Distribution of Toner:

The average particle diameter and particle size distribution of the toner may be measured with Coulter Counter TA-II or Coulter Multisizer II (manufactured by Coulter Electronics, Inc.). In the present invention, they are measured with Coulter Multisizer II (manufactured by Coulter Electronics, Inc.). An interface (manufactured by Nikkaki K.K.) that outputs number distribution and volume distribution and a personal computer PC9801 (manufactured by NEC.) are connected. As an electrolytic solution, an aqueous 1% NaCl solution is prepared using first class grade sodium chloride. For example, ISOTON R-II (available from Coulter Scientific Japan Co.) may be used. Measurement is made by adding as a dispersant 0.1 to 5 ml of surface active agent, preferably an alkylbenzene sulfonate, to 100 to 150 ml of the above aqueous electrolytic solution, and further adding 2 to 20 mg of a sample to be measured. The electrolytic solution in which the sample has been suspended is subjected to dispersion for about 1 minute to about 3 minutes in an ultrasonic dispersion machine. The volume distribution and number distribution are calculated by measuring the volume and number of toner particles with particle diameters of 2 μm or more by means of the above Coulter Multisizer, using an aperture of 100 μm as its aperture. Using these values, the weight-based (the middle value of each channel is used as the representative value for each channel), weight-average particle diameter (D4), the per cent by number of toner particles with diameters of 4.0 μm or less and the per cent by volume of toner particles with diameters of 12.7 μm or more are determined.

(8) Measurement of Acid Value and Hydroxyl Value of Toner and Binder Resin:

Acid Value

The acid value is determined in the following way. Basic operation is made according to JIS K0070.

(A) Reagent (a) Solvent: An ethyl ether/ethyl alcohol mixture solution (1+1 or 2+1) or a benzene/ethyl alcohol mixture solution (1+1 or 2+1) is used. Just before being used, these solutions are neutralized with a 0.1 mol/litter potassium hydroxide ethyl alcohol solution using phenolphthalein as an indicator.

(b) Phenolphthalein solution: 1 g of phenolphthalein is dissolved in 100 ml of ethyl alcohol (95 vol.%).

(c) 0.1 mol/litter potassium hydroxide ethyl alcohol solution: 7.0 g of potassium hydroxide is dissolved in water used in a quantity as small as possible, and ethyl alcohol (95 vol.%) is added thereto to make up a 1 liter solution, which is then left standing for 2 or 3 days, followed by filtration. Standardization is made according to JIS K8006 (basic items relating to titration during a reagent content test).

(B) Operation

From 1 to 20 g of the sample (toner or binder resin) is precisely weighed, and 100 ml of the solvent and few drops of the phenolphthalein solution as an indicator are added thereto, which are then thoroughly shaked until the sample dissolves completely. In the case of a solid sample, it is dissolved by heating on a water bath. After cooling, the resultant solution is titrated with the 0.1 mol/litter potassium hydroxide ethyl alcohol solution, and the time that slightly red of the indicator is retained for 30 seconds is regarded as the end point of neutralization.

(C) Calculation

The acid value is calculated from the following equation.

$$A=(B\times f\times 5.611)/S$$

where;

A is the acid value (mg·KOH/g);

B is the amount (ml) of the 0.1 mol/litter potassium hydroxide ethyl alcohol solution;

f is the factor of the 0.1 mol/litter potassium hydroxide ethyl alcohol solution; and S is the sample (g).

Hydroxyl Value

The hydroxyl value is determined in the following way. Basic operation is made according to JIS K0070.

(A) Reagent (a) Acetylating reagent: 25 g of acetic anhydride is put into 100 ml of a measuring flask, and pyridine is added to make up a 100 ml solution in total weight, followed by thorough shaking. The acetylating reagent is so stored in a brown bottle that it does not come into contact with any moisture or any vapor of carbon dioxide or acid.

(b) Phenolphthalein solution: 1 g of phenolphthalein is dissolved in 100 ml of ethyl alcohol (95 vol. %).

(c) N/2 potassium hydroxide ethyl alcohol solution: 35 g of potassium hydroxide is dissolved in water used in a quantity as small as possible, and ethyl alcohol (95 vol. %) is added thereto to make up a 1 liter solution, which is then left standing for 2 or 3 days, followed by filtration. Standardization is made according to JIS K-8006.

(B) Operation

In a round flask, 0.5 to 2.0 g of the sample is precisely weighed, and just 5 ml of the acetylating reagent is added thereto. A small funnel is hooked on the mouth of the flask, and its bottom is immersed by about 1 cm depth in a 95 to 100° C. glycerol bath and heated. Here, in order to prevent the neck of the flask from being heated by the heat of the bath, the base of the neck of the flask is covered with a cardboard disk with a round hole made in the middle. One hour later, the flask is taken out of the bath. After it was left to cool, 1 ml of water is added through the funnel, followed by shaking to decompose acetic anhydride. In order to effect the decomposition further completely, the flask is again heated in the glycerol bath for 10 minutes. After it was left to cool, the walls of the funnel and flask are washed with 5 ml of ethyl alcohol, followed by titration with the N/2 potassium hydroxide ethyl alcohol solution using the phenolphthalein solution as a reagent. Here, an empty test is made in parallel with the main test.

(C) Calculation

The hydroxyl value is calculated from the following equation.

$$A=[(B-C)\times f\times 28.05]/S+D$$

where;

A is the hydroxyl value (mg·KOH/g);

B is the amount (ml) of the N/2 potassium hydroxide ethyl alcohol solution used in the empty test;

C is the amount (ml) of the N/2 potassium hydroxide ethyl alcohol solution used in the main test;

f is the factor of the N/2 potassium hydroxide ethyl alcohol solution;

S is the sample (g); and

D is the acid value (mg·KOH/g).

(9) Measurement of Shape Factors (SF-1, SF-2) of Toner and Carrier:

The SF-1 and SF-2 are defined to be values obtained by sampling at random 100 particles in a toner image by the use of FE-SEM (S-800), a scanning electron microscope manufactured by Hitachi Ltd., introducing their image information in an image analyzer (LUZEX-3) manufactured by Nireko Co. through an interface to make analysis, and calculating the data according to the following expressions.

$$\text{SF-1}=\{(MXLNG)^2/\text{AREA}\}\times(\pi/4)\times 100$$

$$\text{SF-2}=\{(PERI)^2/\text{AREA}\}\times(1/4\pi)\times 100$$

(MXLNG: absolute maximum length; AREA: projected area of toner particle; PERI: peripheral length)

The shape factor SF-1 of toner indicates the degree of sphericity; the greater than 100 the value is, the more amorphous (shapeless) the toner particles become. SF-2 indicates the degree of irregularity; the greater than 100 the value is, the more remarkable the irregularity of the toner particle surfaces become.

(10) Measurement of Particle Diameter of Carrier:

The particle diameter of the carrier is measured using a laser diffraction particle size distribution measuring device HELOS (manufactured by Nippon Denshi K.K.) under conditions of a feed air pressure of 3 bar and- a suction pressure of 0.1 bar. In addition, the average particle diameter of the carrier shows a volume-based 50% particle diameter of carrier particles.

(11) Measurement of Magnetic Properties of Carrier:

The magnetic properties of the carriers is measured with a vibration magnetic-field type magnetic-property autographic recorder BHV-35, manufactured by Riken Denshi K.K. In measuring the same, an external magnetic field of 1,000/4π (kA/m) is formed, and the intensity of magnetization is determined in the following way: A cylindrical plastic container is filled with the carrier in the state it has densely been packed so that carrier particles do not move. In this state, the magnetic moment is measured, and the actual weight at the time the sample is placed is measured to determine the intensity of magnetization ($Am^2/kg$).

Where physical properties of the carrier are measured from a developer, the developer is washed with an ion-exchange water containing CONTAMINON N (a surface-active agent available from Wako Pure Chemical Industries, Ltd), to separate the toner and the carrier, and then, the above measurement is made.

(12) Measurement of Resistivity of Carrier:

The resistivity of the carriers is measured with a powder insulation resistance measuring instrument manufactured by Shinku-Riko Inc. As measuring conditions, a carrier left for 24 hours or more under conditions of 23° C. and 60% RH (relative humidity) is put in a measuring cell of 20 mm in diameter (0.283 $cm^2$), which is then sandwiched between 120 $g/cm^2$ loading electrodes, setting the thickness of the cell to 2 mm, to make measurement at an applied voltage of 500 V.

(13) Measurement of Apparent Density of Carrier:

The apparent density of the carrier is measured according to JIS Z02504.

Image-Forming Method

An image-forming method making use of the toner of the present invention is described below in detail.

The image-forming method in the present invention is a method in which images are formed using the toner of the present invention described above. It is an image-forming method having a charging step of charging the surface of an photosensitive member electrostatically; a latent-image formation step of forming an electrostatic latent image on the photosensitive member surface thus charged; a developing step of feeding the toner of the present invention to the electrostatic latent image by the action of an electric field formed between i) a developer-carrying member which is provided in a developing unit and holds thereon a developer containing the toner and ii) the photosensitive member holding thereon the electrostatic latent image, to render the electrostatic latent image visible to form a toner image; a transfer step of transferring the toner image onto a transfer material via, or not via, an intermediate transfer member; and a fixing step of making the transfer material pass through a nip formed by a fixing member and a pressure member pressed against the fixing member, to fix the toner image to the transfer material with heating and pressure contact.

The toner of the present invention may preferably be used in white-and-black copying machines such as iR6000 and iR3000, laser beam printers such as LBP720 and LBP950, two-component remodeled machines of these, and full-color copying machines such as LBP2040, LBP2810, LBP2710, LBP2410, CLC500, CLC700, CLC1000, CP2150, CP660 and iRC3200, all manufactured by CANON INC.

A preferred example of the image-forming method making use of the toner of the present invention is described below with reference to the accompanying drawings. FIG. 1 is a partial diagrammatic view showing an example of an image-forming apparatus employing the image-forming method making use of the toner of the present invention. Although the details are described later, this image-forming apparatus has a photosensitive drum 1 as a photosensitive member on which electrostatic latent images are to be held, a charging means 2 which charges the surface of the photosensitive drum 1 electrostatically, an information-writing means 24 (not shown) which forms the electrostatic latent images on the surface of the photosensitive drum 1, a developing assembly 4 by means of which the electrostatic latent images formed on the surface of the photosensitive drum 1 are developed and rendered visible by the use of the toner to form toner images, and a transfer blade 27 as a transfer means which transfers to a transfer material 25 the toner images formed by means of the developing assembly 4.

As a development method making use of the toner of the present invention, the development may be performed using, e.g., a two-component developing means as shown in FIG. 1. In the present invention, the step of development may preferably be the step of applying to the developer-carrying member a voltage formed by superimposing an AC component on a DC component, to form a vibrating electric field between the developer-carrying member and the photosensitive member surface to perform development. Stated specifically, as shown in FIG. 1, the development may preferably be performed by applying an alternating electric field to the developer-carrying member and in such a state that a magnetic brush formed on the developer-carrying member by the carrier is kept in touch with the latent-image-bearing member, photosensitive drum 1.

A distance B between the developer carrying member (developing sleeve) 11 and the photosensitive drum 1 (S-D distance) may preferably be from 100 to 800 μm. This is favorable for preventing carrier adhesion to the photosensitive member and improving dot reproducibility. If the S-D distance is smaller, i.e., the gap is narrower, than 100 μm, the developer tends to be insufficiently fed to the photosensitive member, resulting in a low image density. If it is larger than 800 μm, magnetic lines of force from a magnet pole S1 may broaden to make the magnetic brush have a low density, resulting in a poor dot reproducibility, or to weaken force of binding the magnetic coat carrier, tending to cause carrier adhesion.

The alternating electric field may preferably be applied at a peak-to-peak voltage of from 300 to 3,000 V and a frequency of from 500 to 10,000 Hz, and preferably from 1,000 to 7,000 Hz, which may each be applied under appropriate selection in accordance with processes. In this instance, the waveform used may be selected in variety from a triangular waveform, a rectangular waveform, a sinusoidal waveform, a waveform with varied duty ratio, and an intermittent alternating superimposed electric field. If the applied voltage is lower than 300 V, a sufficient image density can be attained with difficulty, and fog toner having adhered to non-image areas may not be satisfactorily collected in some cases. If it is higher than 5,000 V, the latent image may be disordered through the magnetic brush to cause a lowering of image quality.

Use of a two-component developer having a toner desirably charged enables fog take-off voltage (Vback) to be lowered, and enables the primary charging of the photosensitive member to be lowered, thus the photosensitive member can be made to have a longer lifetime. The Vback, which may depend on the developing system, may preferably be 350 V or less, and more preferably 300 V or below.

As contrast potential, a potential of from 100 V to 500 V may preferably be used so that a sufficient image density can be achieved.

If the frequency is lower than 500 Hz, being concerned with process speed, the toner brought into contact with the photosensitive member can not be sufficiently vibrated when returned to the developing sleeve, so that fog tends to occur. If it is higher than 10,000 Hz, the toner can not follow the electric field to tend to cause a lowering of image quality.

What is important in the development according to the present invention is as follows: In order to perform development promising a sufficient image density, achieving a superior dot reproducibility and being free of carrier adhesion, the magnetic brush on the developing sleeve 11 may preferably be made to come into touch with the photosensitive drum 1 at a width (developing nip C) of from 3 to 8 mm. If the developing nip C is narrower than 3 mm, it may be difficult to satisfactorily fulfil image density and dot reproducibility. If it is broader than 8 mm, the developer may pack into the nip to stop the machine from operating, or it may be difficult to sufficiently prevent the carrier adhesion. As methods for adjusting the developing nip, the nip width may appropriately be adjusted by adjusting the distance A between a developer control blade 15 and the developing sleeve 11, or by adjusting the distance B between the developing sleeve 11 and the photosensitive drum 1.

The image forming method making use of the toner of the present invention can faithfully develop dot latent images because it is not affected by the injection of electric charges through the toner and does not disorder latent images when using, in the reproduction of images attaching importance especially to halftones, the developer and developing method making use of the toner of the present invention especially in combination with a developing system in which digital latent images are formed. Also in the step of transfer, by using the toner in which fine-powder is cut out and particle size distribution is sharp, a high transfer efficiency and a high image quality can be achieved at both halftone areas and solid areas.

Concurrently with the achievement of a high image quality at the initial stage, by the use of the above two-component type developer, the change of the charge quantity of the toner can be minimized inside the developing assembly, bringing out the effect of the present invention that no decrease in image density may occur even when copied on a large number of sheets.

Preferably, the image-forming apparatus may have developing assemblies for magenta, cyan, yellow and black and development for black may finally be made, whereby images can more assume a tightness (tighter images).

The image forming method making use of the toner of the present invention is further described below with reference to FIG. 1.

In the image forming appratus shown in FIG. 1, a magnetic brush composed of magnetic particles 23 is formed on the surface of a transport sleeve 22 by the action of magnetic force exerted by a magnet roller 21. This magnetic brush is brought into touch with the surface of a photosensitive drum 1 to charge the photosensitive drum 1 electrostatically. A charging bias is kept applied to the transport sleeve 22 by a bias applying means (not shown).

The photosensitive drum 1 thus charged is exposed to laser light 24 by means of an exposure unit as a latent-image formation means (not shown) to form a digital electrostatic latent image. The electrostatic latent image thus formed on the photosensitive drum 1 is developed with a toner 19*a* (the toner of the present invention) held in a developer 19 containing the toner 19*a* and a carrier 9*b* and carried on a developing sleeve 11 internally provided with a magnet roller 12 and to which a development bias is kept applied by a bias-applying means (not shown).

The inside of a developing assembly 4 is partitioned into a developer chamber R1 and an agitator chamber R2 by a partition wall 17, which are provided with developer transport screws 13 and 14, respectively. At the upper part of the agitator chamber R2, a toner storage chamber R3 holding a replenishing toner 18 therein is installed. At the lower part of the toner storage chamber R3, a supply opening 20 is provided.

As a developer transport screw 13 is rotatively driven, the developer held in the developer chamber R1 is transported in one direction in the longitudinal direction of the developing sleeve 11 while being agitated. The partition wall 17 is provided with openings (not shown) on this side and the inner side as viewed in the drawing. The developer transported to one side of the developer chamber R1 by the screw 13 is sent into the agitator chamber R2 through the opening on the same side of the partition wall 17, and is delivered to the developer transport screw 14. The screw 14 is rotated in the direction opposite to the screw 13. Thus, while the developer in the agitator chamber R2, the developer delivered from the developer chamber R1 and the toner replenished from the toner storage chamber R3 are agitated and blended, the developer is transported inside the agitator chamber R2 in the direction opposite to the screw 13 and is sent into the developer chamber R1 through the opening on the other side of the partition wall 17.

To develop the electrostatic latent image formed on the photosensitive drum 1, the developer 19 held in the developer chamber R1 is drawn up by the magnetic force of the magnet roller 12, and is carried on the surface of the developing sleeve 11. The developer carried on the developing sleeve 11 is transported to the developer control blade 15 as the developing sleeve 11 is rotated, where the developer is controlled into a developer thin layer with a proper layer thickness. Thereafter, it reaches a developing zone where the developing sleeve 11 faces the photosensitive drum 1. In the position corresponding to the developing zone of the magnet roller 12, a magnetic pole (development pole) N1 is placed, and the development pole N1 forms a magnetic field at the developing zone. This magnetic field raises the developer as ears, thus the magnetic brush of the developer is formed in the developing zone. Then, the magnetic brush comes into touch with the photosensitive drum 1. The toner attracted to the magnetic brush and the toner attracted to the surface of the developing sleeve 11 are moved to and attracted to the region of the electrostatic latent image on the photosensitive drum 1, where the electrostatic latent image is developed, thus a toner image is formed.

The developer having passed through the developing zone is returned into the developing assembly 4 as the developing sleeve 11 is rotated, then stripped off the developing sleeve 11 by a repulsive magnetic field formed between magnetic poles S1 and S2, and dropped into the developer chamber R1 and agitator chamber R2 so as to be collected there.

Once a T/C ratio (blend ratio of toner and carrier, i.e., toner concentration in the developer) of the developer in the developing assembly 4 has lowered as a result of the above development, the replenishing toner 18 is replenished from the toner storage chamber R3 in the quantity corresponding to the quantity of the toner consumed by the development, thus the T/C ratio of the developer is maintained in a stated quantity. To detect the T/C ratio of the developer 19 in the developing assembly 4, a toner concentration detecting sensor 28 is used which measures changes in permeability of the developer by utilizing the inductance of a coil. The toner concentration detecting sensor 28 has a coil (not shown) on its inside.

The developer control blade 15, which is provided beneath the developing sleeve 11 to control the layer thickness of the developer 19 on the developing sleeve 11, is a non-magnetic blade made of a non-magnetic material such as aluminum or SUS316 stainless steel. The distance between the end of the blade and the surface of the developing sleeve 11 is 150 to 1,000 μm, and preferably 250 to 900 μm. If this distance is smaller than 150 μm, the magnetic carrier 19*b* may be caught between them to tend to make the developing layer uneven, and also the developer necessary for performing good development may be difficult to apply on the sleeve, so that developed images are liable to have a low density and much unevenness. In order to prevent uneven coating (what is called blade clog) due to undesirable particles included in the developer, the distance may preferably be 250 μm or more. If it is more than 1,000 μm, the quantity of the developer applied on the developing sleeve 11 increases to make it difficult to desirably control the developer layer thickness so that the magnetic carrier particles adhere to the photosensitive drum 1 in a large quantity and also the circulation of the developer and the control of the developer by the developer control blade 15 may become less effective to tend to cause fog because of a decrease in triboelectricity of the toner.

The toner image formed by development is transferred onto a transfer material (recording material) transported to a transfer zone by means of a transfer blade 27 which is a transfer means to which a transfer bias is kept applied by a bias-applying means 27. The toner image thus transferred onto the transfer material is fixed to the transfer material by means of a fixing assembly (not shown). Transfer residual toner remaining on the photosensitive drum 1 without being transferred to the transfer material in the transfer step is charge-controlled in the charging step and collected at the time of development.

An example of an image-forming method making use of the toner of the present invention and having a charge polarity control step is described with reference to FIG. 6.

Figure 6:
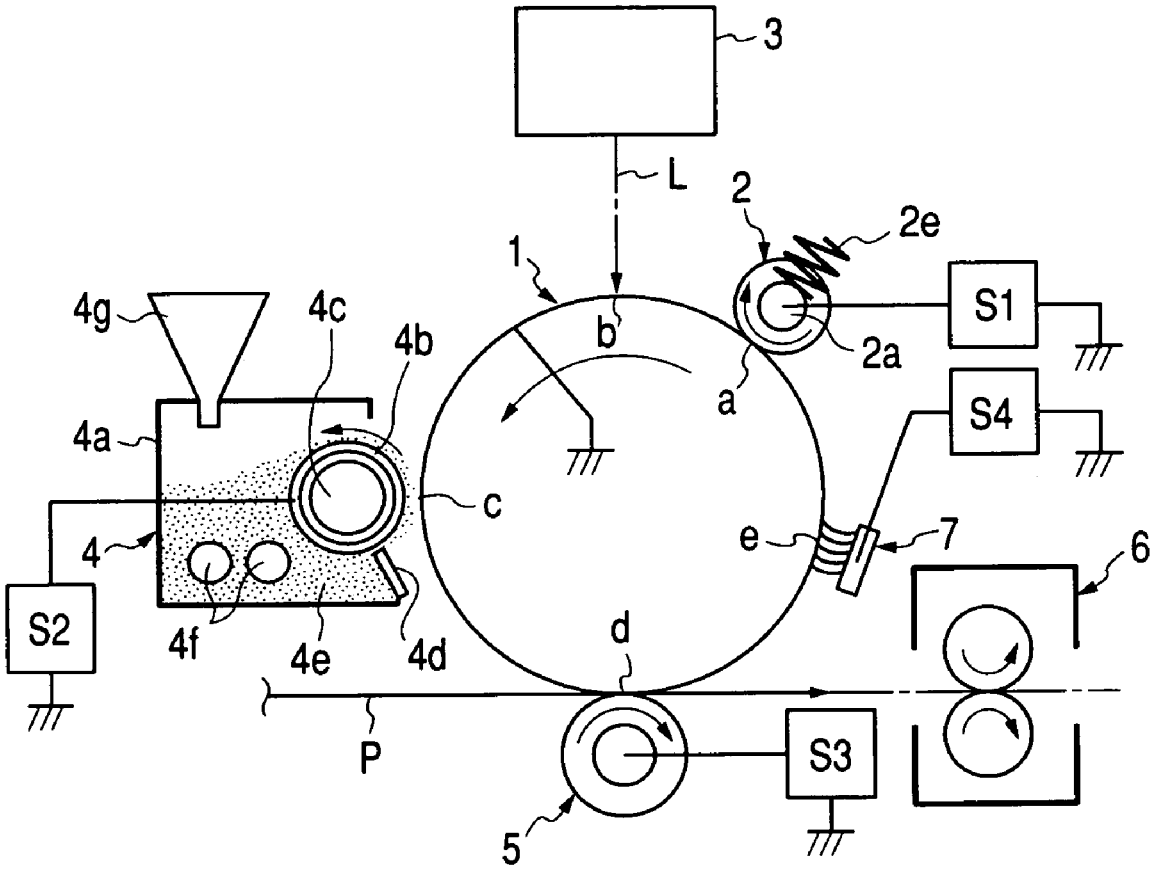
FIG. 6 is a schematic illustration showing another example of an image-forming apparatus in which the toner of the present invention is preferably used.

As shown in FIG. 6, a sated charging bias is applied to a charging roller 2 from a power source S1 to charge a photosensitive drum 1 electrostatically. Here, the bias voltage may be a vibrating voltage formed by superimposing an AC voltage (Vac) on a DC voltage (Vdc). Thereafter, image-wise exposure is effected by a laser system 3 to form an electrostatic latent image.

In respect to this electrostatic latent image, a developing sleeve 4*b* is provided in proximity and face to face to the photosensitive drum 1. The part where the photosensitive drum 1 and the developing sleeve 4*b* face to each other is a developing zone c. The developing sleeve 4*b* may preferably be rotatively driven in the direction opposite to the direction of movement of the photosensitive drum 1 at the developing zone c. On the periphery of this developing sleeve 4*b*, part of a two-component developer 4*e* held in a developer container 4*a* is attracted and held as a magnetic-brush layer by the action of magnetic force of a magnet roller 4*c* in the developing sleeve 4*b*. It is rotatively transported as the sleeve is rotated, and is layer-controlled to a stated thin layer by a developer-coating blade 4*d*, where the thin layer comes into touch with the surface of the photosensitive drum 1 at the developing zone c to rub the photosensitive drum surface appropriately.

To the developing sleeve 4*b*, a stated development bias voltage is applied from a power source S2. In this example, the development bias voltage applied to the developing sleeve 4*b* is the vibrating voltage formed by superimposing an AC voltage (Vac) on a DC voltage (Vdc). Thus, the electrostatic latent image formed on the photosensitive drum 1 is developed with the toner contained in the two-component developer 4*e*. The toner image formed by development is transferred to a transfer material or an intermediate transfer member at a transfer zone d by the aid of a transfer roller 5. The toner remaining on the photosensitive drum 1 undergoes the next step of charge polarity control. That is, the toner remaining on the photosensitive drum 1 (transfer residual toner) comes into contact with a brush of a charge quantity control member 7 (to which a stated voltage is kept applied from a power source S4) at a brush contact zone e between the number 7 and the photosensitive drum 1, so that this toner is controlled to a regular polarity. In the case of a negatively chargeable toner, a negative voltage is applied to the photosensitive drum 1. In the case of a positively chargeable toner, a positive voltage is applied to the photosensitive drum 1. Undergoing such a step, in the case of a cleanerless system, the transfer residual toner can be collected desirably at the time of development. While not shown in FIG. 6, it is also an effective means that, in order to remove residual electric charges of the photosensitive drum 1 and prevent drum ghosts, the same member as in the charge quantity control step is used between the transfer step and the charge polarity control step to provide the photosensitive drum 1 with a potential having a polarity reverse to the polarity applied in the charging step.

Figure 3:
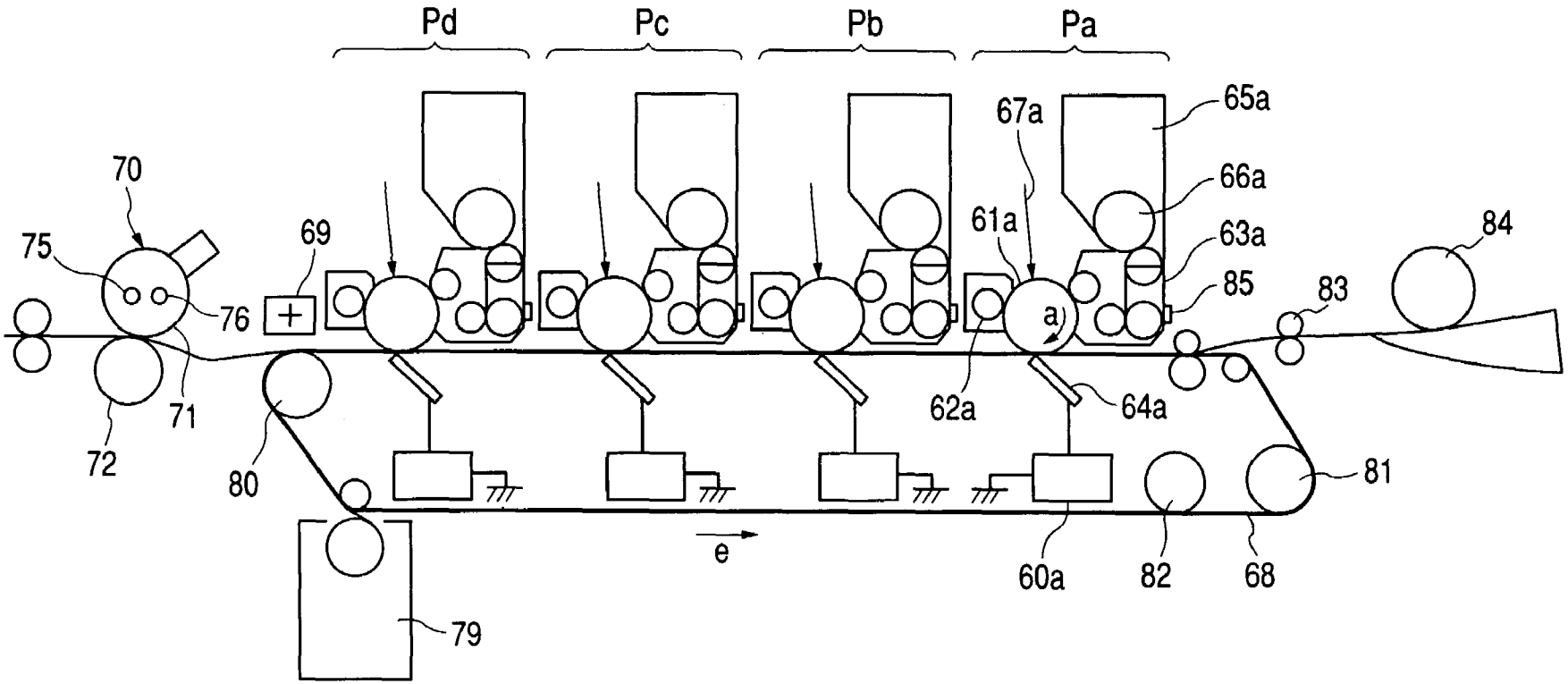
FIG. 3 is a schematic view showing an example of a full-color image-forming apparatus in which the toner of the present invention is preferably used.

FIG. 3 schematically illustrates an example in which the image forming method making use of the toner of the present invention is applied to a full-color image forming apparatus.

The main body of the full-color image forming apparatus is provided side by side with a first image-forming unit Pa, a second image-forming unit Pb, a third image-forming unit Pc and a fourth image-forming unit Pd, and images with respectively different colors are formed on a transfer material through the process of latent image formation, development and transfer.

The respective image-forming units provided side by side in the image-forming apparatus are each constituted as described below referring to the case of the first image-forming unit Pa.

The first image-forming unit Pa has a photosensitive drum 61*a* of 30 mm diameter as an electrophotographic latent image bearing member photosensitive member. This photosensitive drum 61*a* is rotatively moved in the direction of an arrow a. Reference numeral 62*a* denotes a primary charging assembly as a charging means, and a magnetic brush formed on a 16 mm diameter sleeve is so provided as to be in contact with the photosensitive drum 61*a*. Reference numeral 67*a* denotes laser light for forming an electrostatic latent image on the photosensitive drum 61*a* whose surface has uniformly been charged by means of the primary charging assembly 62*a*, with the laser light being emitted by an exposure unit (not shown). Reference numeral 63*a* denotes a developing assembly as a developing means for developing an electrostatic latent image held on the photosensitive drum 61*a*, to form a color toner image, and holds a color toner which is the toner of the present invention. Reference numeral 64*a* denotes a transfer blade as a transfer means for transferring the color toner image formed on the surface of the photosensitive drum 61*a*, to the surface of a transfer material (recording material) transported by a belt-like transfer material carrying member 68. This transfer blade 64*a* comes into touch with the back of the transfer material carrying member 68 and can apply a transfer bias.

In this first image-forming unit Pa, the photosensitive drum 61*a* is uniformly primarily charged by the primary charging assembly 62*a*, and thereafter the electrostatic latent image is formed on the photosensitive member by the exposure laser light 67*a* emitted from the exposure unit. The electrostatic latent image is developed by the developing assembly 63*a* using the color toner. The toner image thus formed by development is transferred, at a first transfer zone (the position where the photosensitive member and the transfer material come into contact), to the surface of the transfer material by applying transfer bias from the transfer blade 64*a* coming into touch with the back of the belt-like transfer material carrying member 68 carrying and transporting the transfer material.

The toner is consumed as a result of the development and the T/C ratio lowers, whereupon this lowering is detected by a toner concentration detecting sensor 85 which measures changes in permeability of the toner by utilizing the inductance of a coil, and a replenishing toner 65*a* is replenished in accordance with the quantity of the toner consumed. The toner concentration detecting sensor 85 has a coil (not shown) in its interior.

In this image-forming apparatus, the second image-forming unit Pb, third image-forming unit Pc and fourth image-forming unit Pd, which are constituted in the same way as the first image-forming unit Pa but having different color toners held in the developing assemblies are so provided that four image-forming units, are arranged side by side. For example, a yellow toner is used in the first image-forming unit Pa, a magenta toner in the second image-forming unit Pb, a cyan toner in the third image-forming unit Pc and a black toner in the fourth image-forming unit Pd, where toner images are formed on the photosensitive members provided corresponding to the respective toner colors and the respective color toners are sequentially transferred to the transfer material at the transfer zones of the respective image-forming units. In this course, the respective color toners are superimposed with registration on the same transfer material while the transfer material is moved once. After the transfer is completed, the transfer material is separated from the surface of the transfer material carrying member 68 by a separation charging assembly 69, and then, sent to a fixing assembly 70 by a transport means such as a transport belt, where a final full-color image is formed only by one-time fixing.

The fixing assembly 70 has a 40 mm diameter fixing roller 71 and a 30 mm diameter pressure roller 72. The fixing roller 71 has heating means 75 and 76 in its interior.

The unfixed color toner images transferred onto the transfer material pass through the pressure contact area between the fixing roller 71 and the pressure roller 72 of this fixing assembly 70, whereupon they are fixed onto the transfer material by the action of heat and pressure.

In the apparatus shown in FIG. 3, the transfer material carrying member 68 is an endless belt-like member. This belt-like member is moved in the direction of an arrow e by a drive roller 80. Reference numeral 79 denotes a transfer belt cleaning device; 81, a belt follower roller; and 82, a belt charge eliminator. Reference numeral 83 denotes a pair of registration rollers for transporting to the transfer material carrying member 68 the transfer material held in a transfer material holder.

As the transfer means, in place of the transfer blade coming into touch with the back of the transfer material carrying member, a transfer roller may be provided in contact therewith so that a transfer bias can directly be applied.

The above contact transfer means may also be replaced with a non-contact transfer means that performs transfer by applying a transfer bias from a corona charging assembly provided in non-contact with the back of the transfer material carrying member, as commonly used.

However, in view of the advantage that the quantity of ozone generated when the transfer bias is applied can be controlled, it is more preferable to use the contact transfer means.

Figure 4:
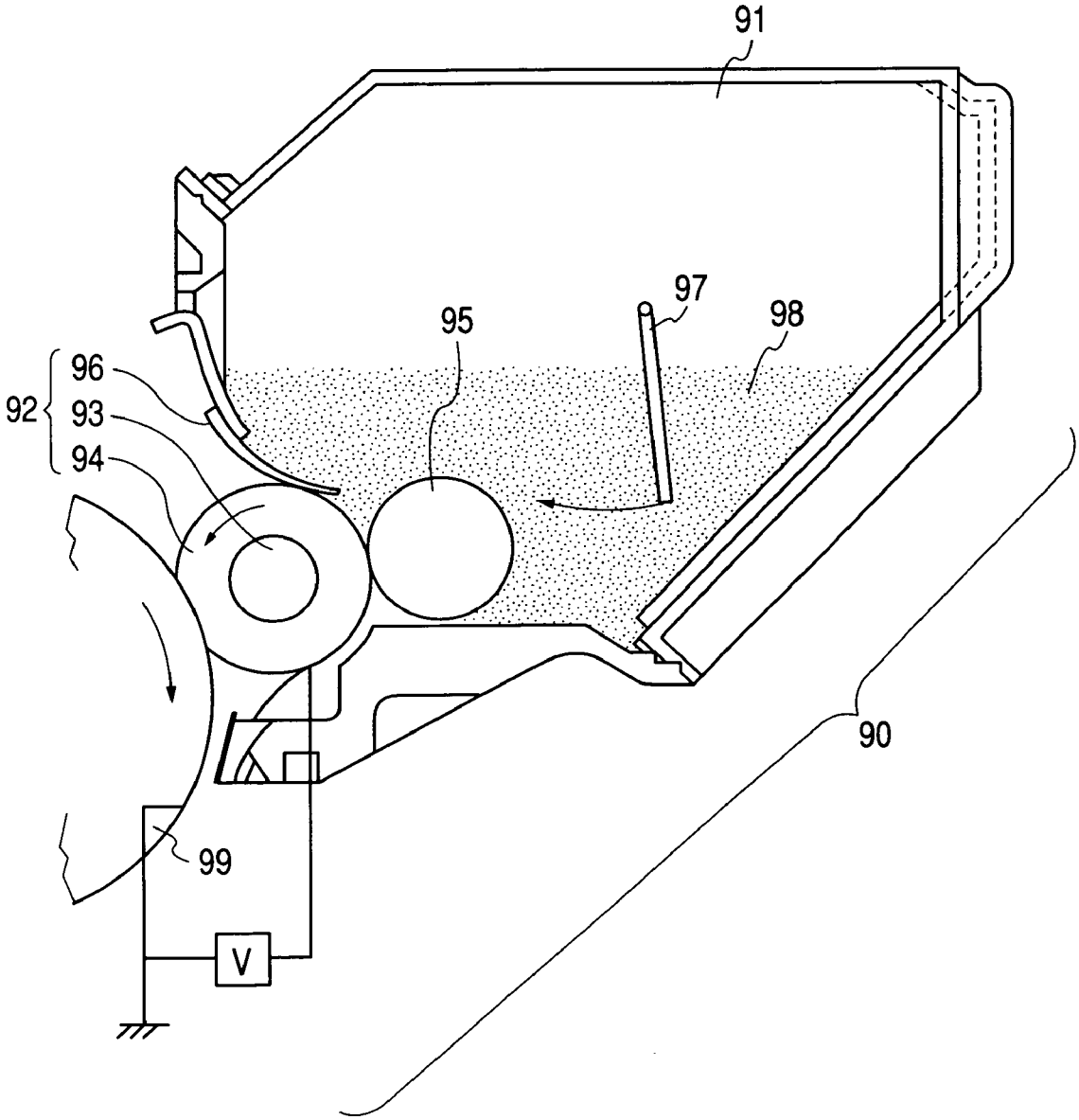
FIG. 4 is a schematic illustration showing an example of an image-forming apparatus in which the toner of the present invention is used in contact one-component development.

As a contact one-component developing method, the toner of the present invention may be used as a non-magnetic toner in, e.g., a developing assembly 90 as shown in FIG. 4 to perform development.

The developing assembly 90 has a developer container 91 for holding a one-component developer 98 having the non-magnetic toner, a developer carrying member 92 for carrying thereon the one-component developer 98 held in the developer container 91 and for transporting it to the developing zone, a feed roller 95 for feeding the developer onto the developer-carrying member, an elastic blade 96 as a developer layer thickness control member for controlling the layer thickness of a developer layer formed on the developer carrying member, and an agitating member 97 for agitating the developer 98 held in the developer container 91.

As the developer carrying member 92, an elastic roller may preferably be used which has on a roller substrate 93 an elastic layer 94 formed of a rubber having an elasticity, such as silicone rubber, or formed of an elastic member such as resin.

This elastic roller 92 comes into pressure contact with the surface of a photosensitive drum 99 as a latent-image-bearing member, a photosensitive member, and participates in developing an electrostatic latent image formed on the photosensitive member by the use of the one-component developer 98 applied on the surface of the elastic roller and also collects unnecessary one-component developer 98 present on the photosensitive member after transfer.

In the present invention, the developer carrying member 92 substantially comes into contact with the photosensitive member 99 surface. This means that the developer carrying member comes into contact with the photosensitive member when the one-component developer is removed from the developer carrying member. Here, images free of any edge effect can be formed by the aid of an electric field acting across the photosensitive member and the developer carrying member through the developer and simultaneously the photosensitive member surface is cleaned. The surface, or the vicinity of the surface, of the elastic roller serving as the developer carrying member must have a potential to have the electric field across the photosensitive member surface and the elastic roller surface. Thus, a method may also be used in which the elastic rubber of the elastic roller is controlled to have a resistance in a medium-resistance region so as to keep the electric field while preventing electrical connection with the photosensitive member surface, or a thin-layer dielectric layer is provided on the surface layer of a conductive roller. It is further possible to use a conductive resin sleeve comprising a conductive roller coated with an insulating material on its outer-surface side coming into contact with the photosensitive member surface, or to use an insulating sleeve so made up that a conductive layer is provided on its inner-surface side not coming into contact with the photosensitive member surface.

This elastic roller carrying the one-component developer may be rotated in the same direction as the photosensitive drum, or may be rotated in the direction opposite thereto. When they are rotated in the same direction, it may be rotated at a peripheral speed more than 100% of the peripheral speed of the photosensitive drum. If the peripheral speed is 100% or less, a problem may arise in image quality, where line images have a poor sharpness. The higher the peripheral speed is, the larger the quantity of the developer fed to the development zone is and the more frequently the developer is attached on and detached from electrostatic latent images. Thus, the developer at the unnecessary areas is scraped off and the developer is imparted to the necessary areas; this is repeated, so that images faithful to the electrostatic latent images are formed. More preferably, the elastic roller may be rotated at a peripheral speed of 100% or more of the peripheral speed of the photosensitive drum.

The developer layer thickness control member 96 is not limited to the elastic blade so long as it can elastically come into pressure contact with the surface of the developer carrying member 92, and an elastic roller may also be used.

The elastic blade or elastic roller may be formed of a rubber elastic material such as silicone rubber, urethane rubber and NBR, a synthetic resin elastic material such as polyethylene terephthalate, or a metal elastic member such as stainless steel or steel, any of which may be used. A composite of some of these may also be used.

In the case of the elastic blade, the elastic blade is, at its upper-edge side base portion, fixedly held on the side of the developer container and is so provided that its blade inner-face side (or its outer-face side in the case of the backward direction) is, at its lower-edge side, brought into touch with the sleeve surface under an appropriate elastic pressure in such a state that it is deflected against the elasticity of the blade in the forward direction or backward direction of the rotation of the developing sleeve.

A feed roller 95 is formed of a foamed material such as polyurethane foam, and is rotated at a relative speed that is not zero in the forward direction or backward direction with respect to the developer carrying member so that the one-component developer can be fed onto the developer carrying member and also the developer remaining on the developer carrying member after transfer (the developer not participating in development) can be taken off.

In the developing zone, when the electrostatic latent image on the photosensitive member is developed by the use of the one-component developer carried on the developer carrying member, a DC and/or AC development bias may preferably be applied across the developer carrying member and the photosensitive drum to perform development.

The non-contact jumping developing system is described below.

Figure 5:
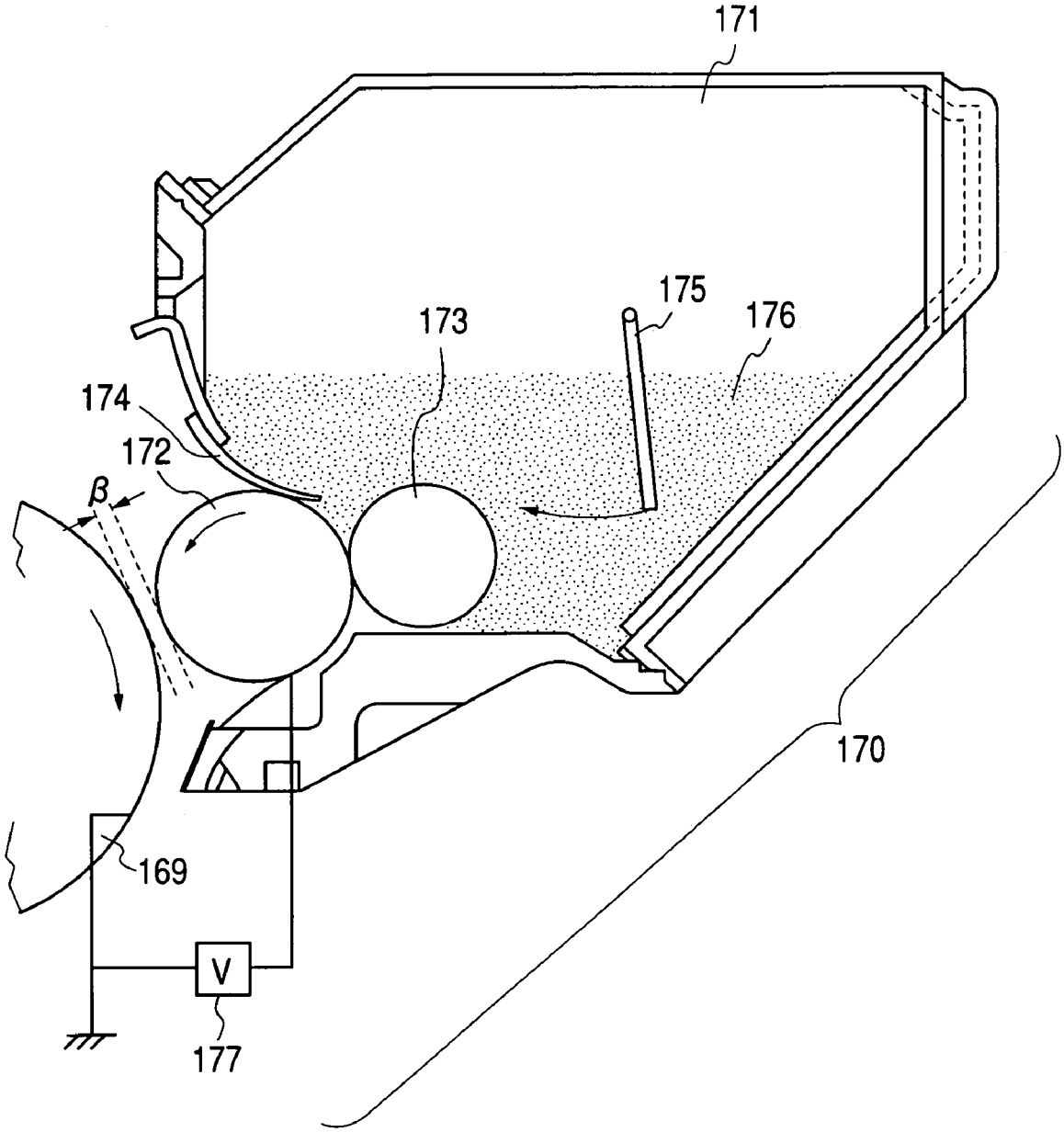
FIG. 5 is a schematic illustration showing an example of an image-forming apparatus in which the toner of the present invention is used in non-contact one-component development.

The non-contact jumping developing system may include a developing method making use of a one-component developer having a magnetic toner or non-magnetic toner. Herein, a developing method making use of a one-component non-magnetic developer having the toner of the present invention as the non-magnetic toner is described with reference to a schematic view of the constitution as shown in FIG. 5.

A developing assembly 170 has a developer container 171 for holding the one-component non-magnetic developer 176 (hereinafter often merely "developer") having a non-magnetic toner, a developer carrying member 172 for carrying thereon the one-component non-magnetic developer 176 held in the developer container 171 and for transporting it to the developing zone, a feed roller 173 for feeding the one-component non-magnetic developer onto the the developer carrying member 172, an elastic blade 174 as a developer layer thickness control member for controlling the thickness of a developer layer formed on the developer carrying member, and an agitating member 175 for agitating the one-component non-magnetic developer 176 held in the developer container 171.

Reference numeral 169 denotes a photosensitive member as an electrostatic latent image bearing member, on which latent images are to be formed by an electrophotographic processing means or electrostatic recording means (not shown). Reference numeral 172 denotes a developing sleeve serving as the developer carrying member, and is formed of a non-magnetic sleeve made of aluminum or stainless steel.

The developing sleeve may be prepared using a crude pipe of aluminum or stainless steel as it is, and may preferably be prepared by spraying glass beads on it to uniformly roughen the surface, by mirror-finishing its surface or by coating its surface with a resin.

The one-component non-magnetic developer 176 is reserved in the developer container 171, and is fed onto the developer carrying member 172 by the feed roller 173. The feed roller 173 is formed of a foamed material such as polyurethane foam, and is rotated at a relative speed that is not zero in the forward direction or backward direction with respect to the developer carrying member so that the developer can be fed onto the developer carrying member and also the developer remaining on the developer carrying member after transfer (the developer not participating in development) can be taken off. The one-component non-magnetic developer fed onto the developer carrying member is applied uniformly and in a thin layer by the elastic blade 174 serving as the developer layer thickness control member.

It is effective for the elastic member to be brought into touch with the developer carrying member at a pressure of from 0.3 to 25 kg/m, and preferably from 0.5 to 12 kg/cm, as a linear pressure in the generatrix direction of the developer carrying member. If the touch pressure is smaller than 0.3 kg/m, it is difficult to uniformly apply the one-component non-magnetic developer, resulting in a broad charge quantity distribution of the one-component non-magnetic developer to cause fog or spots around line images. If the touch pressure is greater than 25 kg/m, a great pressure is applied to the one-component non-magnetic developer so that the one-component non-magnetic developer deteriorates and the one-component non-magnetic developer agglomerates, thus such a pressure is not preferable, and also not preferable because a great torque is required in order to drive the developer carrying member. That is, the adjustment of the touch pressure to 0.3 to 25 kg/m makes it possible to effectively loosen the agglomeration of one-component non-magnetic developer and further makes it possible to effect instantaneous rise of the charge of the one-component non-magnetic developer.

As the developer layer thickness control member, an elastic blade or an elastic roller may be used, and it is preferable to use those made of a material of triboelectric series, suited for charging the developer electrostatically to the desired polarity.

In the present invention, silicone rubber, urethane rubber or styrene-butadiene rubber is preferred as a material for the developer layer thickness control member. An organic resin layer may also be provided which is formed of a resin such as polyamide, polyimide, nylon, melamine, melamine cross-linked nylon, phenol resin, fluorine resin, silicone resin, polyester resin, urethane resin or styrene resin. A conductive rubber or conductive resin may be used, and a filler such as metal oxide, carbon black, inorganic whisker or inorganic fiber and a charge control agent may further be dispersed in the rubber or resin of the elastic blade. This is also preferable because more appropriate conductivity and charge-providing properties can be imparted to the developer layer thickness control member and the one-component non-magnetic developer can appropriately be charged.

In this non-magnetic one-component developing method, in a system in which the one-component non-magnetic developer is applied in thin layer on the developing sleeve 172 by the elastic blade 174, it is preferable in order to achieve a sufficient image density that the thickness of the one-component non-magnetic developer on the developing sleeve is set smaller than a gap length β where the developing sleeve faces the latent image bearing member and an alternating electric field is applied to this gap. More specifically, an alternating electric field or a development bias formed by superimposing a direct current electric field on an alternating electric field is applied across the developing sleeve 172 and the latent image bearing member 169 by a bias power source 177 shown in FIG. 5. This facilitates the movement of the one-component non-magnetic developer from the surface of the developing sleeve. 172 to the photosensitive member 169 to enable images with a much better quality to be formed.

As process conditions in the present invention, where a usual transfer sheet (105 $g/m^2$ or less in basis weight) is fed, fixing speed may preferably be 100 to 700 mm/s in the case of black-and-white machines, and 100 to 400 mm/s in the case of full-color machines.

In addition, the fixing nip may preferably have a width of from 3 to 20 mm, and more preferably from 5 to 15 mm.

EXAMPLES

The present invention is described below by giving Examples. The present invention is by no means limited to these Examples. In the following, "part(s)" refers to "part(s) by weight".

Polar-Resin Production Example 1

3.65 mols of polyoxypropylene(2.2)-2,2-bis(4-hydroxyphenyl)propane, 6.21 mols of isophthalic acid and 0.14 mol of trimellitic anhydride were weighed out. Then, 100 parts of these acids and alcohol and 0.3 part of the above titanium chelate compound, Exemplary Compound 4, were put into a four-liter four-necked flask made of glass, and a thermometer, a stirring rod, a condenser and a nitrogen feed pipe were attached thereto. This flask was placed in a mantle heater. In an atmosphere of nitrogen, the reaction was carried out at 220° C. At the time the acid value came to be 12, the heating was stopped to allow the reaction mixture to cool gradually to obtain Polar Resin 1 having a polyester unit component. This resin had a hydroxyl value of 20, an Mw of 12,000, an Mn of 5,200 and a Tg of 65.7° C.

Polar-Resin Production Example 2

As materials for producing a vinyl copolymer, 1.1 mols of styrene, 0.14 mol of 1,2-ethylhexyl acrylate, 0.1 mol of acrylic acid and 0.05 mol of dicumyl peroxide were put into a dropping funnel. Also, 2.3 mols of polyoxypropylene (2.2)-2,2-bis(4-hydroxyphenyl)propane, 2.8 mols of polyoxyethylene(2.2)-2,2-bis(4-hydroxyphenyl)propane, 3.1 mols of terephthalic acid, 1.6 mols of isophthalic acid and 0.2 mol of trimellitic anhydride were weighed out. Then, 100 parts of these and 0.27 part of the above titanium chelate compound Exemplary Compound 4 were put into a four-liter four-necked flask made of glass, and a thermometer, a stirring rod, a condenser and a nitrogen feed pipe were attached thereto. This flask was placed in a mantle heater. Next, after the internal space of the flask was displaced with nitrogen gas, the temperature was gradually raised with stirring, where the monomers, cross-linking agent and polymerization initiator were dropwise added from the above dropping funnel over a period of 4 hours with stirring at a temperature of 145° C. Then, the temperature was raised to 220° C., and the reaction was carried out for 5 hours to obtain Polar Resin 2 having a polyester unit component. This resin had an acid value of 11, a hydroxyl value of 19, an Mw of 70,000, an Mn of 5,400 and a Tg of 66.7° C.

Polar-Resin Production Example 3

2.75 mols of polyoxypropylene(2.2)-2,2-bis(4-hydroxyphenyl)propane, 1.0 mol of polyoxyethylene (2.2)-2,2-bis (4-hydroxyphenyl)propane, 6.1 mols of isophthalic acid, and 0.15 mol of trimellitic anhydride were weighed out. Then, 100 parts of these acids and alcohols and 0.27 part of the above titanium chelate compound Exemplary Compound 1 were put into a four-liter four-necked flask made of glass, and a thermometer, a stirring rod, a condenser and a nitrogen feed pipe were attached thereto. This flask was placed in a mantle heater. In an atmosphere of nitrogen, the reaction was carried out at 220° C., At the time the acid value came to be 13, the heating was stopped to allow the reaction mixture to cool gradually to obtain Polar Resin 3 having a polyester unit component. This resin had a hydroxyl value of 20, an Mw of 13,000, an Mn of 5,300 and a Tg of 65.9° C.

Polar-Resin Production Example 4

Polar Resin 4 having a polyester unit component was obtained in the same manner as in Polar-Resin Production Example 3 except that, in place of the titanium chelate compound Exemplary Compound 1, the above titanium chelate compound Exemplary Compound 3 was used. The polyester unit component in the resin was in a content of 100% by weight. This resin had an acid value of 13, a hydroxyl value of 20, an Mw of 12,000, an Mn of 5,200 and a Tg of 66.7° C.

Polar-Resin Production Example 5

2.61 mols of polyoxypropylene(2.2)-2,2-bis(4-hydroxyphenyl)propane, 1.74 mols of polyoxyethylene (2.2)-2,2-bis(4-hydroxyphenyl)propane, 3.91 mols of fumaric acid and 1.74 mols of trimellitic anhydride were weighed out. Then, 100 parts of these acids and alcohols and 0.3 part of the above titanium chelate compound Exemplary Compound 2 were put into a four-liter four-necked flask made of glass, and a thermometer, a stirring rod, a condenser and a nitrogen feed pipe were attached thereto. This flask was placed in a mantle heater. In an atmosphere of nitrogen, the reaction was carried out at 235° C. for 5 hours to obtain Polar Resin 5 having a polyester unit component. This resin had an acid value of 10, a hydroxyl value of 18, an Mw of 34,000, an Mn of 3,200 and a Tg of 64.7° C.

Polar-Resin Production Example 6

Polar Resin 6 having a polyester unit component was obtained in the same manner as in Polar-Resin Production Example 1 except that the reaction was stopped at the time the acid value came to be 4. This resin had a hydroxyl value of 15, an Mw of 19,000, an Mn of 6,700 and a Tg of 65.7° C.

Polar-Resin Production Example 7

Polar Resin 7 having a polyester unit component was obtained in the same manner as in Polar-Resin Production Example 1 except that the reaction was stopped at the time the acid value came to be 22. This resin had a hydroxyl value of 28, an Mw of 11,000, an Mn of 3,700 and a Tg of 66.3° C.

Polar-Resin Production Example 8

Polar Resin 8 having a polyester unit component was obtained in the same manner as in Polar-Resin Production Example 3 except that, in place of the titanium chelate compound Exemplary Compound 1, 0.15 part of the above titanium chelate compound Exemplary Compound 3 and 0.15 part of the above titanium chelate compound Exemplary Compound 4 were used. The polyester unit component in the resin was in a content of 100% by weight. This resin had an acid value of 12, a hydroxyl value of 20, an Mw of 12,000, an Mn of 5,200 and a Tg of 66.7° C.

Polar-Resin Production Example 9

2.75 mols of polyoxypropylene(2.2)-2,2-bis(4-hydroxyphenyl)propane, 1.0 mol of polyoxyethylene (2.2)-2,2-bis (4-hydroxyphenyl)propane, 6.1 mols of isophthalic acid, and 0.15 mol of trimellitic anhydride were weighed out. Then, 100 parts of these acids and alcohols and 0.27 part of a dihydrate of the above titanium chelate compound Exemplary Compound 9 were put into a four-liter four-necked flask made of glass, and a thermometer, a stirring rod, a condenser and a nitrogen feed pipe were attached thereto. This flask was placed in a mantle heater. In an atmosphere of nitrogen, the reaction was carried out at 220° C. At the time the acid value came to be 12, the heating was stopped to allow the reaction mixture to cool gradually to obtain Polar Resin 9 having a polyester unit component. This resin had a hydroxyl value of 23, an Mw of 12,000, an Mn of 5,200 and a Tg of 68.0° C.

Polar-Resin

Comparative Production Example 1

Comparative Polar Resin 1 having a polyester unit component was obtained in the same manner as in Polar-Resin Production Example 3 except that, in place of the titanium chelate compound Exemplary Compound 1, tetramethyl titanate was used. The polyester unit component in the resin was in a content of 100% by weight. This resin had an acid value of 21, a hydroxyl value of 29, an Mw of 13,000, an Mn of 5,200 and a Tg of 65.7° C.

Polar-Resin

Comparative Production Example 2

Comparative Polar Resin 2 having a polyester unit component was obtained in the same manner as in Polar-Resin Production Example 3 except that, in place of the titanium chelate compound Exemplary Compound 1, dibutyltin oxide was used. The polyester unit component in the resin was in a content of 100% by weight. This resin had an acid value of 21, a hydroxyl value of 29, an Mw of 14,000, an Mn of 5,800 and a Tg of 67.6° C.

Polar-Resin

Comparative Production Example 3

Comparative Polar Resin 3 having a polyester unit component was obtained in the same manner as in Polar-Resin Production Example 1 except that the reaction was stopped at the time the acid value came to be 1. This resin had a hydroxyl value of 9, an Mw of 21,000, an Mn of 7,700 and a Tg of 66.7° C.

Polar-Resin

Comparative Production Example 4

Comparative Polar Resin 4 having a polyester unit component was obtained in the same manner as in Polar-Resin Production Example 1 except that the reaction was stopped at the time the acid value came to be 38. This resin had a hydroxyl value of 42, an Mw of 11,000, an Mn of 3,700 and a Tg of 66.7° C.

Toner Production Example 1

Based on 100 parts of the styrene monomer, 15 parts of a cyan colorant copper phthalocyanine (C.I. Pigment Blue 15:3) and 2.0 parts of a di-tert-butylsalicylic acid aluminum compound (BONTRON E101, available from Orient Chemical Industries, Ltd.) was made ready for use. These were introduced into an attritor, and, using zirconia beads of 1.25 mm in diameter, agitated at 200 rpm at 25° C. for 180 minutes to prepare Master Batch Dispersion 1.

Meanwhile, into 710 g of ion-exchange water, 450 parts of an aqueous 0.1M-$Na_3PO_4$ solution was introduced, followed by heating to 60° C. Thereafter, 67.7 parts of an aqueous 1.0M-$CaCl_2$ solution was little by little added thereto to obtain an aqueous medium containing a calcium phosphate compound.

Next, the following components:

| | |
|---|---|
| Master Batch Dispersion 1 | 53 parts |
| Styrene monomer | 12 parts |
| n-Butyl acrylate monomer | 35 parts |
| Ester wax (total number of carbon atoms: 34; half width: 4° C.; DSC endothermic peak: 70° C.; Mw: 800; Mn: 600; needle penetration: 6 degrees) | 20 parts |
| Polar Resin 1 (Mw: 12,000; Mn: 5,200; Tg: 65.7° C.; acid value: 12.0; hydroxyl value: 20) | 7 parts |
| Divinylbenzene | 0.075 part |
| were heated to 60° C., followed by stirring to effect uniform dissolution. In the mixture obtained, | 3 parts |
| of a polymerization initiator 2,2'-azobis(2,4-dimethylvaleronitrile) was dissolved. | |

Thus, a polymerizable monomer composition was prepared.

Then, maintaining the above aqueous medium to pH 6, the polymerizable monomer composition was introduced thereinto, followed by stirring at 60° C. in an atmosphere of N2 for 10 minutes at 10,000 rpm using a homomixer to granulate the polymerizable monomer composition. Thereafter, this was moved to a reaction vessel, where, maintaining the aqueous medium to pH 6, the temperature was raised to 63° C. while stirring with a paddle agitating blade, and the reaction was carried out for 5 hours. With further addition of 1 part of potassium perphosphate, the temperature was raised to 80° C., and the reaction was carried out for 5 hours. After the polymerization reaction was completed, the reaction system was sufficiently vacuum-dried and then cooled. Thereafter, hydrochloric acid was added thereto to dissolve the calcium phosphate compound, followed by filtration, washing with water, drying in vacuo, and then classification by means of a multi-division classifier to obtain cyan toner particles.

Based on 100 parts of the cyan toner particles thus obtained, 1.2 parts of silicone-oil-treated hydrophobic silica having a BET specific surface area of 200 $m^2/g$ and 0.2 part of isobutyltrimethoxysilane-treated anatase-type fine titanium oxide having a BET specific surface area of 100 $m^2/g$ were externally added by means of a Henschel mixer, followed by removal of coarse particles by means of a Turbo screener having a #400 mesh sieve to obtain a cyan non-magnetic toner Toner No. 1. This toner had a weight-average particle diameter of 6.9 μm; a TA value of 42 and a TB value of 61. The composition of Toner No. 1 obtained is shown in Table 1A, and physical properties thereof in Table 1B.

Toner Production Example 2

A cyan toner Toner No. 2 was obtained in the same manner as in Toner Production Example 1 except that the polar resin used therein was changed for Polar Resin 2 which was added in an amount of 10 parts. The composition of Toner No. 2 obtained is shown in Table 1A, and physical properties thereof in Table 1B.

Toner Production Example 3

A cyan toner Toner No. 3 was obtained in the same manner as in Toner Production Example 1 except that the polar resin used therein was changed for Polar Resin 3 which was added in an amount of 10 parts. The composition of Toner No. 3 obtained is shown in Table 1A, and physical properties thereof in Table 1B.

Toner Production Example 4

A cyan toner Toner No. 4 was obtained in the same manner as in Toner Production Example 1 except that the polar resin used therein was changed for Polar Resin 4 which was added in an amount of 10 parts. The composition of Toner No. 4 obtained is shown in Table 1A, and physical properties thereof in Table 1B.

Toner Production Example 5

A cyan toner Toner No. 5 was obtained in the same manner as in Toner Production Example 1 except that the polar resin used therein was changed for Polar Resin 5 which was added in an amount of 23 parts and a release agent was added in an amount of 20 parts. The composition of Toner No. 5 obtained is shown in Table 1A, and physical properties thereof in Table 1B.

Toner Production Example 6

A cyan toner Toner No. 6 was obtained in the same manner as in Toner Production Example 1 except that the polar resin used therein was changed for Polar Resin 6. The composition of Toner No. 6 obtained is shown in Table 1A, and physical properties thereof in Table 1B.

Toner Production Example 7

A cyan toner Toner No. 7 was obtained in the same manner as in Toner Production Example 1 except that the polar resin was changed for Polar Resin 7. The composition of Toner No. 7 obtained is shown in Table 1A, and physical properties thereof in Table 1B.

Toner Comparative Production Examples 1 to 4

Comparative Toners No. 1 to No. 4 were obtained in the same manner as in Toner Production Example 1 except that the polar resin was changed for Comparative Polar Resins 1 to 4, respectively, the ester wax as a release agent was changed for polypropylene wax (half width: 22° C.; DSC endothermic peak: 129° C.; Mw: 17,000; Mn: 1,350; needle penetration: 0.5 degrees) added in an amount of 2.5 parts and as the inorganic fine powder only the hydrophobic silica was added in an amount of 0.9 part. The composition of each of Comparative Toners No. 1 to No. 4 obtained is shown in Table 1A, and physical properties thereof in Table 1B.

Toner Comparative Production Example 5

A cyan toner Comparative Toner No. 5 with a weight-average particle diameter of 3.4 μm (particles of 4 μm or less: 62.0% by number; particles of 12.7 μm or more: 0% by volume) was obtained in the same manner as in Toner Production Example 1 except that the polar resin was changed for Polar Resin 6, the aqueous 0.1M-$Na_3PO_4$ solution was used in an amount of 600 parts, the number of revolutions of the homomixer was changed to 13,000 rpm, the classification conditions of the multi-division classifier were changed and the hydrophobic silica was used in an amount of 1.1 parts. The composition of Comparative Toner No. 5 obtained is shown in Table 1A, and physical properties thereof in Table 1B.

Toner Comparative Production Example 6

A cyan toner Comparative Toner No. 6 with a weight-average particle diameter of 10.9 μm (particles of 4 μm or less: 2.7% by number; particles of 12.7 μm or more: 3.4% by volume) was obtained in the same manner as in Toner Production Example 1 except that the polar resin was changed for Polar Resin 7, the aqueous 0.1M-$Na_3PO_4$ solution was used in an amount of 190 parts, the number of revolutions of the homomixer was changed to 4,300 rpm, the classification conditions of the multi-division classifier were changed and the hydrophobic silica was used in an amount of 0.7 part. The composition of Comparative Toner No. 6 obtained is shown in Table 1A, and physical properties thereof in Table 1B.

Toner Comparative Production Example 7

A cyan toner Comparative Toner No. 7 was obtained in the same manner as in Toner Production Example 15 except that the polar resin was not used. The composition of Comparative Toner No. 7 obtained is shown in Table 1A, and physical properties thereof in Table 1B.

Toner Production Example 8

A cyan toner Toner No. 8 with a weight-average particle diameter of 4.9 μm (particles of 4 μm or less: 49.0% by number; particles of 12.7 μm or more: 0% by volume) was obtained in the same manner as in Toner Production Example 6 except that the polar resin was changed for Polar Resin 6, the aqueous 0.1M-$Na_3PO_4$ solution was used in an amount of 520 parts, the number of revolutions of the homomixer was changed to 11,500 rpm, the classification conditions of the multi-division classifier were changed and the hydrophobic silica and the hydrophobic titanium oxide were used in amounts of 1.5 parts and 0.3 part, respectively. The composition of Toner No. 8 obtained is shown in Table 1A, and physical properties thereof in Table 1B.

Toner Production Example 9

A cyan toner Toner No. 9 with a weight-average particle diameter of 9.2 μm (particles of 4 μm or less: 8.0% by number; particles of 12.7 μm or more: 2.1% by volume) was obtained in the same manner as in Toner Production Example 7 except that the polar resin was changed for Polar Resin 7 and the hydrophobic silica and the hydrophobic titanium oxide were used in amounts of 0.7 part and 0.1 part, respectively. The composition of Toner No. 9 obtained is shown in Table 1A, and physical properties thereof in Table 1B.

Toner Production Example 10

A cyan toner Toner No. 10 with a weight-average particle diameter of 6.7 μm was obtained in the same manner as in Toner Production Example 6 except that the ester wax was added in an amount of 40 parts and the hydrophobic silica and the hydrophobic titanium oxide were used in amounts of 1.8 parts and 0.5 part, respectively. The composition of Toner No. 10 obtained is shown in Table 1A, and physical properties thereof in Table 1B.

Toner Production Example 11

A cyan toner Toner No. 11 with a weight-average particle diameter of 6.8 μm was obtained in the same manner as in Toner Production Example 9 except that the ester wax was added in an amount of 3 parts and the hydrophobic silica and the hydrophobic titanium oxide were used in amounts of 1.2 parts and 0.2 part, respectively. The composition of Toner No. 11 obtained is shown in Table 1A, and physical properties thereof in Table 1B.

Toner Production Example 12

A cyan toner Toner No. 12 with a weight-average particle diameter of 6.7 μm was obtained in the same manner as in Toner Production Example 11 except that the hydrophobic silica and the hydrophobic titanium oxide were used in amounts of 1.5 parts and 0.3 part, respectively. The composition of Toner No. 12 obtained is shown in Table 1A, and physical properties thereof in Table 1B.

Toner Production Example 13

A cyan toner Toner No. 13 with a weight-average particle diameter of 6.8 μm was obtained in the same manner as in Toner Production Example 11 except that the hydrophobic silica and the hydrophobic titanium oxide were used in amounts of 1.8 parts and 0.4 part, respectively. The composition of Toner No. 13 obtained is shown in Table 1A, and physical properties thereof in Table 1B.

Production of Magnetic Material 1

In an aqueous ferrous sulfate solution, a sodium hydroxide solution and sodium silicate were mixed in an equivalent weight of from 1.0 to 1.1 based on iron ions to prepare an aqueous solution containing ferrous hydroxide.

Maintaining the pH of the aqueous solution at about 9, air was blown into it to effect oxidation at 80 to 90° C. to prepare a slurry fluid from which seed crystals were to be formed. Subsequently, to this slurry fluid, an aqueous ferrous sulfate solution was so added as to be in an equivalent weight of from 0.9 to 1.2 based on the initial alkali content (the sodium component in the sodium hydroxide). Thereafter, maintaining the pH of the slurry fluid at 9, oxidation reaction was allowed to proceed while air was blown into it. Magnetic iron oxide particles thus formed as a result of the oxidation reaction were washed, filtered and then taken out once. Here, a water-containing sample was withdrawn in a small quantity, and its water content was beforehand measured. Then, this water-containing sample was, without being dried, re-dispresed in another aqueous medium. Thereafter, the pH of the re-dispersion formed was adjusted to about 6, and then a silane coupling agent [n-$C_{10}H_21Si(OCH_3)_3$] was added thereto with thorough stirring, in an amount of 1.2 parts based on the weight of magnetic iron oxide (the weight of magnetic iron oxide was calculated as a value obtained by subtracting the water content from the water-containing sample) to carry out coupling treatment. Next, fine-particle components were removed by wet-process classification making use of precipitation separation. The hydrophobic iron oxide particles thus obtained were washed, filtered and then dried by normal methods, followed by disintegration treatment of particles standing a little agglomerated, to obtain Magnetic Material 1.

Toner Production Example 14

Into 710 g of ion-exchange water, 450 parts of an aqueous 0.1M-$Na_3PO_4$ solution was introduced, followed by heating to 60° C. Thereafter, 67.7 parts of an aqueous 1.0M-$CaCl_2$ solution was little by little added thereto to obtain an aqueous medium containing a calcium phosphate compound.

| | |
|---|---|
| Styrene | 77 parts |
| n-Butyl acrylate | 23 parts |
| Ester wax (total number of carbon atoms: 34; half width: 4° C.; DSC endothermic peak: 70° C.; Mw: 800; Mn: 600; needle penetration: 6 degrees) | 17 parts |
| Polar Resin 1 (Mw: 12,000; Mn: 5,200; Tg: 65.7° C.; acid value: 12.0; hydroxyl value: 20) | 7 parts |
| Divinylbenzene | 0.075 part |
| Di-tert-butylsalicylic acid aluminum compound (BONTRON E101, available from Orient Chemical Industries, Ltd.) | 1 part |
| Magnetic Material 1 | 100 parts |

These were added to the above aqueous medium having been heated to 60° C., followed by stirring to effect uniform dissolution and dispersion. In the mixture obtained, 3 parts of a polymerization initiator 2,2'-azobis(2,4-dimethylvaleronitrile) was dissolved. Thus, a polymerizable monomer composition was prepared. Except for this, toner particles were obtained in the same manner as in Toner Production Example 1. To the toner particles thus obtained, the hydrophobic silica and hydrophobic titanium oxide used in Toner Production Example 1 were added in amounts of 1.2 parts and 0.05 part, respectively, to obtain Toner No. 14. The composition of Toner No. 14 obtained is shown in Table 1A, and physical properties thereof in Table 1B.

Toner Production Example 15

Preparation of Dispersion (A):

| | |
|---|---|
| Polar Resin 5 | 50 g |
| Methylene chloride | 100 g |

The above materials were mixed and dissolved by means of a ball mill, and the solution obtained was dispersed in 155 g of pure water containing 10% of polyethylene glycol and 0.7% of a cationic surface-active agent (SANIZOLE B50, available from Kao Corporation), which were dispersed applying a shear force strongly by means of a rotor-stator type homogenizer (ULTRATARAX, manufactured by IKA K.K.). The fluid dispersion formed was heated to 62° C., and was kept for 1 hour, obtaining Dispersion (A).

Preparation of Colorant Dispersion (B):

| | |
|---|---|
| Copper phthalocyanine pigment (PV FAST BLUE, available from BASF Corp.) | 90 g |
| Anionic surface-active agent (NEOGEN SC, available from Dai-ichi Kogyo Seiyaku Co., Ltd.) | 5 g |
| Ion-exchange water | 200 g |
| Di-tert-butylsalicylic acid aluminum compound (BONTRON E101, available from Orient Chemical Industries, Ltd.) | 10 g |

The above materials were mixed and dissolved, and the solution obtained was subjected to dispersion for 10 minutes by means of a rotor-stator-type homogenizer (ULTRATARAX, manufactured by IKA K.K.). The fluid dispersion formed was further subjected to dispersion for 5 minutes by means of an ultrasonic homogenizer to produce Colorant Dispersion (B).

Preparation of Release Agent Dispersion (C):

| | |
|---|---|
| Polypropylene wax (half width: 22° C.; DSC endothermic peak: 129° C.; Mw: 17,000; Mn: 1,350; needle penetration: 0.5 degree) | 5 g |
| Cationic surface-active agent (SANIZOLE B50, available from Kao Corporation) | 5 g |
| Ion-exchange water | 200 g |

The above materials were heated to 95° C., and were subjected to dispersion by means of a homogenizer (ULTRATARAX T50, manufactured by IKA K.K.), followed by further dispersion by means of a pressure ejection-type homogenizer to produce Release Agent Dispersion (C).

Preparation of Agglomerated Particles

| | |
|---|---|
| Dispersion (A) | 200 g |
| Colorant Dispersion (B) | 10 g |
| Release Agent Dispersion (C) | 10 g |
| Cationic surface-active agent (SANIZOLE B50, available from Kao Corporation) | 2 g |

The above materials were mixed in a round flask made of stainless steel, by means of a homogenizer (ULTRATARAX T50, manufactured by IKA K.K.) to effect dispersion. Thereafter, the fluid dispersion formed was heated to 48° C. using a heating oil bath while the contents in the flask were stirred. This was kept at 48° C. for 30 minutes to produce agglomerated particles.

<Second Step>

Preparation of Colorant-Deposited Particles

To the flask holding the agglomerated particles, 5 g of Colorant Dispersion (B) as a fine colorant particle dispersion was gently added, and the temperature of the heating oil bath was further raised to 50° C., and was kept for 30 minutes. The temperature was further raised to 52° C., and was kept for 1 hour to produce colorant-deposited particles.

<Third Step>

Thereafter, to the flask holding the colorant-deposited particles, 2 g of an anionic surface-active agent (NEOGEN SC, available from Dai-ichi Kogyo Seiyaku Co., Ltd.) was added, and then the flask made of stainless steel was made airtight, where stirring was continued using magnetic shielding. Then, the reaction mixture was heated to 110° C., and was kept for 3 hours. After cooling, the reaction product was filtered and then sufficiently washed with ion-exchange water to produce toner particles for developing electrostatic latent images. Except for the foregoing, Toner No. 15 was obtained in the same manner as in Toner Production Example 1. The composition of Toner No. 15 obtained is shown in Table 1A, and physical properties thereof in Table 1B.

Toner Production Example 16

<Mixing Step>

The following materials were subjected to dispersion for 24 hours by means of a ball mill to produce 200 parts of a toner composition fluid mixture in which Polar Resin 5 stood dispersed.

| | |
|---|---|
| Polar Resin 5 | 85 parts |
| C.I. Pigment Blue 15:3 | 6.5 parts |
| Polypropylene wax (half width: 22° C.; DSC endothermic peak: 129° C.; Mw: 17,000; Mn: 1,350; needle penetration: 0.5 degree) | 7.5 parts |
| Di-tert-butylsalicylic acid aluminum compound (BONTRON E101, available from Orient Chemical Industries, Ltd.) | 1 part |
| Ethyl acetate (solvent) | 100 parts |

<Dispersion Suspension Step>

The following materials were subjected to dispersion for 24 hours by means of a ball mill to dissolve carboxymethyl cellulose, obtaining an aqueous medium.

| | |
|---|---|
| Calcium carbonate (coated with an acrylic-acid type copolymer) | 20 parts |
| Carboxymethyl cellulose (trade name: CELLOGEN BS-H, available from Dai-ichi Kogyo Seiyaku Co., Ltd.). | 0.5 part |
| Ion-exchange water | 99.5 parts |

1,200 g of an aqueous medium obtained from the above materials was put into a TK homomixer, and was stirred rotating a rotary blade at a peripheral speed of 20 m/sec, during which 1,000 g of the above toner composition fluid mixture was introduced. These were stirred for 1 minute maintaining the temperature to 25° C. constantly, obtaining a suspension.

<Solvent Removal Step>

2,200 g of the suspension obtained in the dispersion suspension step was stirred by means of a Full-zone blade (manufactured by Shinko Pantekku K.K.) at a peripheral speed of 45 m/min, during which, keeping the temperature at 40° C. constantly, the gaseous phase on the suspension was forcibly renewed using a blower to start to remove the solvent. In that course, after 15 minutes from the start of solvent removal, 75 g of ammonia water diluted to 1% was added as an ionic substance. Subsequently, after 1 hour from the start of solvent removal, 25 g of the ammonia water was added. Subsequently, after 2 hours from the start of solvent removal, 25 g of the ammonia water was added. Finally, after 3 hours from the start of solvent removal, 25 g of the ammonia water was added, so that a total of 150 g of the ammonia water was added. Further, keeping the temperature at 40° C., the system was held for 17 hours from the start of solvent removal. Thus, a toner dispersion was obtained in which the solvent (ethyl acetate) was removed from suspended particles.

<Washing and Dehydration Step>

To 300 parts of the toner dispersion obtained in the solvent removal step, 80 parts of 10 mol/l hydrochloric acid was added, followed by further addition of an aqueous 0.1 mol/l sodium hydroxide solution to effect neutralization treatment. Thereafter, washing with ion-exchange water by suction filtration was repeated four times to produce a toner cake.

<Drying and Sifting Step>

The toner cake obtained as described above was dried by means of a vacuum dryer, followed by sifting through a 45-mesh sieve. Except for the foregoing, Toner No. 16 was obtained in the same manner as in Toner Production Example 1. The composition of Toner No. 16 obtained is shown in Table 1A, and physical properties thereof in Table 1B.

Toner Production Example 17

A yellow toner Toner No. 17 was obtained in the same manner as in Toner Production Example 1 except that in place of C.I. Pigment Blue 15:3 used therein C.I. Pigment Yellow 93 was used in an amount of 14 parts. The composition of Toner No. 17 obtained is shown in Table 1A, and physical properties thereof in Table 1B.

Toner Production Example 18

A magenta toner Toner No. 18 was obtained in the same manner as in Toner Production Example 1 except that in place of C.I. Pigment Blue 15:3 used therein dimethylquinacridone was used in an amount of 14 parts. The composition of Toner No. 18 obtained is shown in Table 1A, and physical properties thereof in Table 1B.

Toner Production Example 19

A black toner Toner No. 19 was obtained in the same manner as in Toner Production Example 1 except that in place of C.I. Pigment Blue 15:3 used therein carbon black was used in an amount of 20 parts. The composition of Toner No. 19 obtained is shown in Table 1A, and physical properties thereof in Table 1B.

Toner Production Example 20

A cyan toner Toner No. 20 with a weight-average particle diameter of 6.9 μm was obtained in the same manner as in Toner Production Example 1 except that the hydrophobic silica and the hydrophobic titanium oxide were used in amounts of 1.0 part and 0.4 part, respectively. The composition of Toner No. 20 obtained is shown in Table 1A, and physical properties thereof in Table 1B. In addition, this toner was blended with Magnetic Carrier 1 described later, in a toner concentration of 8% by weight to make up Developer 20.

Toner Production Example 21

A yellow toner Toner No. 21 with a weight-average particle diameter of 6.8 μm was obtained in the same manner as in Toner Production Example 17 except that the hydrophobic silica and the hydrophobic titanium oxide were used in amounts of 1.0 part and 0.4 part, respectively. The composition of Toner No. 21 obtained is shown in Table 1A, and physical properties thereof in Table 1B. In addtion, this toner was blended with Magnetic Carrier 1 described later, in a toner concentration of 8% by weight to make up Developer 21.

Toner Production Example 22

A magenta toner Toner No. 22 with a weight-average particle diameter of 6.8 μm was obtained in the same manner as in Toner Production Example 18 except that the hydrophobic silica and the hydrophobic titanium oxide were used in amounts of 1.0 part and 0.4 part, respectively. The composition of Toner No. 22 obtained is shown in Table 1A, and physical properties thereof in Table 1B. In addition, this toner was blended with Magnetic Carrier 1 described later, in a toner concentration of 8% by weight to make up Developer 22.

Toner Production Example 23

A black toner Toner No. 23 with a weight-average particle diameter of 6.8 μm was obtained in the same manner as in Toner Production Example 19 except that the hydrophobic silica and the hydrophobic-titanium oxide were used in amounts of 1.0 part and 0.4 part, respectively. The composition of Toner No. 23 obtained is shown in Table 1A, and physical properties thereof in Table 1B. In addition, this toner was blended with Magnetic Carrier 1 described later, in a toner concentration of 8% by weight to make up Developer 23.

Toner Production Example 24

A cyan toner Toner No. 24 was obtained in the same manner as in Toner Production Example 3 except that as the release agent used therein an ester wax having an endothermic peak temperature of 48° C. was used. The composition of Toner No. 24 obtained is shown in Table 1A, and physical properties thereof in Table 1B.

Toner Production Example 25

A cyan toner Toner No. 25 was obtained in the same manner as in Toner Production Example 3 except that as the release agent used therein a polyethylene wax having an endothermic peak temperature of 124° C. was used. The composition of Toner No. 25 obtained is shown in Table 1A, and physical properties thereof in Table 1B.

Toner Production Example 26

A cyan toner Toner No. 26 was obtained in the same manner as in Toner Production Example 1 except that the di-tert-butylsalicylic acid aluminum compound was not used. The composition of Toner No. 26 obtained is shown in Table 1A, and physical properties thereof in Table 1B.

Toner Production Example 27

A cyan toner Toner No. 27 was obtained in the same manner as in Toner Production Example 1 except that in place of the di-tert-butylsalicylic acid aluminum compound a di-tert-butylsalicylic acid zirconium compound (TN105, available from Hodogaya Chemical Co., Ltd.) was used. The composition of Toner No. 27 obtained is shown in Table 1A, and physical properties thereof in Table 1B.

Toner Production Example 28

A cyan toner Toner No. 28 was obtained in the same manner as in Toner Production Example 1 except that in place of the di-tert-butylsalicylic acid aluminum compound a di-tert-butylsalicylic acid zinc compound (BONTRON E84, available from Orient Chemical Industries, Ltd.) was used. The composition of Toner No. 28 obtained is shown in Table 1A, and physical properties thereof in Table 1B.

Toner Production Example 29

A cyan toner Toner No. 29 was obtained in the same manner as in Toner Production Example 1 except that the polar resin used was changed for Polar Resin 8. The composition of Toner No. 29 obtained is shown in Table 1A, and physical properties thereof in Table 1B.

Toner Production Example 30

A cyan toner Toner No. 30 was obtained in the same manner as in Toner Production Example 1 except that the polar resin used was changed for Polar Resin 9. The composition of Toner No. 29 obtained is shown in Table 1A, and physical properties thereof in Table 1B.

Magnetic-Carrier Production Example 1

| | |
|---|---|
| Phenol (hydroxybenzene) | 50 parts |
| Aqueous 37% by weight formaldehyde solution (formalin) | 80 parts |
| Water | 50 parts |
| Alumina-containing fine magnetite particles surface-treated with a silane coupling agent having an epoxy group, KBM403 (available from Shin-Etsu Chemical Co., Ltd.) (number-average particle diameter: 0.22 μm; resistivity: $4 \times 10^5$ Ω · cm) | 280 parts |
| Fine $\alpha$-$Fe_2O_3$ particles surface-treated with KBM403 (number-average particle diameter: 0.40 μm; resistivity: $8 \times 10^9$ Ω · cm) | 120 parts |
| 25% by weight ammonia water | 15 parts |

The above materials were put into a four-necked flask, and were stirred and mixed, during which the mixture was heated to 85° C. over a period of 60 minutes and was held at that temperature, where the reaction was carried out for 120 minutes, followed by curing. Thereafter, the reaction product was cooled to 30° C., and 500 parts of water was added thereto. Then, the supernatant formed was removed, and the precipitate formed was washed with water, followed by air drying. Subsequently, this was vacuum-dried for 24 hours to produce Magnetic Carrier Cores (A) having a phenolic resin as a binder resin. On Magnetic Carrier Cores (A), 0.4% by weight of adsorbed water was present after left standing for 24 hours in an environment of 30° C./80% RH(relative humidity).

Magnetic Carrier Cores (A) obtained were surface-coated with a toluene solution of 5% by weight of γ-aminopropyltrimethoxysilane represented by the following formula:

$$NH_2—CH_2CH_2CH_2—Si—(OCH_3)_3$$

As the result, Magnetic Carrier Cores (A) stood surface-treated with 0.3% by weight of γ-aminopropyltrimethoxysilane. During the coating, the toluene was evaporated while applying shear force continuously to Magnetic Carrier Cores (A). It was ascertained that

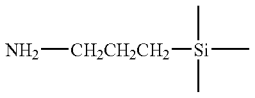

groups were present on the surfaces of Magnetic Carrier Cores (A).

The above Magnetic Carrier Cores (A) having been treated with the silane coupling agent in a treating machine were stirred at 70° C., during which a silicone resin KR-221 8 (available from Shin-Etsu Chemical Co., Ltd.) to which γ-aminopropyltrimethoxysilane was added in a proportion of 4% based on the silicone resin solid content and which was diluted with toluene in a concentration of 25% as the silicone resin solid content, was added under reduced pressure to coat the carrier cores with the resin. Thereafter, the coated carrier cores were agitated for 2 hours, and then heat-treated at 140° C. for 2 hours in an atmosphere of nitrogen gas. After agglomerates were broken up, coarse particles of 200 meshes or more were removed to produce Magnetic Carrier 1.

Magnetic Carrier 1 thus obtained had an average particle diameter of 35 μm, a resistivity of $1 \times 10^{13}$ Ω·cm, an intensity of magnetization at 1 kOe ($\sigma_{1000}$) of 40 $Am^2/kg$, an apparent density of 1.9 $g/cm^3$ and an SF-1 of 107.

Magnetic-Carrier Production Example 2

14.0 mol % of $Li_2CO_3$, 77.0 mol % of $Fe_2O_3$, 6.8 mol % of $Mg(OH)_2$ and 2.2 mol % of $CaCO_3$ were pulverized and mixed by means of a wet-process ball mill, followed by drying. This was held at 900° C. for 1 hour to effect calcination. The resultant calcined product was pulverized for 7 hours into particles of 3 μm or less in diameter by means of the wet-process ball mill. To the resultant slurry, a dispersant and a binder were added in appropriate quantities, followed by granulation and drying by means of a spray dryer. The granulated product obtained was held at 1,240° C. for 4 hours in an electric furnace to carry out firing. Thereafter, the fired product was broken up, and was further classified to produce Magnetic Carrier 2 formed of ferrite particles of 40 μm in average particle diameter.

Example 1

As an image-forming apparatus, a commercially available color laser printer CP2810 (manufactured by CANON INC.) was remodeled to a printer having a fixing speed of 150 mm/s and being able to reproduce images on 20 sheets/minute.

Using Developer No. 1 composed of Toner No. 1, an image pattern with a print percentage (image area percentage) of 10% in which circles of 20 mm in diameter, having an image density of 1.5 as measured with a Model 504reflection densitometer manufactured by X-Rite K.K. are provided at five spots, was printed to conduct a 10,000-sheet running (extensive operation) test in each of environments of 23° C./5%RH (N/L) and 32.5° C./92% RH (H/H). Evaluation was made according to such evaluation methods as shown below. The evaluation results are shown in Table 2. As can be seen from Table 2, substantially good results were obtained in all evaluation items.

(1) Low-Temperature Fixing Performance:

Evaluation was made using Xx 64 g paper in an environment of L/L (15° C./10% RH). Solid images each 5 cm square in size were reproduced on a A4 sheet of paper at nine spots. Here, unfixed images each were so formed as to be in a toner laid-on quantity of 0.6 $mg/cm^2$. The fixed images were rubbed five times with Silbon paper under application of a load of 4.9 kPa, and the temperature at which the image density decreased by 20% or more was regarded as fixing lower-limit temperature.

(2) OHT Transparency Evaluation:

Using transparency sheets (OHT) for exclusive use in CP2810, solid images (each on the transfer sheet: 0.6 $mg/cm^2$) were reproduced thereon in an environment of N/N (23.5° C./60% RH). The images formed were projected on a screen by using a transmission OHP (overhead projector). Projected images were evaluated in five ranks as shown below.

A: Transparency is very high and good.

B: Transparency is good.

C: Dullness is somewhat seen, but of no problem in practical use.

D: Dullness is fairly seen, and on a level that is somewhat problematic.

E: Intolerable in practical use.

(3) High-Temperature Anti-Offset Properties:

Evaluated using Xx 64 g paper in an environment of N/N (23.5° C./60% RH). A solid white image was reproduced on 50 sheets fed in A4-lenghthwise feed. Thereafter, in A4-breadthwise feed, an image in which the whole area within 5 cm from the leading end was in halftone with an image density of 0.5 and the other area was in solid white, was copied on both sides. The level of offset appearing on the white background area in the A4-breadthwise feed was visually inspected.

A: No offset appears at all.

B: Offset appears slightly at end areas other than the area corresponding to A4-lenghthwise feed, but is not on a level that is problematic in practical use.

C: Offset a little appears at end areas other than the area corresponding to A4-lenghthwise feed. It is on a level which is a limit tolerable in practical use, but of no problem in usual copying.

D: Offset appears in the whole area in the lengthwise direction, and on a level that is problematic in practical use.

E: Offset appears starting from the fist side in the whole area in the lengthwise direction, and is intolerable in practical use.

(4) Fog:

Fog was measured in the 10,000-sheet running test in the environments of N/L and H/H. As a method therefor, the average reflectance Dr (%) on plain paper before image reproduction was measured with a reflectometer (REFLECTOMETER MODEL TC-6DS, manufactured by Tokyo Denshoku K.K.) having a filter of a complementary color of a color to be measured. Meanwhile, a solid white image was reproduced on plain paper, and then the reflectance Ds (%) of the solid white image was measured. Fog (%) is calculated from the following equation:

$$\text{Fog}(\%)=Dr(\%)-Ds(\%).$$

(5) Image density:

In the 10,000-sheet running test in the environments of N/L and H/H, image density was measured with a Model 504 reflection densitometer manufactured by X-Rite K.K.

(6) Melt Adhesion to Drum:

In the 10,000-sheet running test in the environment of H/H, whether or not any melt-adhesion matter appeared on the photosensitive drum was evaluated visually and with a loupe in six ranks according to the following criteria.

A: No melt-adhesion matter is present at all.

B: Melt-adhesion matter of 0.1 mm or less in diameter is present at several spots on the drum, but of no problem on images at all.

C: Melt-adhesion matter of 0.1 mm to 0.4 mm in diameter is present at several spots on the drum and stands appears slightly on images, but is not on a level that is problematic in practical use.

D: Melt-adhesion matter of more than 0.4 mm in diameter is present at ten spots or more on the drum, appears on images, and is on a level that is problematic.

E: Melt-adhesion matter of 0.4 mm to 1 mm in diameter is present at ten to twenty spots on the drum, appears on images, and is on a level that is problematic.

F: Melt-adhesion matter of more than 1 mm in diameter is present on the drum over its whole surface, appears on images in a large number, and is on a level that is problematic and intolerable in practical use.

(7) Photosensitive Member Cleanability:

In the 10,000-sheet running test in the environment of N/L, it was visually examined how the photosensitive member (drum) was cleanable, according to the following criteria.

A: No faulty cleaning is seen at all.

B: Faulty cleaning is seen in a length of 1 mm or less at several spots on the drum, but of no problem on images at all.

C: Faulty cleaning is seen in a length of 1 mm to 4 mm at several spots on the drum and appears slightly on images, but is not on a level that is problematic in practical use.

D: Faulty cleaning is seen in a length of mm or more at ten spots or more on the drum, appears on images, and is on a level that is problematic.

E: Faulty cleaning is seen in a length of 4 mm to 10 mm at ten to twenty spots on the drum, appears on images, and is on a level that is problematic.

F: Faulty cleaning is seen in a length of more than 10 mm on the drum over its whole surface, appears on images in a large number, and is on a level that is problematic and untolerable in practical use.

(8) Image Quality Evaluation:

In the 10,000-sheet running test in the environment of H/H, image quality was evaluated (overall evaluation on 5-point characters, line images and solid images) visually and with a loupe. Evaluation was made according to the following criteria.

A: No spot around line images is seen, line images and character images are sharp, and solid images are also uniform and good.

B: Spots around line images are somewhat seen in inspection with a loupe, but of no problem at all in visual inspection, and solid images are also uniform and good.

C: Some spots around line images and character images are seen in visual inspection, but are not on a level that is problematic in practical use.

D: Many spots around line images and character images are seen in visual inspection, but are not on a level that is barely not problematic in ordinary use.

E: Many spots around line images and character images are seen in visual inspection, and are on a level that is problematic.

F: Many spots around line images and character images are seen in visual inspection, and are intolerable in practical use.

G: Not only line images and character images but also solid images have no uniformity with poor quality, and are intolerable in practical use.

(9) Evaluation on Toner Scatter:

In the 10,000-sheet running test in the environment of H/H, evaluation on toner scatter was made by the quantity of toner accumulating beneath the developing sleeve and inside the machine.

A: No toner accumulates at all beneath the developing sleeve and inside the machine, showing good results.

B: A toner layer is slightly seen beneath the developing sleeve, but no toner scattered inside the machine is seen, showing good results.

C: Toner is somewhat scattered beneath the developing sleeve and inside the machine, but not on a level that is problematic.

D: Toner is scattered beneath the developing sleeve and inside the machine, and on a level that is problematic.

E: Toner is scattered beneath the developing sleeve and inside the machine from place to place, and intolerable in practical use.

F: The inside of the machine is soiled with toner color, and image defects frequently occur, which is intolerable in practical use.

(10) Fixing Winding Test:

The winding of paper around the fixing roller was tested at the initial stage of the 10,000-sheet running test in the environment of H/H. On EN100 (64 g paper) perfectly moisture-conditioned paper (transfer sheet), a solid toner image was put in a toner laid-on quantity of 1.1 mg/cm$^2$ from the position of 1 mm from the leading end of the transfer sheet to form an unfixed toner image. This was fixed using a fixing assembly iRC3200 (manufactured by CANON INC). Here, fixing temperature was dropped 5° C. by 5° C. to perform fixing, where the temperature at which the transfer sheet winds around the fixing roller was regarded as fixing winding temperature.

(11) Blocking Test:

10 g of the toner was placed in a 50 cc plastic cup. This was left standing for 3 days (72 hours) in a 53° C. thermostatic chamber, and then the state of the toner was visually judged as shown below.

A: No blocking at all, and the toner is substantially the same as at the initial stage.

B: The toner somewhat tends to agglomerate, but is in such a state that agglomerates can be broken up when the plastic cup is turned, and is not especially problematic.

C: The toner tends to agglomerate, but is in such a state that agglomerates can be loosened by hand, and is somehow tolerable in practical use.

D: The toner agglomerates so seriously as to be problematic in practical use.

E: The toner stands solidified, and is not usable.

(12) Measurement of Transfer Efficiency:

The transfer efficiency of toner was ascertained at the last stage of the 10,000-sheet running test in the environment of H/H. A solid toner image with a toner image laid-on quantity of 0.65 mg/cm$^2$ was formed by development on the drum, and thereafter transferred to EN100 (64 g paper) to form an unfixed toner image. The transfer efficiency of toner was found from the difference in weight between the weight of toner on drum and the weight of toner on transfer sheet (the transfer efficiency is regarded as 100% when the toner on drum is all transferred to the transfer sheet).

A: Transfer efficiency is 95% or more.

B: Transfer efficiency is 90% or more to less than 95%.

C: Transfer efficiency is 80% or more to less than 90%.

D: Transfer efficiency is 70% or more to less than 80%.

E: Transfer efficiency is less than 70%.

(13) Tint Variation Test:

Prints of a photographic image having Y, M and C primary colors and R, G and B secondary colors were sampled in 10 sheets each at the initial stage and after 10,000-sheet running. Tints of the printed images at the initial stage and after 10,000-sheet running were visually inspected to make evaluation as shown below.

A: No tint variation is seen at all.

B: Tint variation is little seen.

C: Tint variation is somewhat seen, and is on such a level that it is noticed by sever users.

D: Tint variation is seen, and is on a such level that it is noticed by users.

E: Tints differ so greatly as to bring about a problem in practical use.

Examples 2 to 26

Developers Nos. 2 to 31 were produced using toners or toners in combination with carriers as shown in Tables 1A and 1B. Evaluation was made in the same manner as in Example 1 but changing the developer as shown in Table 2. The results obtained are shown in Table 2. In addition, in respect of Examples 17, 18 and 21, evaluation was made on cyan colors in the case of full-color image reproduction.

In the case when two-component developers were used, developers and an image-forming apparatus were employed which were prepared and remodeled, respectively, in the following way.

Figure 2:
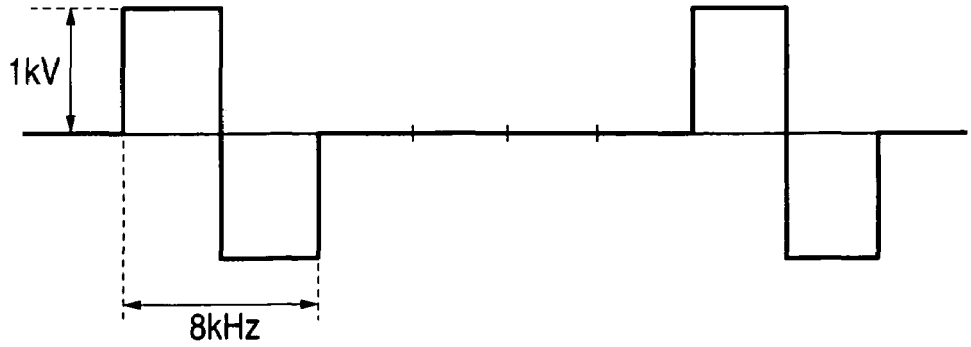
FIG. 2 illustrates an alternating electric field used in Example 1.

First, 92 parts of each magnetic carrier and 8 parts of each toner were blended by means of a V-type mixer to make up each developer. To make evaluation using the two-component developers, as an image-forming apparatus, a commercially available digital copying machine CP2150 (manufactured by CANON INC.) was remodeled into a copying machine having a fixing speed of 150 mm/s and being able to reproduce images on 35 sheets/minute. The copying machine was also so remodeled that the developing assembly and charging assembly as shown in FIG. 1 were able to be set in, and the one making use of the development bias shown in FIG. 2 was used. In the fixing assembly, both the heating roller and the pressure roller were changed for rollers the surface layers of which were coated with PFA in a thickness of 1.2 μm. The copying machine was also so modified as to be in a form in which all contact members other than the pressure rollers of the oil application mechanism were removed.

Comparative Examples 1 to 7

Using Comparative Toners No. 1 to No. 7, tests and evaluation were conducted in the same manner as in Example 1. The results are shown in Table 2.

TABLE 1A

| | | | Developer (Composition) | | | | | | | | | | |
|---|---|---|---|---|---|---|---|---|---|---|---|---|---|
| | | | Toner particles | | | | | | | | | | |
| | | | | | | Release agent | | | | | | | |
| | | | Polar resin | | | Content in | | Charge control | | Inorganic fine powder | | | |
| | Toner No. | Carrier No. | No. | Acid val. | Type | toner (pbw) | Colorant Type | agent Type | Produced by: | Type 1 (pbw) | Amt. | Type 2 (pbw) | Amt. |
| Developer No. | | | | | | | | | | | | | |
| 1 | 1 | — | 1 | 12 | Est.Wx | 15.7 | Cu Pc. | Sal.Al | Sus.P. | Hpho.Si | 1.2 | Hpho.Ti | 0.2 |
| 2 | 2 | — | 2 | 11 | Est.Wx | 15.4 | Cu Pc. | Sal.Al | Sus.P. | Hpho.Si | 1.2 | Hpho.Ti | 0.2 |
| 3 | 3 | — | 3 | 13 | Est.Wx | 15.4 | Cu Pc. | Sal.Al | Sus.P. | Hpho.Si | 1.2 | Hpho.Ti | 0.2 |
| 4 | 4 | — | 4 | 13 | Est.Wx | 15.7 | Cu Pc. | Sal.Al | Sus.P. | Hpho.Si | 1.2 | Hpho.Ti | 0.2 |
| 5 | 5 | — | 5 | 10 | Est.Wx | 14.0 | Cu Pc. | Sal.Al | Sus.P. | Hpho.Si | 1.2 | Hpho.Ti | 0.2 |
| 6 | 6 | — | 6 | 4 | Est.Wx | 15.7 | Cu Pc. | Sal.Al | Sus.P. | Hpho.Si | 1.2 | Hpho.Ti | 0.2 |
| 7 | 7 | — | 7 | 22 | Est.Wx | 15.7 | Cu Pc. | Sal.Al | Sus.P. | Hpho.Si | 1.2 | Hpho.Ti | 0.2 |
| 8 | 8 | — | 6 | 4 | Est.Wx | 15.7 | Cu Pc. | Sal.Al | Sus.P. | Hpho.Si | 1.5 | Hpho.Ti | 0.3 |
| 9 | 9 | — | 7 | 22 | Est.Wx | 15.7 | Cu Pc. | Sal.Al | Sus.P. | Hpho.Si | 0.7 | Hpho.Ti | 0.1 |
| 10 | 10 | — | 6 | 4 | Est.Wx | 27.2 | Cu Pc. | Sal.Al | Sus.P. | Hpho.Si | 1.8 | Hpho.Ti | 0.5 |
| 11 | 11 | — | 7 | 22 | Est.Wx | 2.7 | Cu Pc. | Sal.Al | Sus.P. | Hpho.Si | 1.2 | Hpho.Ti | 0.2 |
| 12 | 12 | — | 7 | 22 | Est.Wx | 2.7 | Cu Pc. | Sal.Al | Sus.P. | Hpho.Si | 1.5 | Hpho.Ti | 0.3 |
| 13 | 13 | — | 7 | 22 | Est.Wx | 2.7 | Cu Pc. | Sal.Al | Sus.P. | Hpho.Si | 1.8 | Hpho.Ti | 0.4 |
| 14 | 14 | — | 1 | 12 | Est.Wx | 7.6 | Magnt. | Sal.Al | Sus.P. | Hpho.Si | 1.2 | Hpho.Ti | 0.05 |
| 15 | 15 | — | 7 | 22 | Est.Wx | 8.3 | Cu Pc. | Sal.Al | Sus.P. | Hpho.Si | 1.2 | Hpho.Ti | 0.2 |
| 16 | 16 | — | 5 | 10 | Est.Wx | 7.5 | Cu Pc. | Sal.Al | Sus.P. | Hpho.Si | 1.2 | Hpho.Ti | 0.2 |
| 17 | 17 | — | 1 | 12 | Est.Wx | 15.9 | PY93 | Sal.Al | Sus.P. | Hpho.Si | 1.2 | Hpho.Ti | 0.2 |
| 18 | 18 | — | 1 | 12 | Est.Wx | 15.9 | Quinc. | Sal.Al | Sus.P. | Hpho.Si | 1.2 | Hpho.Ti | 0.2 |
| 19 | 19 | — | 1 | 12 | Est.Wx | 15.9 | Carbk. | Sal.Al | Sus.P. | Hpho.Si | 1.2 | Hpho.Ti | 0.2 |
| 20 | 20 | 1 | 1 | 12 | Est.Wx | 15.9 | Cu Pc. | Sal.Al | Sus.P. | Hpho.Si | 1 | Hpho.Ti | 0.4 |
| 21 | 21 | 1 | 1 | 12 | Est.Wx | 15.9 | PY93 | Sal.Al | Sus.P. | Hpho.Si | 1 | Hpho.Ti | 0.4 |
| 22 | 22 | 1 | 1 | 12 | Est.Wx | 15.9 | Quinc. | Sal.Al | Sus.P. | Hpho.Si | 1 | Hpho.Ti | 0.4 |
| 23 | 23 | 1 | 1 | 12 | Est.Wx | 15.9 | Carbk. | Sal.Al | Sus.P. | Hpho.Si | 1 | Hpho.Ti | 0.4 |
| 24 | 24 | — | 3 | 13 | Est.Wx | 15.9 | Cu Pc. | Sal.Al | Sus.P. | Hpho.Si | 1.2 | Hpho.Ti | 0.2 |
| 25 | 25 | — | 3 | 13 | PE Wx | 15.9 | Cu Pc. | Sal.Al | Sus.P. | Hpho.Si | 1.2 | Hpho.Ti | 0.2 |
| 26 | 26 | — | 1 | 12 | Est.Wx | 15.7 | Cu Pc. | — | Sus.P. | Hpho.Si | 1.2 | Hpho.Ti | 0.2 |
| 27 | 27 | — | 1 | 12 | Est.Wx | 15.7 | Cu Pc. | Sal.Zr | Sus.P. | Hpho.Si | 1.2 | Hpho.Ti | 0.2 |
| 28 | 28 | — | 1 | 12 | Est.Wx | 15.7 | Cu Pc. | Sal.Zn | Sus.P. | Hpho.Si | 1.2 | Hpho.Ti | 0.2 |
| 29 | 20 | 2 | 1 | 12 | Est.Wx | 15.9 | Cu Pc. | Sal.Al | Sus.P. | Hpho.Si | 1 | Hpho.Ti | 0.4 |
| 30 | 29 | — | 8 | 12 | Est.Wx | 15.4 | Cu Pc. | Sal.Al | Sus.P. | Hpho.Si | 1.2 | Hpho.Ti | 0.2 |
| 31 | 30 | — | 9 | 12 | Est.Wx | 15.4 | Cu Pc. | Sal.Al | Sus.P. | Hpho.Si | 1.2 | Hpho.Ti | 0.2 |
| Comparative: | | | | | | | | | | | | | |
| 1 | 1 | — | 1 | 21 | PP Wx | 2.3 | Cu Pc. | Sal.Al | Sus.P. | Hpho.Si | 0.9 | Hpho.Ti | 0 |
| 2 | 2 | — | 2 | 21 | PP Wx | 2.3 | Cu Pc. | Sal.Al | Sus.P. | Hpho.Si | 0.9 | Hpho.Ti | 0 |
| 3 | 3 | — | 3 | 1 | PP Wx | 2.3 | Cu Pc. | Sal.Al | Sus.P. | Hpho.Si | 0.9 | Hpho.Ti | 0 |
| 4 | 4 | — | 4 | 38 | PP Wx | 2.3 | Cu Pc. | Sal.Al | Sus.P. | Hpho.Si | 0.9 | Hpho.Ti | 0 |
| 5 | 5 | — | 6 | 4 | PP Wx | 2.3 | Cu Pc. | Sal.Al | Sus.P. | Hpho.Si | 1.1 | Hpho.Ti | 0 |
| 6 | 6 | — | 7 | 22 | PP Wx | 2.3 | Cu Pc. | Sal.Al | Sus.P. | Hpho.Si | 0.7 | Hpho.Ti | 0 |
| 7 | 7 | — | — | — | PP Wx | 2.4 | Cu Pc. | Sal.Al | Eml.P. | Hpho.Si | 0.9 | Hpho.Ti | 0 |

Est.Wx: ester wax;
PE Wx: polyethylene wax;
PP Wx: polypropylene wax;
Cu Pc.: copper phthalocyanine;
Magnt.: magnetite;
Quinc.: quinacridone;
Carbk.: carbon black
Sal.Al: salicylic acid aluminum compound;
Sal.Zn: salicylic acid zinc compound
Sus.P.: suspension polymerization;
Eml.P.: Emulsion polymerization
Hpho.Si: hydrophobic silica;
Hpho.Ti: hydrophobic titanium oxide

TABLE 1B

| | | | Developer (Physical Properties) | | | | | | | | | | | |
|---|---|---|---|---|---|---|---|---|---|---|---|---|---|---|
| | | | Toner physical properties | | | | | | | | | | | |
| | Toner No. | Carrier No. | Wt. Av. particle diam. (μm) | Water/ methanol wettability test TA | TB | TB − TA | Endothermic peak temp. (° C.) | Endothermic peak half width | Mn | Mw (×10³) | MI | Tg (° C.) | SF-1 | SF-2 |
| Developer No. | | | | | | | | | | | | | | |
| 1 | 1 | — | 6.9 | 42 | 61 | 19 | 70 | 4 | 1.7 | 11.0 | 12 | 59.7 | 111 | 106 |
| 2 | 2 | — | 6.8 | 43 | 60 | 17 | 70 | 4 | 2.5 | 13.2 | 7 | 59.4 | 112 | 107 |
| 3 | 3 | — | 6.9 | 42 | 62 | 20 | 70 | 4 | 1.8 | 11.6 | 11 | 60.3 | 109 | 106 |
| 4 | 4 | — | 6.8 | 42 | 63 | 21 | 70 | 4 | 1.7 | 11.3 | 12 | 59.6 | 112 | 107 |
| 5 | 5 | — | 6.9 | 44 | 62 | 18 | 70 | 4 | 2.2 | 12.4 | 9 | 59.4 | 112 | 107 |
| 6 | 6 | — | 6.8 | 48 | 68 | 20 | 70 | 4 | 2.0 | 12.0 | 10 | 58.9 | 114 | 107 |
| 7 | 7 | — | 6.7 | 38 | 57 | 19 | 70 | 4 | 1.3 | 9.7 | 14 | 59.3 | 112 | 108 |
| 8 | 8 | — | 4.9 | 41 | 63 | 22 | 70 | 4 | 1.4 | 10.1 | 15 | 58.9 | 114 | 107 |
| 9 | 9 | — | 9.2 | 38 | 56 | 18 | 70 | 4 | 1.6 | 11.5 | 14 | 59.3 | 112 | 108 |
| 10 | 10 | — | 6.7 | 70 | 91 | 21 | 70 | 4 | 1.2 | 9.2 | 18 | 58.1 | 115 | 110 |
| 11 | 11 | — | 6.8 | 7 | 38 | 31 | 70 | 4 | 1.8 | 11.8 | 12 | 59.7 | 111 | 107 |
| 12 | 12 | — | 6.7 | 7 | 55 | 48 | 70 | 4 | 1.8 | 11.8 | 12 | 59.7 | 111 | 107 |
| 13 | 13 | — | 6.8 | 7 | 69 | 62 | 70 | 4 | 1.8 | 11.8 | 12 | 59.7 | 111 | 107 |
| 14 | 14 | — | 6.5 | 28 | 42 | 14 | 70 | 4 | 2.0 | 15.6 | 23 | 60.3 | 111 | 109 |
| 15 | 15 | — | 5.8 | 41 | 54 | 13 | 70 | 4 | 2.2 | 12.5 | 15 | 60.2 | 131 | 138 |
| 16 | 16 | — | 6.8 | 37 | 59 | 22 | 70 | 4 | 2.2 | 12.4 | 14 | 60.2 | 106 | 108 |
| 17 | 17 | — | 6.8 | 43 | 60 | 17 | 70 | 4 | 1.6 | 11.3 | 12 | 60.2 | 112 | 108 |
| 18 | 18 | — | 6.8 | 42 | 63 | 21 | 70 | 4 | 1.6 | 11.2 | 12 | 59.8 | 110 | 108 |
| 19 | 19 | — | 6.8 | 37 | 54 | 17 | 70 | 4 | 1.8 | 11.4 | 12 | 60.1 | 112 | 109 |
| 20 | 20 | 1 | 6.9 | 42 | 61 | 19 | 70 | 4 | 1.7 | 11.0 | 12 | 59.7 | 111 | 106 |
| 21 | 21 | 1 | 6.8 | 42 | 59 | 17 | 70 | 4 | 1.6 | 11.3 | 12 | 60.2 | 112 | 108 |
| 22 | 22 | 1 | 6.8 | 47 | 62 | 15 | 70 | 4 | 1.6 | 11.2 | 12 | 59.8 | 110 | 108 |
| 23 | 23 | 1 | 6.7 | 37 | 54 | 17 | 70 | 4 | 1.8 | 11.4 | 12 | 60.1 | 112 | 109 |
| 24 | 24 | — | 6.9 | 42 | 62 | 20 | 48 | 4 | 1.2 | 8.7 | 21 | 57.6 | 114 | 109 |
| 25 | 25 | — | 6.9 | 42 | 62 | 20 | 122 | 17 | 2.0 | 13.4 | 10 | 59.8 | 112 | 108 |
| 26 | 26 | — | 6.8 | 41 | 60 | 19 | 70 | 4 | 1.7 | 11.0 | 12 | 59.7 | 111 | 106 |
| 27 | 27 | — | 6.9 | 40 | 60 | 20 | 70 | 4 | 1.6 | 10.9 | 12 | 59.7 | 112 | 105 |
| 28 | 28 | — | 6.8 | 40 | 59 | 19 | 70 | 4 | 1.6 | 10.9 | 12 | 59.7 | 110 | 105 |
| 29 | 20 | 2 | 6.9 | 42 | 61 | 19 | 70 | 4 | 1.7 | 11.0 | 12 | 59.7 | 111 | 106 |
| 30 | 29 | — | 6.8 | 41 | 61 | 20 | 70 | 4 | 1.7 | 11.3 | 12 | 60.4 | 108 | 106 |
| 31 | 30 | — | 6.9 | 42 | 63 | 21 | 70 | 4 | 1.8 | 11.6 | 11 | 60.4 | 107 | 105 |
| Comparative: | | | | | | | | | | | | | | |
| 1 | 1 | — | 6.9 | 32 | 37 | 5 | 129 | 22 | 1.9 | 12.8 | 10 | 59.8 | 111 | 108 |
| 2 | 2 | — | 6.9 | 32 | 35 | 3 | 129 | 22 | 1.8 | 12.7 | 11 | 59.7 | 112 | 108 |
| 3 | 3 | — | 6.9 | 34 | 37 | 3 | 129 | 22 | 2.1 | 13.2 | 10 | 59.8 | 111 | 108 |
| 4 | 4 | — | 6.9 | 29 | 34 | 5 | 129 | 22 | 1.3 | 9.8 | 16 | 57.9 | 114 | 109 |
| 5 | 5 | — | 3.4 | 21 | 36 | 15 | 129 | 22 | 1.4 | 10.1 | 15 | 58.9 | 115 | 108 |
| 6 | 6 | — | 10.9 | 41 | 46 | 5 | 129 | 22 | 1.6 | 11.5 | 14 | 59.2 | 109 | 106 |
| 7 | 7 | — | 6.8 | 41 | 48 | 7 | 129 | 22 | 1.2 | 11.1 | 15 | 58.1 | 131 | 138 |

TABLE 2A

| | | | Examples & Comparative Examples (Evaluation Results) | | | | | | | | |
|---|---|---|---|---|---|---|---|---|---|---|---|
| | | | Fixing | Low-temp. fixing performance | High-temp. anti-offset properties | Fog | | | | | |
| | | | | | | Initial stage | | | | After 10,000 sheets | |
| | Developer No. | OHT transparency | winding temp. (° C.) | Initial stage 15° C./10% RH | Initial stage N/N | (3rd sh.) N/L | (3rd sh.) H/H | (30th sh.) N/L | (30th sh.) H/H | N/L | H/H |
| Example: | | | | | | | | | | | |
| 1 | 1 | B | 160 | 155 | B | 0.8 | 1 | 0.6 | 0.8 | 1 | 1.2 |
| 2 | 2 | C | 165 | 165 | A | 0.6 | 0.8 | 0.4 | 0.7 | 0.8 | 0.9 |
| 3 | 3 | B | 160 | 155 | B | 0.8 | 0.8 | 0.6 | 0.6 | 1 | 1 |
| 4 | 4 | B | 160 | 155 | B | 1 | 0.7 | 0.8 | 0.5 | 1.2 | 0.9 |
| 5 | 5 | B | 165 | 160 | A | 0.6 | 0.7 | 0.5 | 0.8 | 0.8 | 0.9 |

TABLE 2A-continued

Examples & Comparative Examples (Evaluation Results)

| | Developer No. | OHT transparency | Fixing winding temp. (° C.) | Low-temp. fixing performance Initial stage 15° C./10% RH | High-temp. anti-offset properties Initial stage N/N | Fog Initial stage (3rd sh.) N/L | Fog Initial stage (3rd sh.) H/H | Fog Initial stage (30th sh.) N/L | Fog Initial stage (30th sh.) H/H | Fog After 10,000 sheets N/L | Fog After 10,000 sheets H/H |
|---|---|---|---|---|---|---|---|---|---|---|---|
| 6 | 6 | B | 160 | 155 | B | 1.2 | 1.3 | 1.1 | 1.2 | 1.4 | 1.5 |
| 7 | 7 | B | 155 | 150 | B | 1.2 | 0.6 | 1.1 | 0.6 | 1.3 | 0.6 |
| 8 | 8 | B | 160 | 155 | B | 1.3 | 1.3 | 1.2 | 1.2 | 1.5 | 1.5 |
| 9 | 9 | B | 160 | 150 | B | 0.8 | 0.6 | 0.9 | 0.6 | 1.1 | 1 |
| 10 | 10 | B | 150 | 150 | A | 1 | 1.3 | 0.8 | 1.1 | 1.4 | 1.7 |
| 11 | 11 | A | 170 | 165 | C | 1.1 | 1.8 | 0.9 | 1.1 | 1.3 | 1.8 |
| 12 | 12 | A | 170 | 165 | C | 0.7 | 1.1 | 0.5 | 1.1 | 1.4 | 1.9 |
| 13 | 13 | A | 170 | 165 | C | 0.8 | 2 | 0.6 | 1.2 | 1.5 | 1.9 |
| 14 | 14 | — | 170 | 170 | B | 1.1 | 1.1 | 0.9 | 0.9 | 1.3 | 1.3 |
| 15 | 15 | A | 170 | 160 | C | 1.5 | 1.6 | 1.3 | 1.4 | 1.7 | 1.8 |
| 16 | 16 | A | 170 | 160 | C | 1.3 | 1.3 | 0.9 | 0.9 | 1.3 | 1.3 |
| 17 | 1, 17 | B | 160 | 155 | B | 0.9 | 1.1 | 0.7 | 0.9 | 1.1 | 1.3 |
| 18 | 18, 19 20, 21 22, 23 | B | 160 | 155 | B | 0.7 | 0.7 | 0.5 | 0.5 | 0.9 | 0.9 |
| 19 | 24 | B | 160 | 160 | B | 1.3 | 1.4 | 1.5 | 1.6 | 2.3 | 2.4 |
| 20 | 25 | B | 175 | 170 | A | 0.8 | 0.8 | 0.6 | 0.6 | 1 | 1 |
| 21 | 29, 21 22, 23 | B | 160 | 155 | B | 0.7 | 0.7 | 1.3 | 1.4 | 2.8 | 2.6 |
| 22 | 26 | B | 160 | 155 | B | 1.5 | 1.6 | 1.5 | 1.8 | 1.4 | 1.6 |
| 23 | 27 | B | 160 | 155 | B | 0.8 | 1 | 0.6 | 0.8 | 1 | 1.2 |
| 24 | 28 | B | 160 | 155 | B | 1.3 | 1.2 | 1.1 | 1.2 | 1 | 1.2 |
| 25 | 30 | B | 160 | 155 | B | 0.7 | 0.8 | 0.6 | 0.6 | 0.9 | 1.1 |
| 26 | 31 | B | 160 | 155 | B | 0.5 | 0.4 | 0.2 | 0.2 | 0.4 | 0.4 |
| Comparative Example: | | | | | | | | | | | |
| 1 | 1 | C | 185 | 175 | D | 1.9 | 2.9 | 1.1 | 2.1 | 1.2 | 1.1 |
| 2 | 2 | C | 185 | 175 | D | 1.8 | 2.8 | 1.0 | 2.0 | 1.2 | 1.0 |
| 3 | 3 | C | 185 | 175 | D | 3.2 | 3.7 | 3.1 | 3.3 | 3.4 | 3.9 |
| 4 | 4 | C | 185 | 175 | D | 1.8 | 1.9 | 1 | 1.1 | 4.4 | 1.6 |
| 5 | 5 | C | 185 | 175 | D | 4.7 | 4.2 | 3.9 | 3.4 | 2.9 | 2.4 |
| 6 | 6 | C | 185 | 175 | D | 2.1 | 2.6 | 1.3 | 1.8 | 1 | 1.5 |
| 7 | 7 | E | 195 | 190 | E | 3.7 | 3.4 | 2.9 | 2.6 | 1.9 | 1.6 |

TABLE 2B

Examples & Comparative Examples (Evaluation Results)

| | Image density Initial stage (3rd sh.) N/L | Image density Initial stage (3rd sh.) H/H | Image density Initial stage (30th sh.) N/L | Image density Initial stage (30th sh.) H/H | Image density After 10,000 sh. N/L | Image density After 10,000 sh. H/H | Tint variation | Image quality | Faulty cleaning in N/L initial stage | Toner scatter in H/H after 10,000 sheets | Transfer efficiency in H/H after 10,000 sheets | Blocking | Melt adhesion in H/H after 10,000 sheets |
|---|---|---|---|---|---|---|---|---|---|---|---|---|---|
| Example: | | | | | | | | | | | | | |
| 1 | 1.51 | 1.49 | 1.5 | 1.51 | 1.53 | 1.51 | A | B | A | A | A | A | A |
| 2 | 1.51 | 1.5 | 1.5 | 1.52 | 1.53 | 1.52 | A | B | A | A | A | A | A |
| 3 | 1.49 | 1.51 | 1.48 | 1.53 | 1.51 | 1.53 | A | B | A | A | A | A | A |
| 4 | 1.51 | 1.5 | 1.5 | 1.52 | 1.53 | 1.52 | A | B | A | A | A | A | A |
| 5 | 1.52 | 1.51 | 1.51 | 1.53 | 1.54 | 1.53 | A | B | A | A | A | A | A |
| 6 | 1.45 | 1.44 | 1.44 | 1.46 | 1.51 | 1.5 | A | B | A | B | A | A | A |
| 7 | 1.5 | 1.51 | 1.48 | 1.53 | 1.46 | 1.53 | A | B | A | B | A | A | A |
| 8 | 1.46 | 1.46 | 1.48 | 1.49 | 1.44 | 1.48 | A | B | C | C | A | A | B |
| 9 | 1.49 | 1.52 | 1.48 | 1.54 | 1.47 | 1.54 | A | C | A | A | A | A | A |
| 10 | 1.49 | 1.47 | 1.46 | 1.52 | 1.44 | 1.52 | B | B | B | B | B | B | B |
| 11 | 1.51 | 1.51 | 1.5 | 1.56 | 1.53 | 1.56 | A | C | A | A | B | A | A |
| 12 | 1.52 | 1.49 | 1.51 | 1.51 | 1.54 | 1.54 | B | B | A | B | A | A | A |
| 13 | 1.51 | 1.51 | 1.5 | 1.53 | 1.53 | 1.56 | C | B | A | B | A | A | A |

TABLE 2B-continued

Examples & Comparative Examples (Evaluation Results)

| | Image density | | | | | | | | Faulty cleaning | Toner scatter in H/H | Transfer efficiency in H/H | | Melt adhesion in H/H |
|---|---|---|---|---|---|---|---|---|---|---|---|---|---|
| | Initial stage | | | | After | | | | in N/L | after | after | | after |
| | (3rd sh.) | | (30th sh.) | | 10,000 sh. | | Tint | Image | initial | 10,000 | 10,000 | | 10,000 |
| | N/L | H/H | N/L | H/H | N/L | H/H | variation | quality | stage | sheets | sheets | Blocking | sheets |
| 14 | 1.45 | 1.47 | 1.44 | 1.47 | 1.47 | 1.47 | — | B | A | A | B | A | A |
| 15 | 1.45 | 1.47 | 1.44 | 1.49 | 1.47 | 1.49 | A | B | A | A | C | B | A |
| 16 | 1.49 | 1.51 | 1.48 | 1.53 | 1.51 | 1.53 | A | B | A | A | A | B | A |
| 17 | 1.49 | 1.52 | 1.48 | 1.54 | 1.51 | 1.54 | A | B | A | A | A | A | A |
| 18 | 1.51 | 1.51 | 1.5 | 1.53 | 1.53 | 1.53 | A | B | A | A | A | A | A |
| 19 | 1.49 | 1.51 | 1.48 | 1.53 | 1.51 | 1.53 | A | B | A | C | B | C | A |
| 20 | 1.49 | 1.51 | 1.48 | 1.53 | 1.51 | 1.53 | A | B | A | A | A | A | A |
| 21 | 1.51 | 1.51 | 1.57 | 1.54 | 1.64 | 1.64 | C | C | A | B | C | A | B |
| 22 | 1.41 | 1.41 | 1.45 | 1.45 | 1.53 | 1.51 | C | B | A | C | A | A | A |
| 23 | 1.51 | 1.49 | 1.5 | 1.51 | 1.53 | 1.51 | A | B | A | A | A | A | A |
| 24 | 1.45 | 1.45 | 1.5 | 1.51 | 1.53 | 1.51 | B | C | A | B | A | A | A |
| 25 | 1.48 | 1.51 | 1.48 | 1.53 | 1.49 | 1.53 | A | B | A | A | A | A | A |
| 26 | 1.55 | 1.55 | 1.55 | 1.55 | 1.55 | 1.55 | A | A | A | A | A | A | A |
| Comparative Example: | | | | | | | | | | | | | |
| 1 | 1.34 | 1.33 | 1.45 | 1.39 | 1.49 | 1.45 | B | C | A | C | B | A | A |
| 2 | 1.36 | 1.34 | 1.46 | 1.41 | 1.48 | 1.46 | B | C | A | C | B | A | A |
| 3 | 1.31 | 1.21 | 1.35 | 1.36 | 1.48 | 1.46 | B | C | A | E | C | A | A |
| 4 | 1.41 | 1.37 | 1.48 | 1.47 | 1.31 | 1.43 | B | D | A | C | B | A | A |
| 5 | 1.35 | 1.28 | 1.48 | 1.41 | 1.49 | 1.45 | C | C | E | E | D | A | D |
| 6 | 1.34 | 1.28 | 1.46 | 1.41 | 1.49 | 1.43 | C | E | A | B | B | B | A |
| 7 | 1.35 | 1.26 | 1.43 | 1.42 | 1.49 | 1.45 | D | C | A | D | D | B | A |

As having been described above, in virtue of the use of the toner incorporated with the polyester resin having an appropriate acid value, produced by polymerization carried out in the presence of the titanium chelate compound as a catalyst, the rise of charging can be so quick that images stable in image density, free of fog and superior in stability during running can be obtained even in continuous printing on a large number of sheets. Also, this polar resin and the release agent interact to make it possible to provide toners having a broad fixing temperature range, without causing deterioration in developing performance.

The present invention makes it possible to provide stable images over a long period of time.

What is claimed is:

1. A toner comprising: toner particles containing at least a colorant, a release agent, a polar resin, and an inorganic fine powder, wherein said polar resin contains (a) at least 3% by weight of said polar resin of a polyester resin unit obtained by carrying out polymerization in the presence of from 0.01% by weight to 2% by weight titanium chelate compound as a catalyst, and (b) has an acid value of from 3 mg×KOH/g to 35 mg×KOH/g;

said toner particles are obtained by carrying out granulation in an aqueous medium;

said toner has a weight average particle diameter of from 4 μm to 10 μm; and wherein in said titanium chelate compound, its chelating compound is a diol, a dicarboxylic acid or an oxycarboxylic acid.

2. The toner according to claim 1, wherein said titanium chelate compound is a compound represented by any of the following Formulas (I) to (VIII), or a hydrate thereof:

Formula (I)

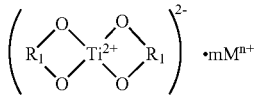

wherein $R_1$'s each represent an alkylene group or alkenylene group having 2 to 10 carbon atoms, which may have a substituent; and M represents a counter cation, m represents the number of the cation and n represents a valence number of the cation, where n is 2 when m is 1 and n is 1 when m is 2; when n is 1, M represents a hydrogen ion, an alkali metal ion, an ammonium ion or an organoammonium ion, and when n is 2, an alkaline earth metal ion;

Formula (II)

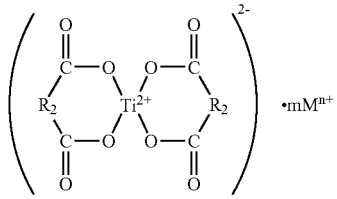

wherein $R_2$'s each represent an alkylene group or alkenylene group having 1 to 10 carbon atoms, which may have a substituent; and M represents a counter cation, m represents the number of the cation and n represents a valence number of the cation, where n is 2 when m is 1 and n is 1 when m is 2; when n is 1, M represents a hydrogen ion, an alkali metal ion, an ammonium ion or an organoammonium ion, and when n is 2, an alkaline earth metal ion;

Formula (III)

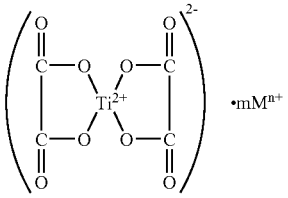

wherein M represents a counter cation, m represents the number of the cation and n represents a valence number of the cation, where n is 2 when m is 1 and n is 1 when m is 2; when n is 1, M represents a hydrogen ion, an alkali metal ion, an ammonium ion or an organoammonium ion, and when n is 2, an alkaline earth metal ion;

Formula (IV)

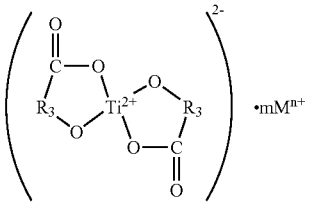

wherein $R_3$'s each represent an alkylene group or alkenylene group having 1 to 10 carbon atoms, which may have a substituent; and M represents a counter cation, m represents the number of the cation and n represents a valence number of the cation, where n is 2 when m is 1 and n is 1 when m is 2; when n is 1, M represents a hydrogen ion, an alkali metal ion, an ammonium ion or an organoammonium ion, and when n is 2, an alkaline earth metal ion;

Formula (V)

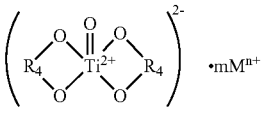

wherein $R_4$'s each represent an alkylene group or alkenylene group having 2 to 10 carbon atoms, which may have a substituent; and M represents a counter cation, m represents the number of the cation and n represents a valence number of the cation, where n is 2 when m is 1 and n is 1 when m is 2, and, when n is 1, M represents a hydrogen ion, an alkali metal ion, an ammonium ion or an organoammonium ion, and when n is 2, an alkaline earth metal ion;

Formula (VI)

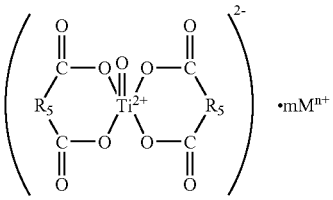

wherein $R_5$'s each represent an alkylene group or alkenylene group having 1 to 10 carbon atoms, which may have a substituent; and M represents a counter cation, m represents the number of the cation and n represents a valence number of the cation, where n is 2 when m is 1 and n is 1 when m is 2, and, when n is 1, M represents a hydrogen ion, an alkali metal ion, an ammonium ion or an organoammonium ion, and when n is 2, an alkaline earth metal ion;

Formula (VII)

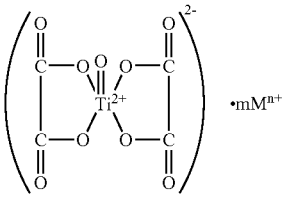

wherein M represents a counter cation, m represents the number of the cation and n represents a valence number of the cation, where n is 2 when m is 1 and n is 1 when m is 2, and, when n is 1, M represents a hydrogen ion, an alkali metal ion, an ammonium ion or an organoammonium ion, and when n is 2, an alkaline earth metal ion; and Formula (VIII)

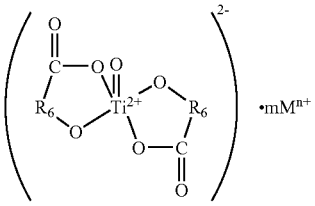

wherein $R_6$'s each represent an alkylene group or alkenylene group having 1 to 10 carbon atoms, which may have a substituent; and M represents a counter cation, m represents the number of the cation and n represents a valence number of the cation, where n is 2 when m is 1 and n is 1 when m is 2, and, when n is 1, M represents a hydrogen ion, an alkali metal ion, an ammonium ion or an organoammonium ion, and when n is 2, an alkaline earth metal ion.

3. The toner according to claim 2, wherein said titanium chelate compound is a compound represented by any of the above Formulas (II), (III), (VI) and (VII), or a hydrate thereof.

4. The toner according to claim 1, wherein in a water/methanol wettability test of said toner particles and said toner, a methanol per cent by weight of each of them at the time a transmittance becomes 50% of an initial value satisfies the following expressions:

$$10 \leqq TA \leqq 70;$$

$$30 \leqq TB \leqq 90; \text{ and}$$

$$0 \leqq TB - TA \leqq 60$$

where TA is the methanol per cent by weight of the toner particles, and TB is the methanol per cent by weight of the toner.

5. The toner according to claim 1, wherein in an endothermic curve of said toner measured by differential thermal analysis, a peak temperature of a maximum endothermic peak in a range from 30° C. to 200° C. is in a range from 50° C. to 120° C.

6. The toner according to claim 1, which contains a salicylic acid metal compound as a charge control agent.

7. The toner according to claim 6, wherein a metal of said salicylic acid metal compound used as a charge control agent is aluminum or zirconium.

8. The toner according to claim 1, wherein said polar resin has a hydroxyl value of 5 to 40 mg×KOH/g.

9. The toner according to claim 1, wherein said toner particles are particles produced by dispersing in an aqueous medium a polymerizable monomer composition which contains at least a polymerizable monomer, the colorant, the polar resin, the release agent, a charge control agent and a polymerization initiator, granulating the polymerizable monomer composition, and polymerizing the polymerizable monomer.

* * * * *